US009601103B2

(12) United States Patent
Guo et al.

(10) Patent No.: US 9,601,103 B2
(45) Date of Patent: Mar. 21, 2017

(54) METHODS AND DEVICES FOR GENERATING HIGH-AMPLITUDE AND HIGH-FREQUENCY FOCUSED ULTRASOUND WITH LIGHT-ABSORBING MATERIALS

(71) Applicant: The Regents of the University of Michigan, Ann Arbor, MI (US)

(72) Inventors: Lingjie Jay Guo, Ann Arbor, MI (US); Hyoung Won Baac, Revere, MA (US)

(73) Assignee: The Regents Of The University Of Michigan, Ann Arbor, MI (US)

( * ) Notice: Subject to any disclaimer, the term of this patent is extended or adjusted under 35 U.S.C. 154(b) by 469 days.

(21) Appl. No.: 14/057,019

(22) Filed: Oct. 18, 2013

(65) Prior Publication Data

US 2014/0112107 A1 Apr. 24, 2014

Related U.S. Application Data

(60) Provisional application No. 61/716,217, filed on Oct. 19, 2012.

(51) Int. Cl.

| | |
|---|---|
| ***G10K 11/36*** | (2006.01) |
| ***B06B 1/00*** | (2006.01) |
| ***G10K 11/32*** | (2006.01) |

(52) U.S. Cl.

CPC ..... *G10K 11/36* (2013.01); *B06B 1/00* (2013.01); *G10K 11/32* (2013.01)

(58) Field of Classification Search

CPC ..... G10K 11/36; G10K 11/32; B06B 1/00

(Continued)

(56) References Cited

U.S. PATENT DOCUMENTS 6,519,376 B2 2/2003 Biagi et al.
8,183,745 B2 5/2012 Trolier-McKinstry et al.

(Continued)

FOREIGN PATENT DOCUMENTS

WO WO2011/150231 * 12/2011 ..... G02B 26/02

OTHER PUBLICATIONS

All-Optical Transducer for Ultrasound and Photoacoustic Imaging by Dichroic Filtering, Boa-Yu Hseih, et al. IEEE International Ultasonics Symposium Proceedings, 2012.*

(Continued)

*Primary Examiner* — James Hulka
*Assistant Examiner* — John T Nolan
(74) *Attorney, Agent, or Firm* — Harness, Dickey & Pierce, PLC

(57) ABSTRACT

A high-frequency light-generated focused ultrasound (LGFU) device is provided. The device has a source of light energy, such as a laser, and an optoacoustic lens comprising a concave composite layer with a plurality of light absorbing particles that absorbs laser energy, e.g., carbon nanotubes, and a polymeric material that rapidly expands upon exposure to heat, e.g., polydimethylsiloxane. The laser energy is directed to the optoacoustic lens and thus can generate high-frequency (e.g., ≥10 MHz) and high-amplitude pressure output (e.g., ≥10 MPa) focused ultrasound. The disclosure also provides methods of making such new arcuate optoacoustic lenses, as well as methods for generating and using the high-frequency and high-amplitude ultrasound, including for surgery, like lithotripsy and ablation.

15 Claims, 26 Drawing Sheets

Figures 1A, 1B, 1C, 1D:
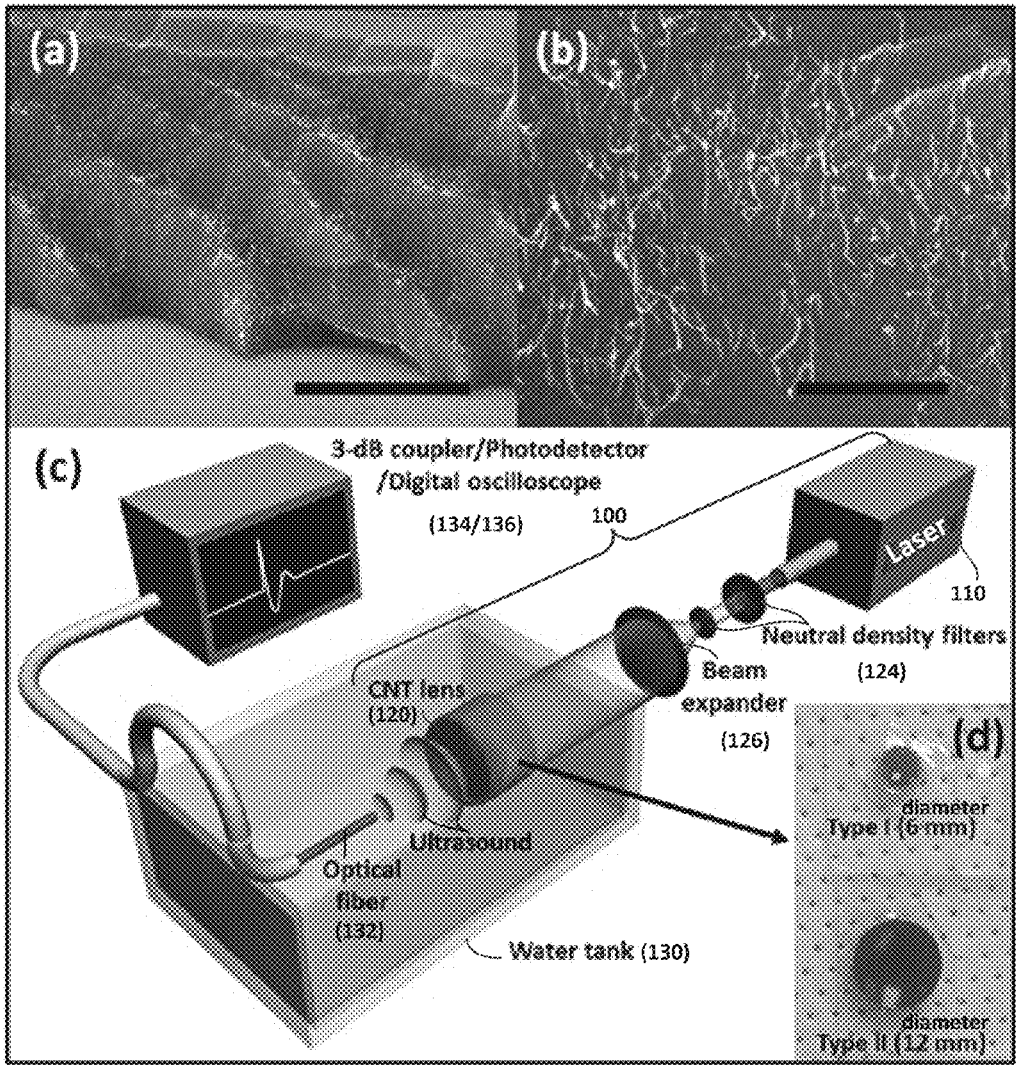

(58) Field of Classification Search
USPC ..... 367/140
See application file for complete search history.

(56) References Cited

U.S. PATENT DOCUMENTS

2001/0055435 A1* 12/2001 Biagi et al. ..... G10K 15/046 385/7
2010/0074845 A1 3/2010 Gambhir et al.

OTHER PUBLICATIONS

High-frequency ultrasound array element using thermoelastic expansion in an elastomeric film, T. Buma, Applied Physics Letters, Jul. 2001.*
Baac, Hyoung Won, et al., "Carbon nanotube composite optoacoustic transmitters for strong and high frequency ultrasound generation," Applied Physics Letters, vol. 97, pp. 234104-1-244104-3 (2010) (published online Dec. 8, 2010).
Baac, Hyoung Won, et al., "Carbon-Nanotube Optoacoustic Lens for Focused Ultrasound Generation and High-Precision Targeted Therapy," Sci. Rep., vol. 2, p. 989 (Dec. 18, 2012) (8 pages).
Baac, Hyoung Won, et al., "Design of High-Intensity Focused Ultrasound Transmitters Based on Optoacoustic Generation," Presented at Session P5E-10, 2011 IEEE International Ultrasonics Symposium, Orlando, Florida, Oct. 18-21, 2011 (Oct. 21, 2011) (8 pages).
Baac, Hyoung Won, et al., "Dual-frequency focused ultrasound using optoacoustic and piezoelectric transmitters for single-pulsed free-field cavitation in water," Applied Physics Letters, vol. 103, pp. 234103-1-234103-4 (2013) (published online Dec. 3, 2013).
Baac, Hyoung Won, et al., "Localized micro-scale disruption of cells using laser-generated focused ultrasound," J Biophotonics, pp. 1-6 (2013) (published online Feb. 19, 2013).
Baac, Hyoung Won, et al., "High-magnitude Focused Ultrasound and Acoustic Cavitation Generated by Carbon-nanotube Polymer Optoacoustic Lens," Presentation at 16th International Conference on Photoacoustic and Photothermal Phenomena, Nov. 27-Dec. 1, 2011 (15 pages).
Baac, Hyoung Won, et al., "Micro-ultrasonic cleaving of cell clusters by laser-generated focused ultrasound and its mechanisms," Biomedical Optics Express, vol. 4, No. 8, pp. 1442-1450 (Jul. 26, 2013).
Buma, T., et al., "High-frequency ultrasound array element using thermoelastic expansion in an elastomeric film," Applied Physics Letters, vol. 79, No. 4, pp. 548-550 (Jul. 23, 2001).
Murray, T.W., et al., "Laser generation of ultrasound in films and coatings," Applied Physics Letters, vol. 74, No. 23, pp. 3561-3563 (Jun. 7, 1999).
Smith, Henry I., "A proposal for maskless, zone-plate-array nanolithography," J. Vac. Sci. Technol. B 14, vol. 14, No. 6, pp. 4318-4322 (Nov./Dec. 1996).
Zhou, Yu-Feng, "High intensity focused ultrasound in clinical tumor ablation," World Journal of Clinical Oncology, vol. 2, No. 1, pp. 8-27 (Jan. 10, 2011) (published online Jan. 10, 2011).

* cited by examiner

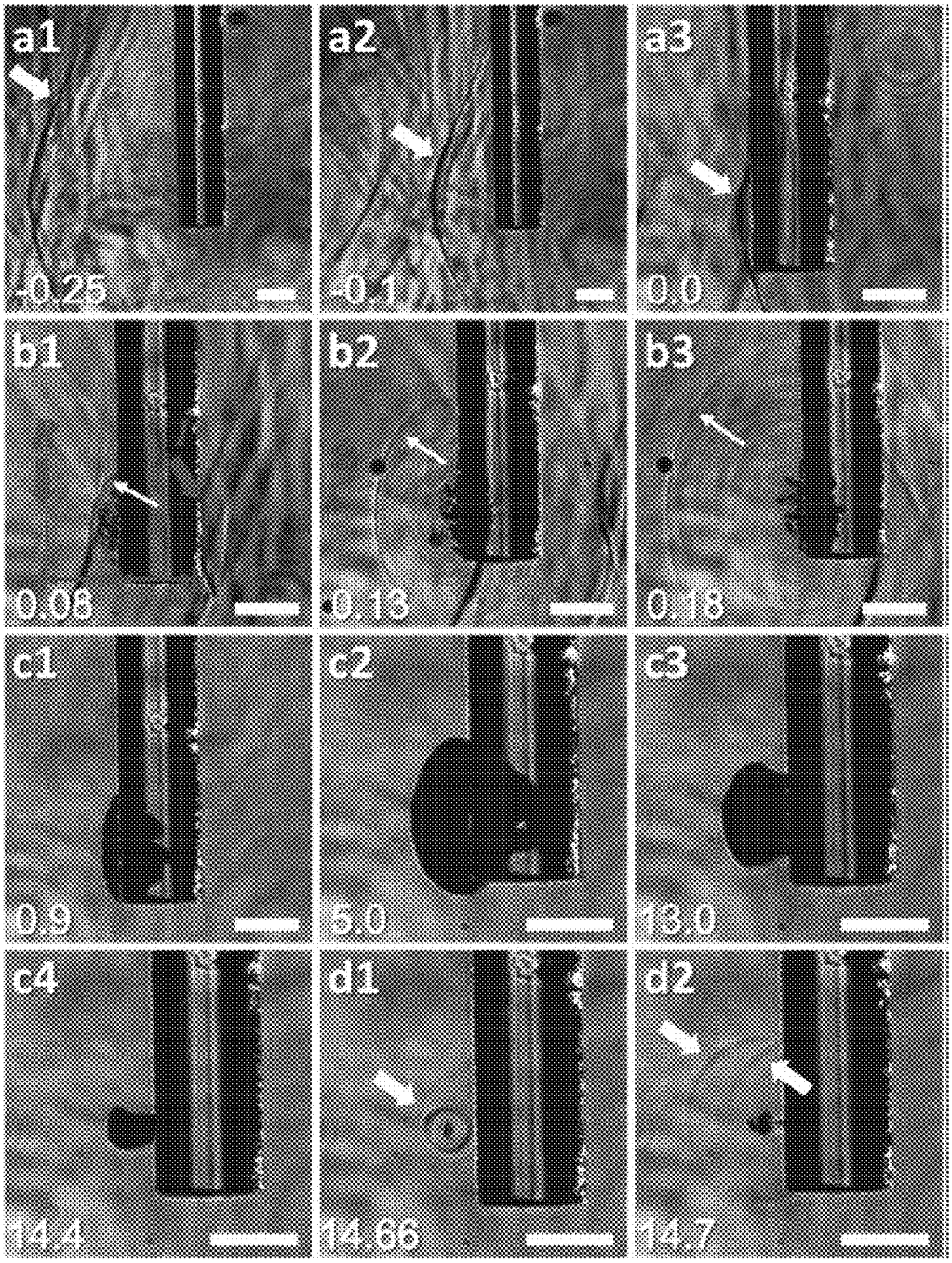
Figures 26(a)(1)-26(d)(2)

(a)

(b)

(c)

METHODS AND DEVICES FOR GENERATING HIGH-AMPLITUDE AND HIGH-FREQUENCY FOCUSED ULTRASOUND WITH LIGHT-ABSORBING MATERIALS

CROSS-REFERENCE TO RELATED APPLICATIONS

This application claims the benefit of U.S. Provisional Application No. 61/716,217, filed on Oct. 19, 2012. The entire disclosure of the above application is incorporated herein by reference.

GOVERNMENT RIGHTS

This invention was made with government support under DMR1120187 awarded by the National Science Foundation. The Government has certain rights in the invention.

FIELD

The present disclosure relates to devices and methods for generating high-amplitude and high-frequency focused ultrasound by using new transmitters comprising light-absorbing materials.

BACKGROUND

This section provides background information related to the present disclosure which is not necessarily prior art.

Focused ultrasound in high-intensity has attracted great attention because it involves a variety of interesting phenomena such as shock waves, cavitation bubbles, and local heat deposition. These mechanisms have been broadly employed in modern acoustics for fundamental understanding of nonlinear acoustic effects, thermal therapies, shock wave lithotripsy, and intra-membrane drug delivery. High-intensity focused ultrasound (HIFU) has been generated by using common piezoelectric transducers, which are usually operated around low frequency (around 1 to 2 MHz). This low frequency limits spatial resolution of an applied focal spot to a range of several mm to a few tens of mm (in an axial direction). This is insufficient for high resolution applications requiring sub-millimeter accuracy, e.g., for physical therapies. Furthermore, possible damage should be minimized over a surrounding volume to the focal spot, particularly in surgical applications. These considerations make it desirable to have a high-frequency ultrasound that can be tightly focused, which is currently not available for conventional HIFU systems.

Optoacoustic generation is one of the most effective ways to obtain high-frequency ultrasound. In one-dimensional structures, a frequency spectrum of the generated ultrasound can closely replicate that of an original laser pulse used for excitation. Nanosecond laser pulses are commonly available, which are sufficient to generate ultrasonic pulses with several tens of MHz of frequency spectra. Such a frequency range is typically sufficient for achieving micro-scale resolution ultrasonic imaging and non-destructive evaluations. However, practical utilization of such light-generated high-frequency ultrasound has been limited to proximity imaging because of weak pressure output and frequency-dependent attenuation during propagation, which increases with the acoustic frequency and propagation distance. For long-range imaging over several centimeters and for therapeutic applications of the light-generated ultrasound such as lithotripsy and surgical techniques like ablation aiming at higher resolution, high-efficiency optoacoustic materials are required to achieve high-amplitude and high-intensity ultrasound over the high-frequency range.

As optoacoustic emission sources, thin metallic coatings on solid substrates have been used as common reference materials. Such metal thin films (typically about 100 nm in thickness) are suitable for high-frequency ultrasound sources, because an acoustic transit time over the thin films can be much shorter than the temporal width of laser pulses. However, optoacoustic conversion efficiency in the metal is poor, mainly because of low light absorption and low thermal expansion. In addition, acoustic impedances of the metals do not match with those of surrounding liquids (e.g. water), which results in inefficient pressure transfer. For highly efficient transmitters of strong and high-frequency ultrasound generation, it would be desirable to have a transmitter capable of high optical absorption, high thermal expansion, fast thermal transition, acoustic impedance matching with a surrounding medium, and a geometrically thin structure for less acoustic attenuation within the source, together with less broadening in a temporal pulse shape, by way of non-limiting example.

SUMMARY

This section provides a general summary of the disclosure, and is not a comprehensive disclosure of its full scope or all of its features.

In various aspects, the present disclosure provides both devices that form high-frequency and high-amplitude light-generated focused ultrasound (LGFU) and well as methods for making and using such devices. In certain variations, the present disclosure provides a high-frequency, high-amplitude light-generated focused ultrasound (LGFU) device that optionally comprises a source of light energy and an optoacoustic generator, such as an optoacoustic lens. The optoacoustic lens may be an arcuate lens that comprises a concave composite layer or an optical zone plate that comprises select surfaces regions comprising composite material. The composite layer comprises a plurality of light absorbing particles and a dielectric material having a high coefficient of volume thermal expansion greater than or equal to about $1\times10^{-5}\times K^{-1}$ and optionally in certain variations, greater than or equal to about $5\times10^{-4}$ $K^{-1}$. When the light energy is directed to the optoacoustic lens, it is capable of generating high-frequency and high-amplitude focused ultrasound having a frequency of greater than or equal to about 10 MHz and an output pressure of greater than or equal to about 1 MPa, optionally greater than or equal to about 10 MPa, in certain variations.

In other aspects, the present disclosure provides a method of making a focused optoacoustic lens for a high-frequency light-generated focused ultrasound. The method comprises disposing a plurality of light absorbing particles on a surface and disposing a polymeric material precursor on the plurality of light absorbing particles disposed on the surface. The surface may be an arcuate lens or an optical zone plate. The method also comprises drying or curing the polymeric material precursor to form a polymeric film having a high coefficient of volume thermal expansion greater than or equal to about $1\times10^{-5}\times K^{-1}$, and optionally in certain variations, greater than or equal to about $5\times10^{-4}$ $K^{-1}$.

In yet other aspects, the present disclosure provides a method of generating a high-frequency and high-amplitude focused ultrasound, where the method comprises directing light energy at an optoacoustic generator, such as an optoacoustic lens. The optoacoustic lens optionally comprises a composite layer comprising a polymeric material and a plurality of light absorbing particles. The optoacoustic lens may be an arcuate (e.g., concave) lens that comprises a concave composite layer or an optical zone plate comprising select surface regions where the composite layer is present. The concave composite layer has the depth of optical absorption less than or equal to 30 μm. Directing light energy at the optoacoustic lens thus generates a high-frequency and high-amplitude focused ultrasound, where the high-frequency ultrasound is greater than or equal to about 10 MHz and the high-amplitude focused ultrasound has an output pressure of greater than or equal to about 1 MPa, optionally greater than or equal to about 10 MPa.

In yet other aspects, the present disclosure contemplates a method for surgery, lithotripsy, or ablation employing ultrasound energy. The method may comprise generating a high-frequency and high-amplitude focused ultrasound energy by directing laser energy at an optoacoustic lens. The optoacoustic lens comprises a composite layer comprising a polymeric material and a plurality of light absorbing particles. The composite layer may have a depth of optical absorption less than or equal to 30 μm and the high-frequency and high-amplitude focused ultrasound energy has a frequency of greater than or equal to about 10 MHz and an output pressure of greater than or equal to about 1 MPa, optionally greater than or equal to about 10 MPa. Such a method further comprises directing the high-frequency and high-amplitude focused ultrasound energy at a target. The focal spot of the generated high-frequency and high-amplitude focused ultrasound energy has a lateral dimension of less than or equal to about 200 μm and an axial dimension of less than or equal to about 1,000 μm.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 1(*a*)-(*d*): Optoacoustic lenses and measurement setup: Cross-sectional views of a gold-coated carbon nanotube-polydimethylsiloxane (CNT-PDMS) composite layer prepared in accordance with certain aspects of the present disclosure are shown in 1(*a*) (scale bar=10 μm) and 1(*b*) (scale bar=1 μm), taken by scanning electron microscopy (SEM); 1(*c*) shows an experimental setup for characterization of a high-frequency, high-amplitude, light-generated focused ultrasound (LGFU) generated by devices prepared in accordance with certain aspects of the present teachings. A 6-ns pulsed laser beam is expanded (by 5 times) and then irradiated onto the transparent side of the CNT lens. The LGFU is optically detected by scanning the single-mode fiber-optic hydrophone. The optical output is 3-dB coupled and transmitted to the photodetector with an electronic bandwidth of 75 MHz; 1(*d*) shows two CNT lenses (types I and II) according to certain embodiments of the present disclosure. The CNTs are grown on the concave side of the plano-concave fused silica lenses. A type II lens shown in 1(*d*) is used for the SEM characterization of 1(*a*) and 1(*b*). The layer thickness is about 16 μm. The PDMS is completely infiltrated among the CNT network as shown in 1(*b*).

Figure 2:
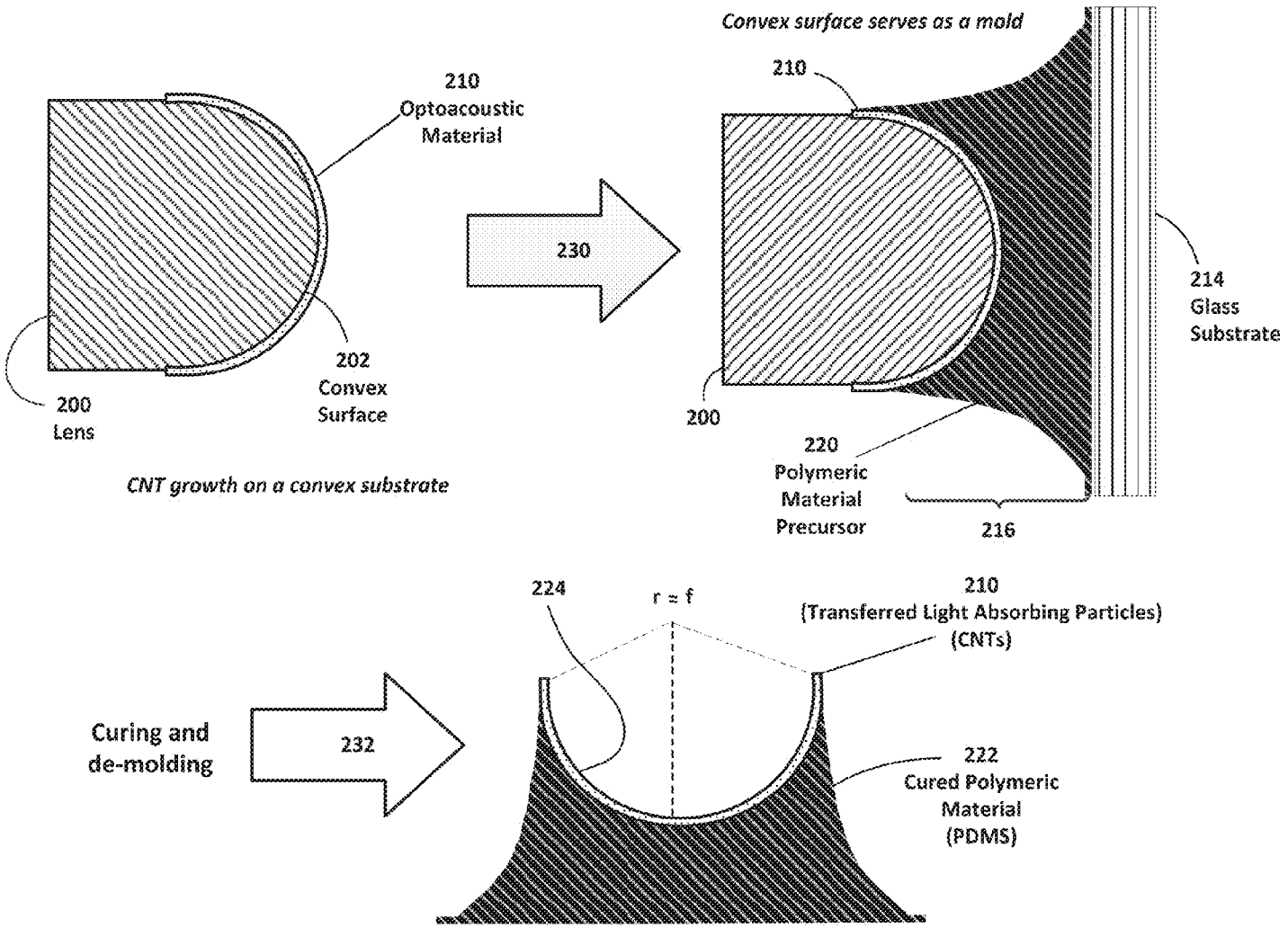

FIG. 2: Shows a schematic illustrating an exemplary method for forming an optoacoustic transmitter lens according to certain embodiments of the present disclosure. CNTs are grown on a convex lens are then transferred to a polymer structure (f is a focal distance, r is radius of curvature).

Figures 3A, 3B, 3C:
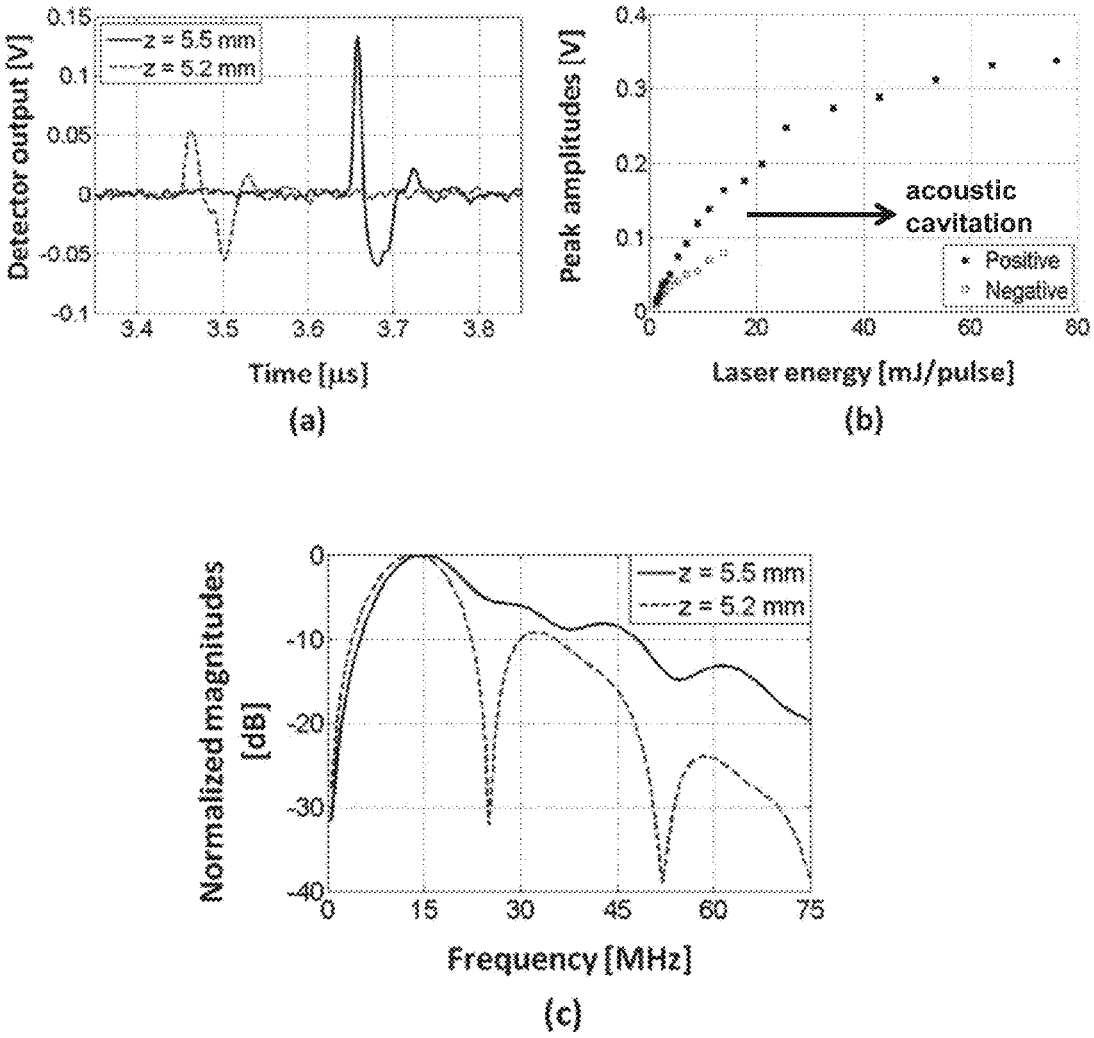
Figures 3D, 3E:
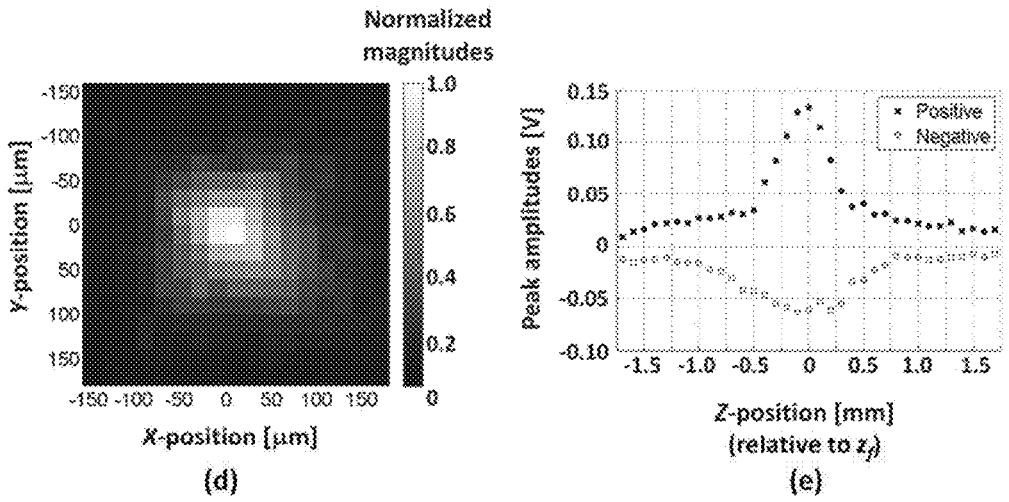

FIGS. 3(*a*)-(*e*): Temporal and spatial characterization of the LGFU: 3(*a*) Time-domain waveforms around the lens focus (z=5.5 mm) and slightly in front of the focal point (z=5.2 mm); 3(*b*) Measured pressure amplitudes versus laser energy at focal point (z=5.5 mm); 3(*c*) Frequency spectra for the waveforms shown in 3(*a*). The sensitivity of the fiber hydrophone is about 6 mV/MPa. The negative amplitudes in 3(*b*) could be correctly determined only under a sub-threshold regime of acoustic cavitation; 3(*d*) Spatial profile of the high-frequency, high-amplitude, light-generated focused ultrasound (LGFU) according to certain embodiments of the present disclosure on the lateral plane at z=5.5 mm. The peak amplitudes are normalized, and the image is obtained from the positive peaks; 3(*e*) Axial profile along the z-direction. Here, the z-position is relatively defined from $z=z_f=5.5$ mm, i.e., z less than 0 means the fiber hydrophone position between the lens surface and the focus, and z greater than 0 beyond the focus. Step resolutions are 20 μm in 3(*d*) and 100 μm in 3(*e*).

Figures 4A, 4B:
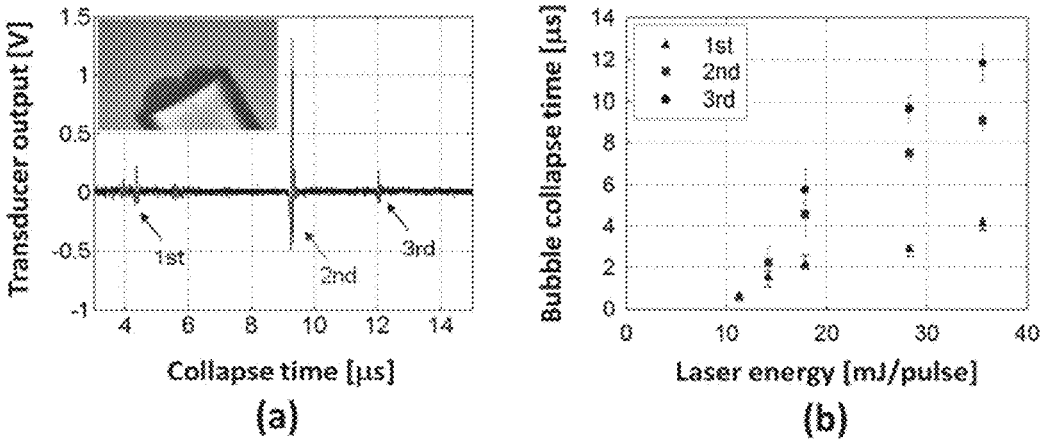

FIGS. 4(*a*)-(*b*): Measurement of the collapse time of cavitation bubbles generated by a single high-frequency, high-amplitude, laser light-generated focused ultrasound (LGFU) pulse according to certain embodiments of the present disclosure. 4(*a*) Individual collapse events are detected in the time-domain. The inset shows the cavitation bubbles formed on the fiber surface. Note that the image is separately taken by the high-speed camera (not exactly at the same moment as the signal trace). Three arrows indicate the pressure signal radiated from the bubble collapse. 4(*b*) The bubble collapse times are plotted as a function of the laser energy. No cavitation signal is monitored under about 10 mJ/pulse.

Figures 5A, 5B, 5C, 5D:
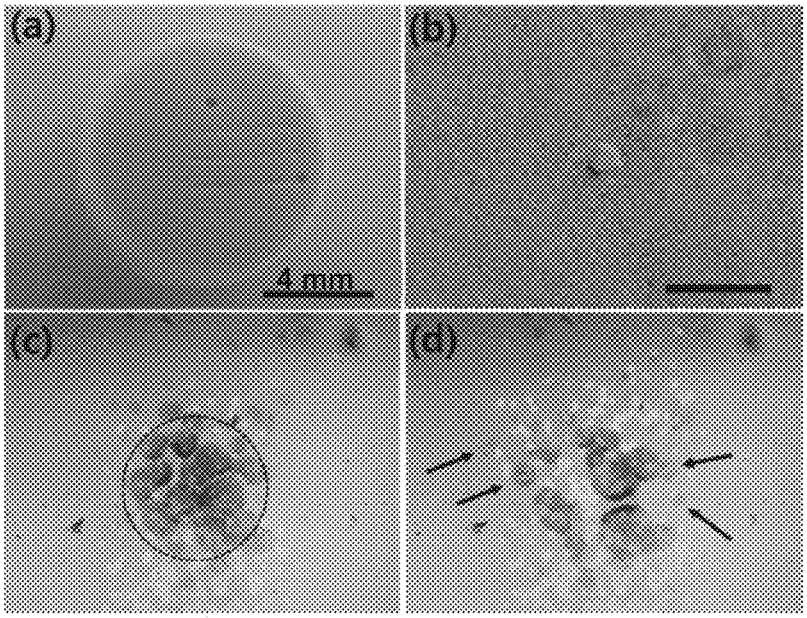

FIGS. 5(*a*)-(*d*): Micro-scale fragmentation of solid materials by high-frequency, high-amplitude, laser light-generated focused ultrasound (LGFU) according to certain embodiments of the present disclosure: 5(*a*) A model kidney stone (scale bar=4 mm) is treated by the LGFU. Greater than 1,000 pulses are delivered on the single spot on the top (about 300 to about 400 μm in diameter), and less than 30 pulses to each position of the line patterns (about 150 μm in width); 5(*b*) A single micro-hole on a polymer film (dented) is produced by a single LGFU pulse (scale bar=20 μm). A polymer micro-piece is torn off from the substrate; 5(*c*) and 5(*d*) High-speed microscopic images of fragmentation process on the polymer-coated glass substrate. The transient bubbles are visualized by the high-speed camera. The focal spot of the LGFU is marked by the dotted circle in 5(*c*) (125 μm in diameter). The LGFU spot in 5(*c*) moves from the bottom to the top direction, leaving many bright dots that correspond to the polymer-removed regions. The same position on the polymer film is shown in 5(*c*) and 5(*d*) in the identical scale, but 5(*d*) is taken after the continued LGFU exposure of about 1.5 second. The black arrows in (d) indicate the preferential bubble formation along the micro-cracks.

Figures 6A, 6B, 6C:
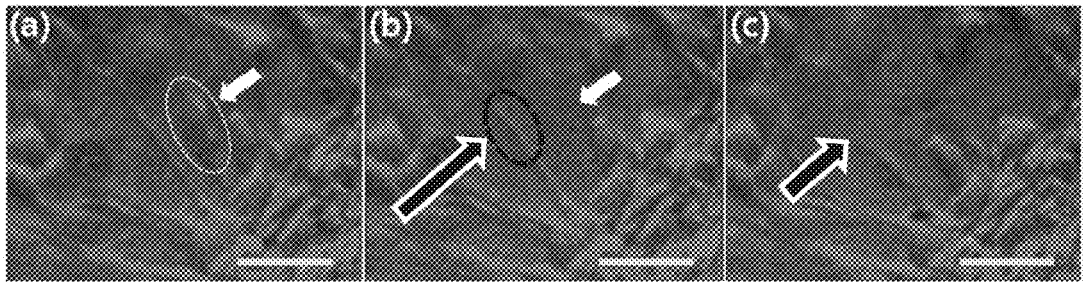

FIGS. 6(*a*)-(*c*): Targeted cell removal by the LGFU (scale bar=20 μm). The images are still shots captured from a video: 6(*a*) Cultured ovarian cancer cells (SKOV3) before ultrasound exposure. The white arrow indicates the single cell to be detached by high-frequency, high-amplitude, laser light-generated focused ultrasound (LGFU) according to certain embodiments of the present disclosure; 6(*b*) After the LGFU exposure, the single cell is selectively removed (indicated by the white arrow). As a next target, the cell-cell junction is indicated by the black arrow; 6(*c*) As the LGFU spot is moved to the black-dotted region, the cellular interconnection is severed.

Figure 7:
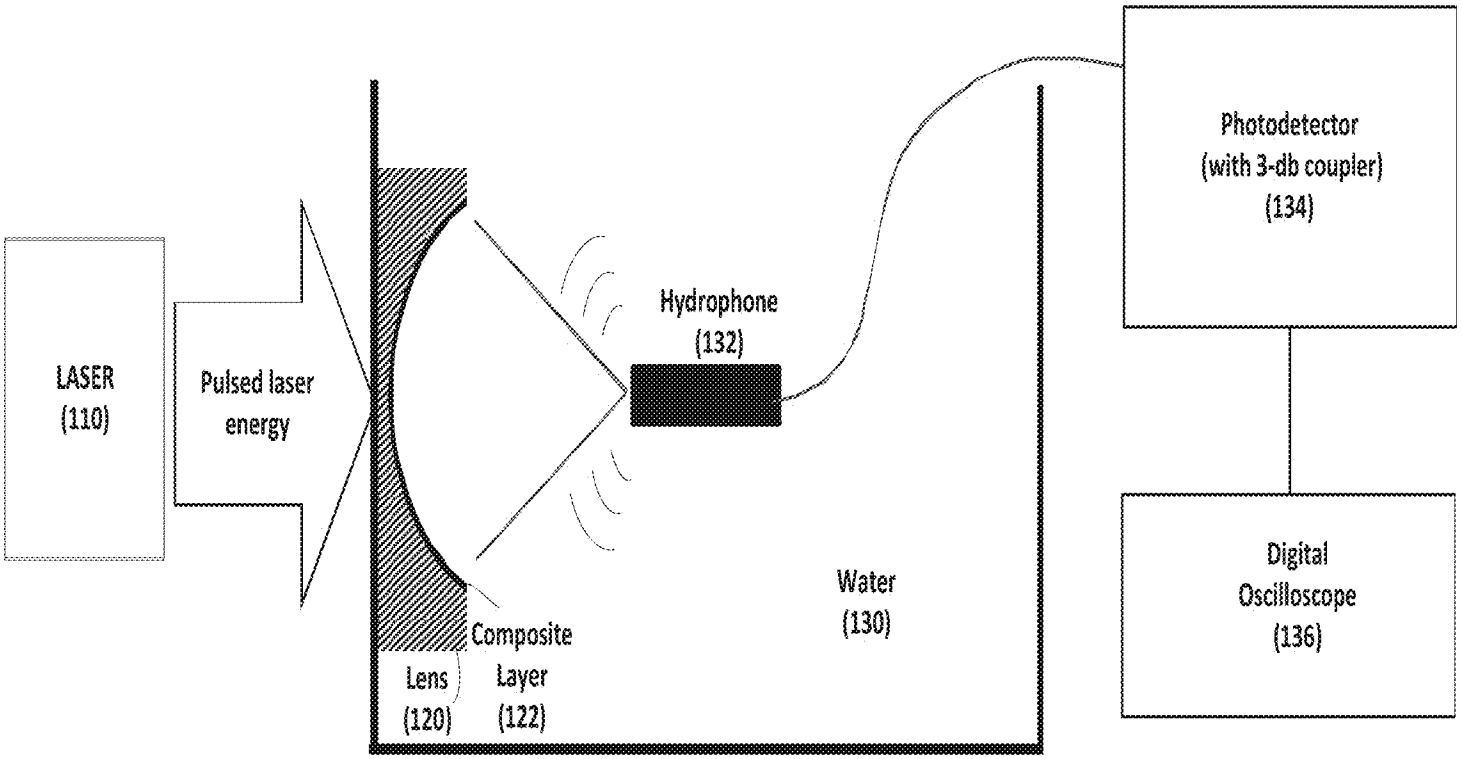

FIG. 7: A schematic illustrating an exemplary setup for measuring and characterizing an optoacoustic transmitter lens prepared according to certain embodiments of the present disclosure with a hydrophone, photodetector, and digital oscilloscope.

Figure 8:
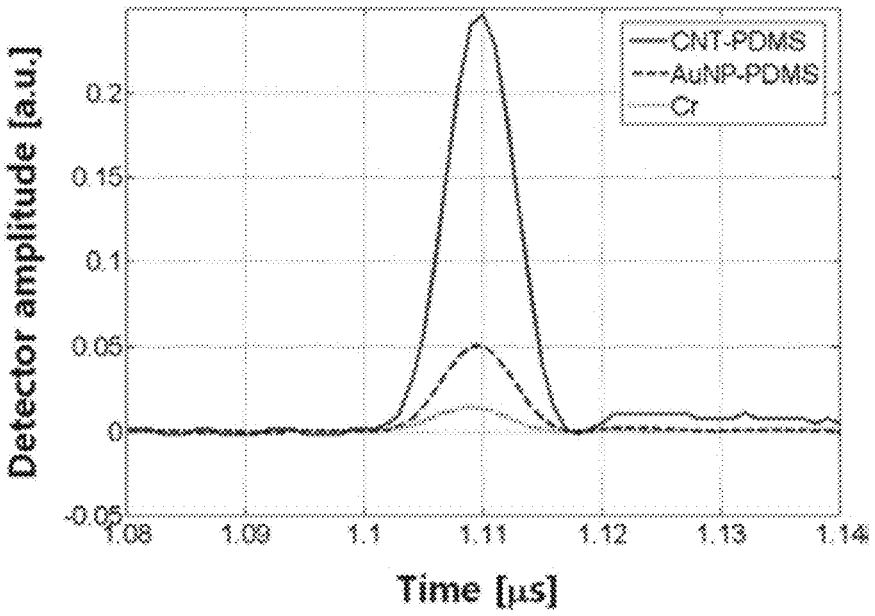

FIG. 8: Optoacoustic pressure amplitudes generated from thin film sources, which are formed on planar flat substrates. Three materials are compared: a CNT-PDMS composite, a two-dimensional gold-nanostructure (AuNP) coated with PDMS, and a bare Cr film.

Figure 9:
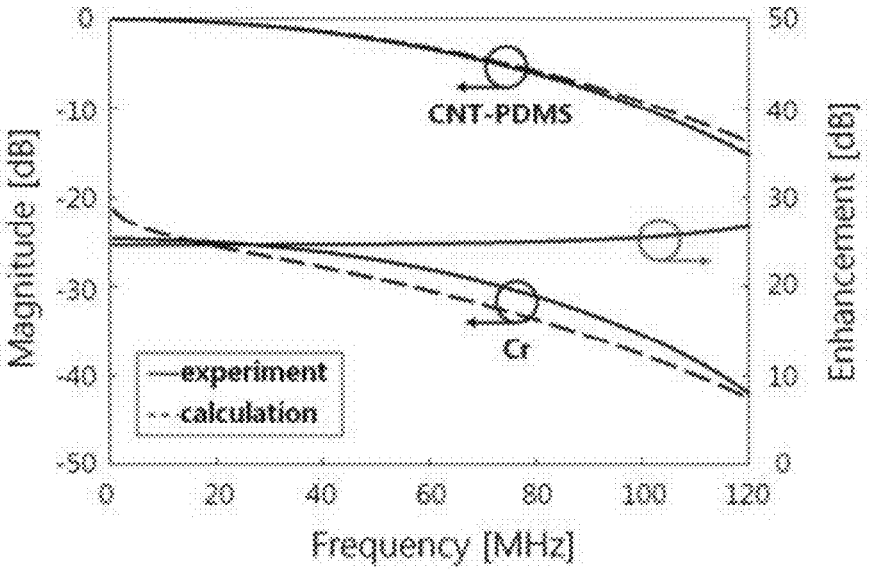

FIG. 9: Shows calculated and experimental detector amplitude for a composite layer comprising carbon nanotubes and polydimethylsiloxane (CNT-PDMS) according to certain embodiments of the present disclosure as compared to a conventional chromium film (Cr).

Figure 10:
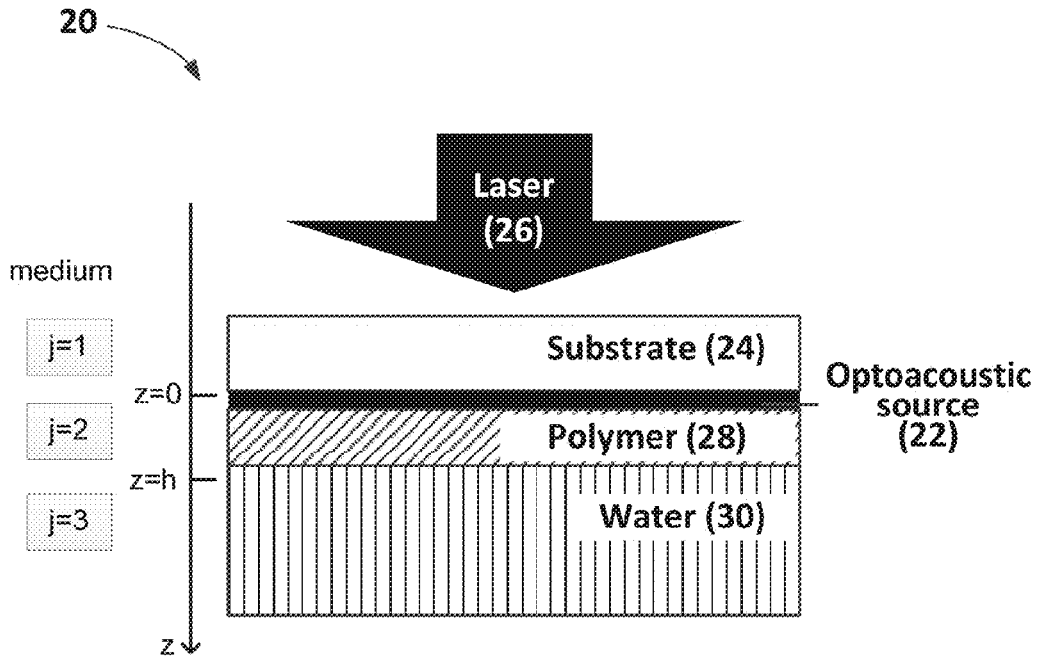

FIG. 10: A simplified one-dimensional model of an optoacoustic generator to demonstrate basic optoacoustic operational principles.

Figure 11:
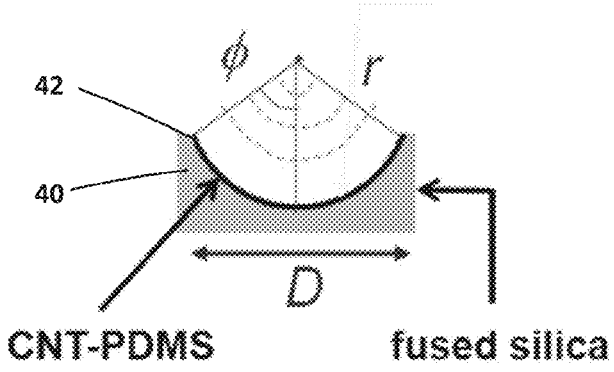

FIG. 11: A schematic of an optoacoustic transmitter lens comprising an optoacoustic composite layer defining a concave surface of the lens prepared in accordance with certain embodiments of the present disclosure.

Figure 12:
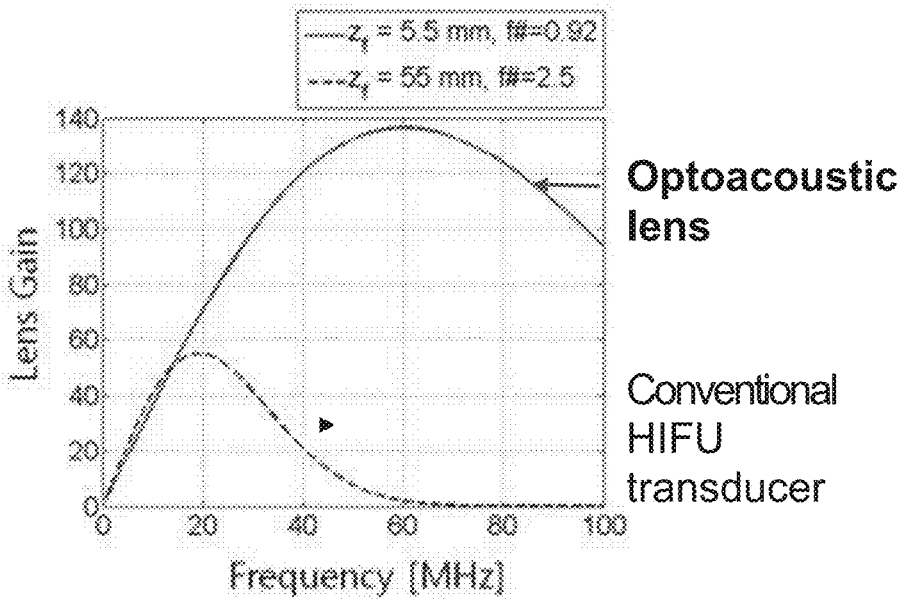

FIG. 12: Shows comparative geometrical gains in focusing lenses. Calculated results show frequency dependence. An optoacoustic transmitter lens (solid) prepared according to certain embodiments of the present disclosure is compared to a conventional piezoelectric transducer used for high-intensity focused ultrasound (HIFU) (dotted).

Figures 13A, 13B, 13C:
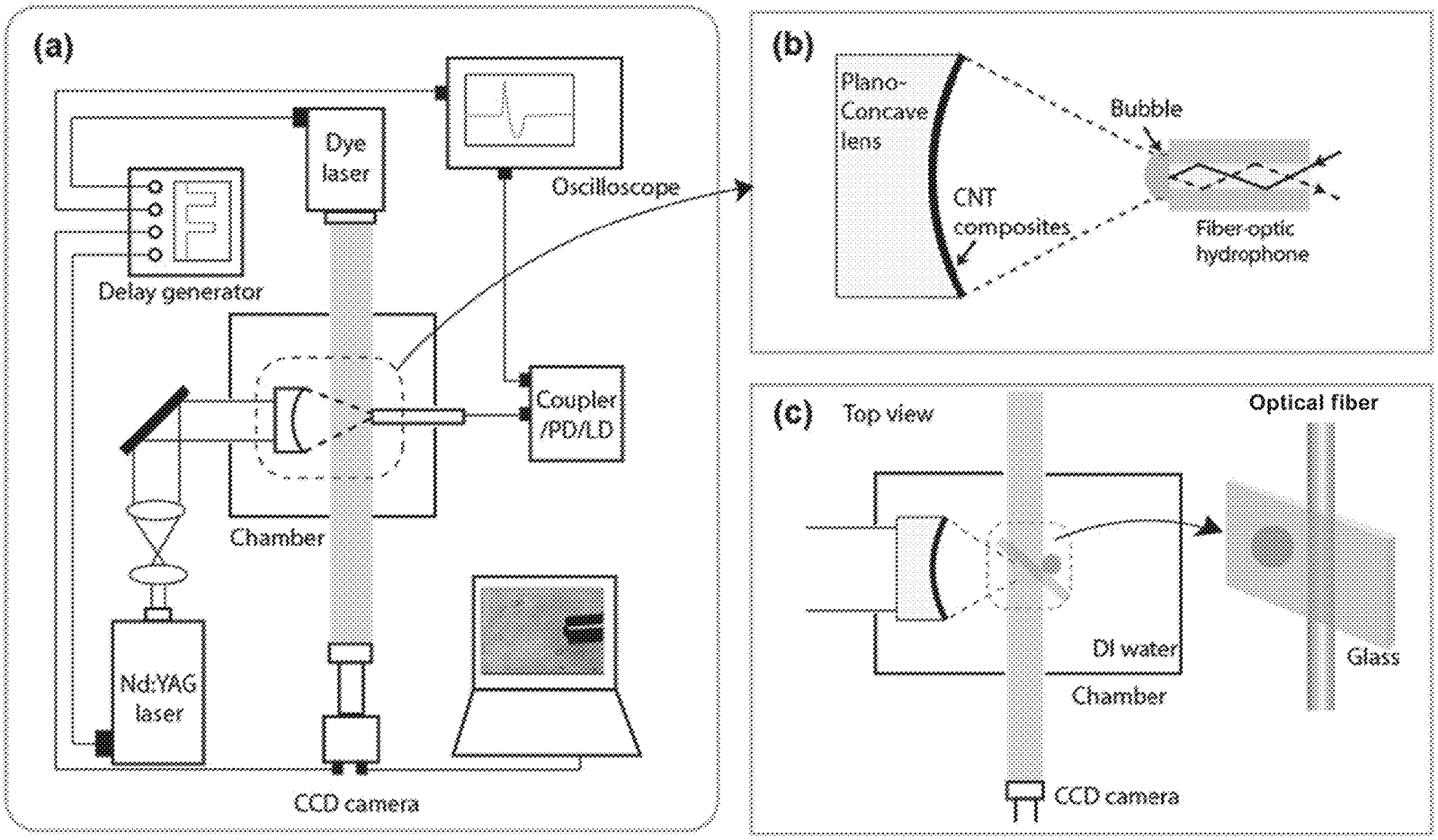

FIGS. 13(*a*)-(*c*): 13(*a*) shows an experimental setup for LGFU-induced bubble nucleation in accordance with certain aspects of the present disclosure, high-speed imaging, and acoustic signal measurement. The single pulsed acoustic wave generated by carbon nanotube (CNT)-polymer composites is focused on a fiber-optic hydrophone for measuring bubble dynamic signals, which is depicted in a detailed portion shown in 13(*b*). The hydrophone setup is substituted with a glass surface as shown in 13(*c*).

Figures 14A, 14B, 14C:
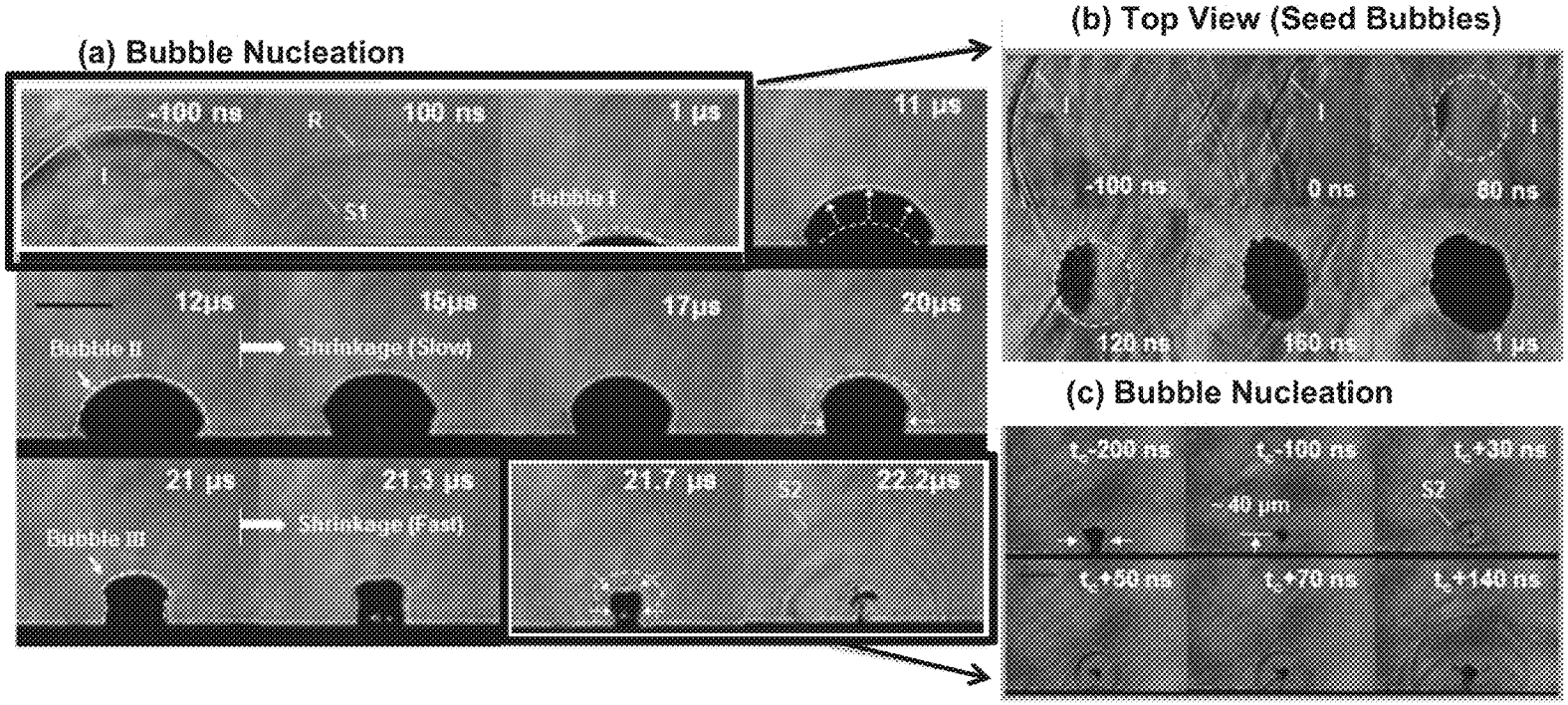

FIGS. 14(*a*)-(*c*): 14(*a*) shows shadowgraph images of focused ultrasound and bubbles nucleation at a laser energy of 64 mJ/pulse. The single LGFU pulses (I) in accordance with certain aspects of the present disclosure are targeted on the flat glass surface. Reflected wave (R), primary shock wave (S1), and cavitation shock wave (S2) are marked. The profiles of bubbles at specific times are marked as bubble I, II, III. 14(*b*) shows top-view images in an early stage of bubble nucleation at the glass surface. The surface is slightly tilted with respect to the vertical axis. 14(*c*) shows images of a cavitation shockwave (S2). The scale bar indicates a length of 100 μm.

Figures 15A, 15B, 15C, 15D:
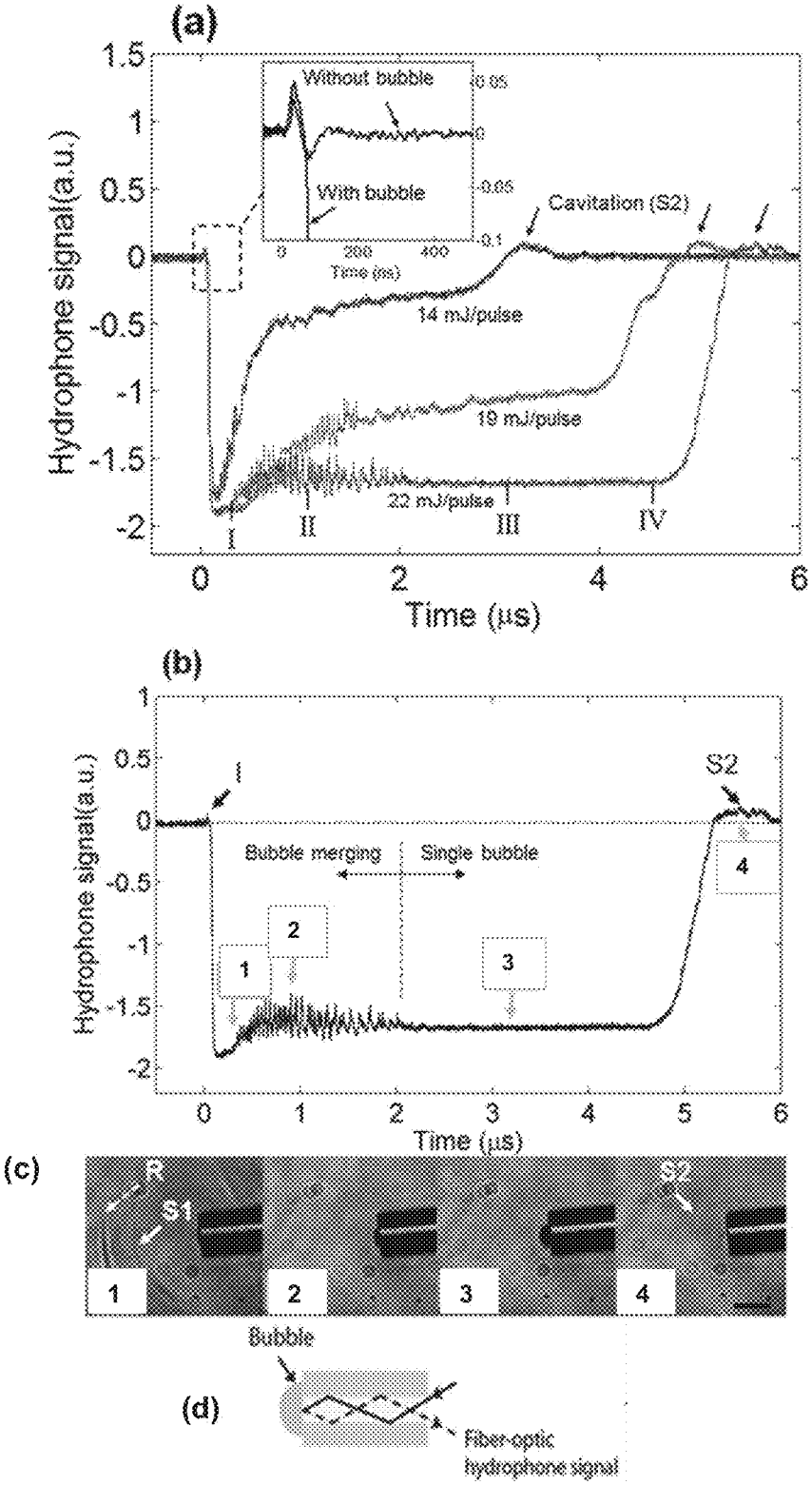

FIGS. 15(*a*)-(*d*): 15(*a*) are signals obtained by a fiber-optic hydrophone (15(*d*)) in the presence of bubbles with three different laser energy levels (14, 19, 22 mJ/pulse) applied to a high-frequency light-generated focused ultrasound (LGFU) in accordance with certain aspects of the present disclosure. The inset of 15(*a*) shows acoustic signal without bubbles. 15(*b*) correlates a hydrophone signal and 15(*c*) shows images of bubbles at the tip visualized at the laser energy (22 mJ/pulse). The bar indicates a length of 100 μm.

Figures 16A, 16B:
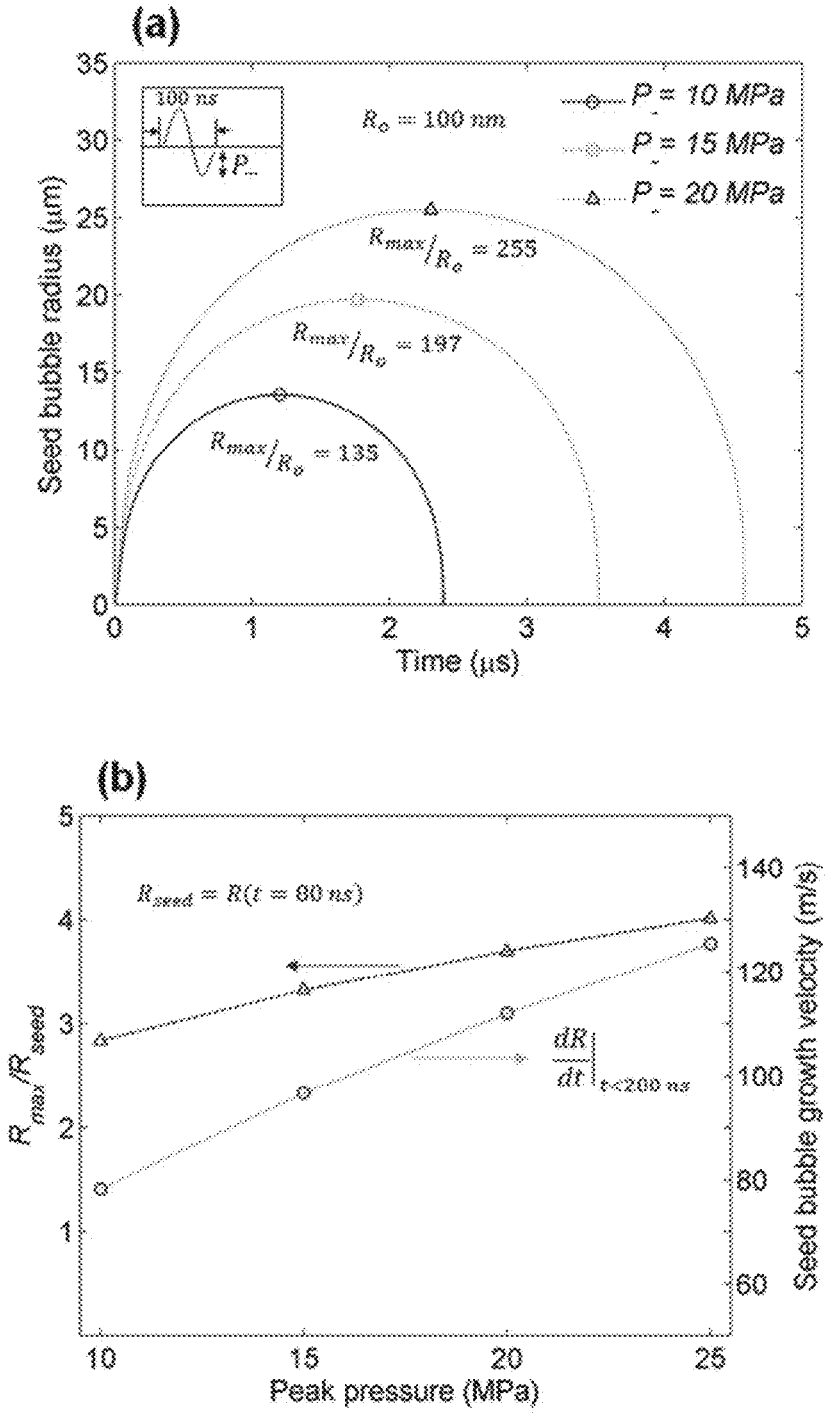

FIGS. 16(*a*)-(*b*): 16(*a*) shows dynamics of an isolated single bubble for different pressure pulses (P_=10, 15, 20 MPa). 16(*b*) is a ratio of maximum seed bubble radius to seed bubble radius [$R_{seed}$(time=80 ns)] as a function of a peak negative pressure (triangular symbol). The velocity of seed bubble growth at an early time (t<200 ns; circular symbol)

Figure 17:
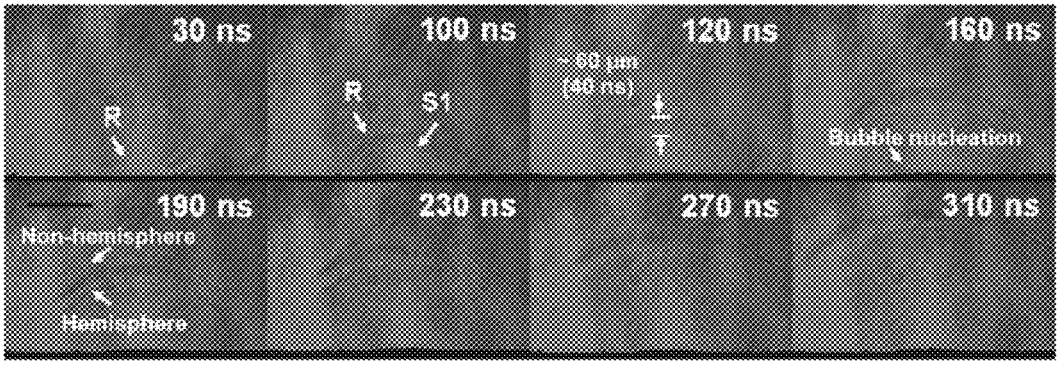

FIG. 17 shows shadowgraph images of a primary shock wave (S1) and a reflected acoustic wave (R) at the laser energy (64 mJ/pulse) generated by a high-frequency light-generated focused ultrasound (LGFU) in accordance with certain aspects of the present disclosure. The bar indicates a length of 100 μm.

Figure 18A:
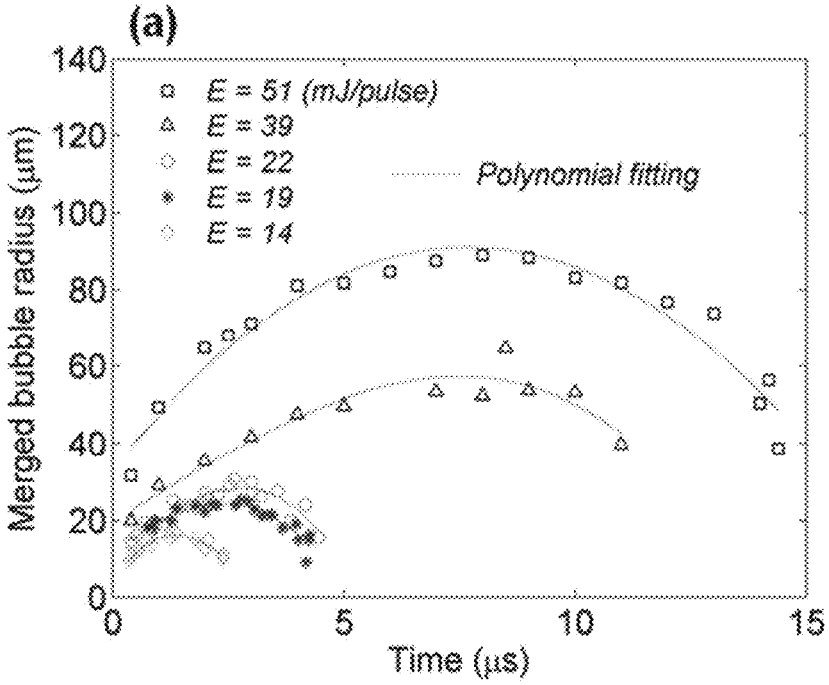
Figure 18B:
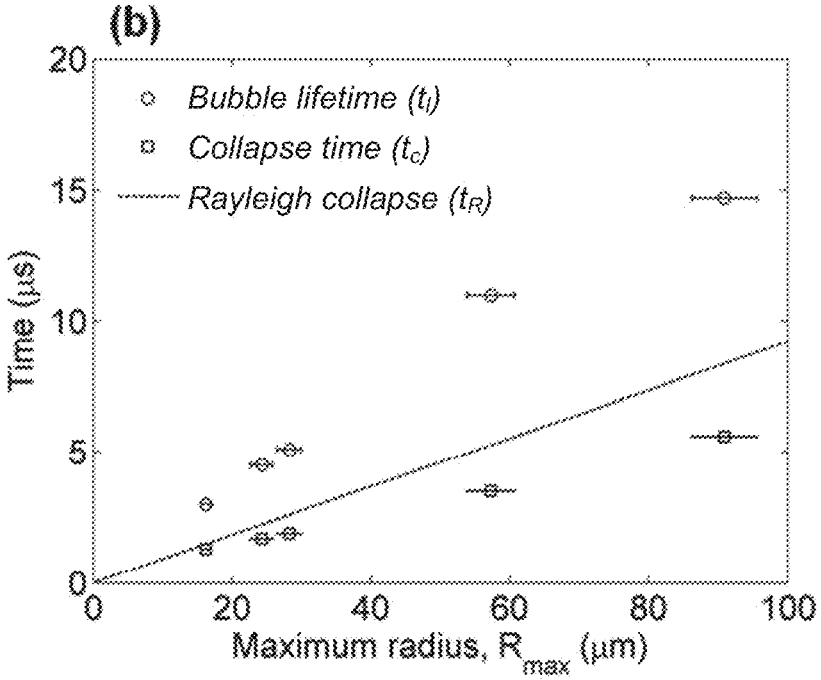

FIGS. 18(*a*)-(*b*): 18(*a*) show merged bubble radius as a function of time for different laser energies (E=14, 19, 22, 39, 51 mJ/pulse) and third order polynomial curve fitting. 18(*b*) shows characteristic times of bubble dynamics: bubble lifetime ($t_l$), collapse time ($t_c$), and Rayleigh collapse time ($t_R$).

Figures 19A, 19B:
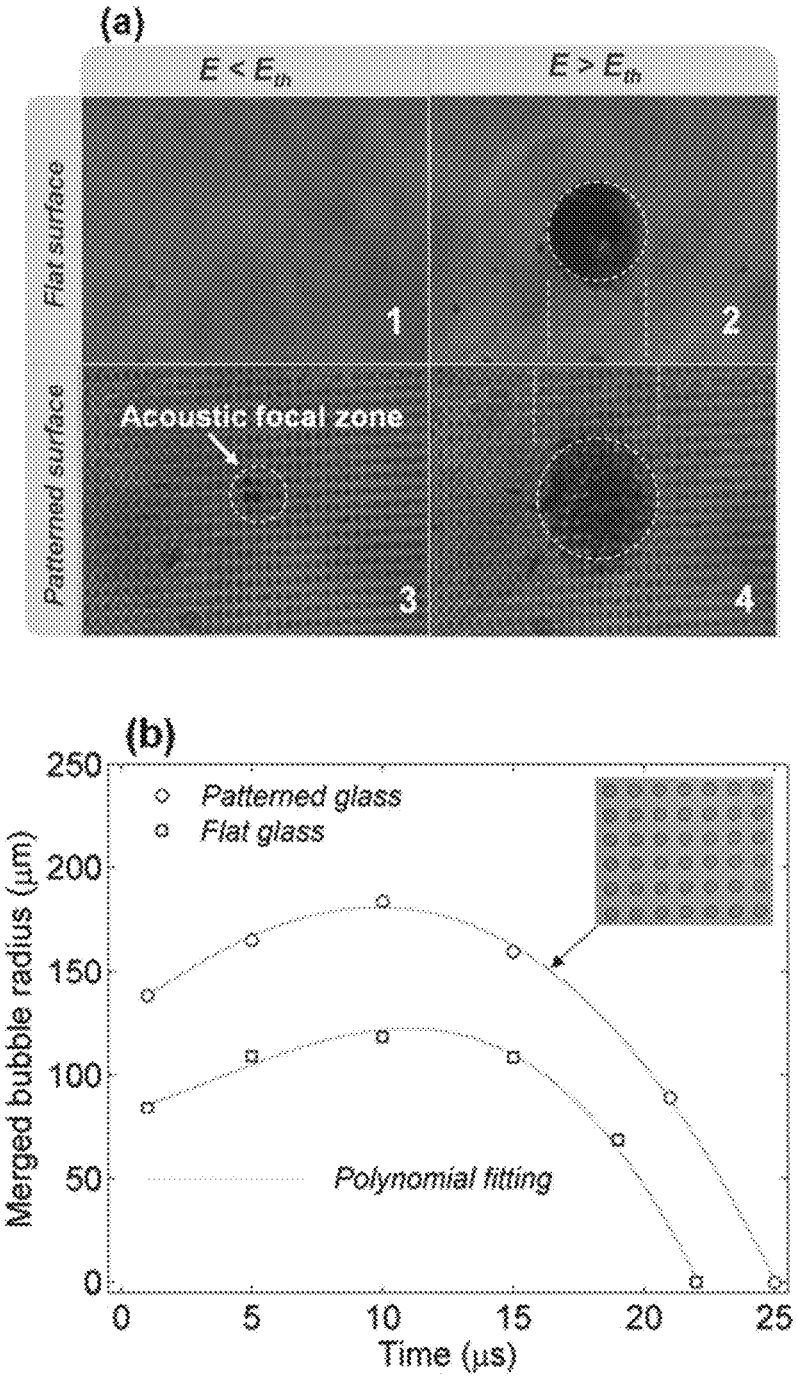

FIGS. 19(*a*)-(*b*): 19(*a*) shows a shadowgraph image of bubble nucleation at a flat glass: Quadrant (1) has no cavitation bubble ($E<E_{th}$) and Quadrant (2) has bubble nucleation ($E>E_{th}$); at the glass patterned with a hole array (spacing=20 μm, radius=4 μm): Quadrant (3) has heterogeneous bubble nucleation ($E<E_{th}$) and Quadrant (4) has bubble nucleation ($E>E_{th}$). 19(*b*) shows time evolution of merged bubbles at the flat glass (circular symbol) and at micro-structured glass (rectangular symbol). The inset is a microscope image of the hole array.

Figures 20A, 20B, 20C:
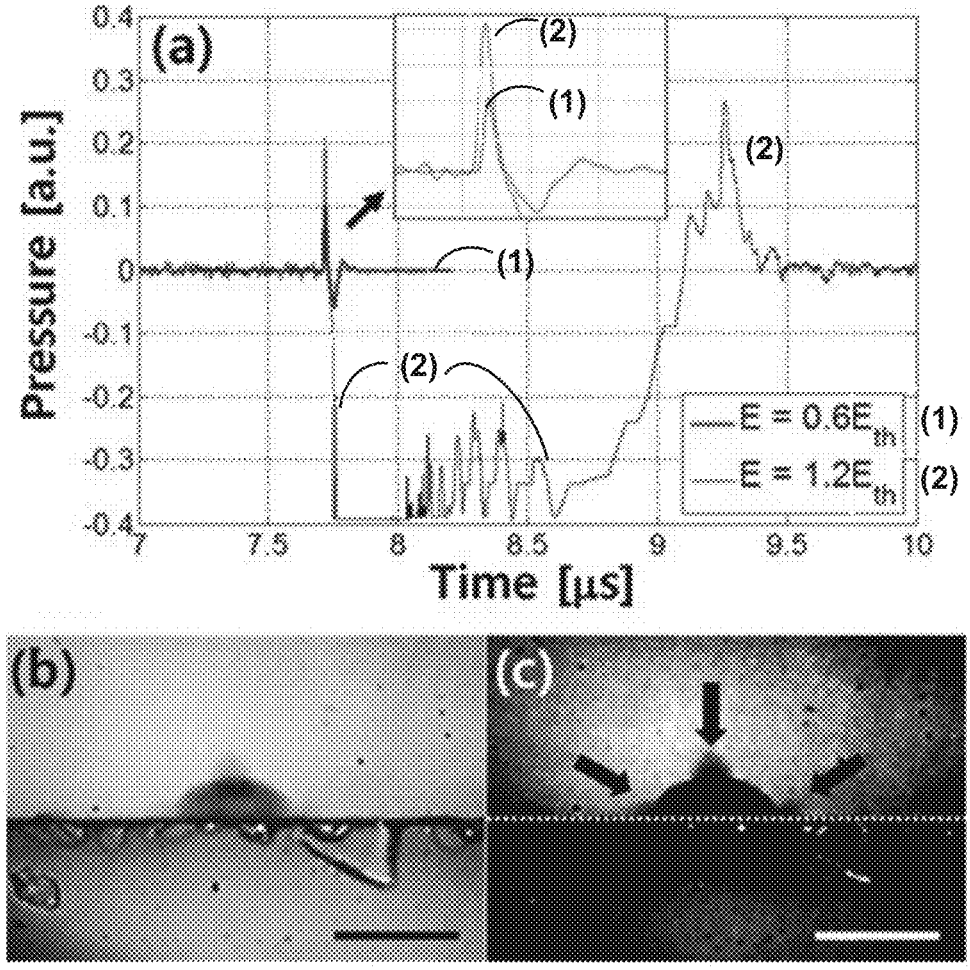

FIGS. 20(*a*)-(*c*): shows cavitational disturbance formed on a glass substrate: 20(*a*) shows high-frequency, high-amplitude, laser light-generated focused ultrasound (LGFU) waveforms below and above the cavitation threshold. The inset compares two waveforms at the focal plane. A stiff shock-front is present in the positive phases for both waveforms. 20(*b*) is an image of a transient micro-bubble (scale bar=100 μm). The micro-bubble is shown under high brightness and low contrast. 20(*c*) The same image shown in 20(*b*), but with enhanced contrast. Micro-jetting is indicated by black arrows. The white-dotted line indicates the glass/water boundary.

Figures 21A, 21B, 21C:
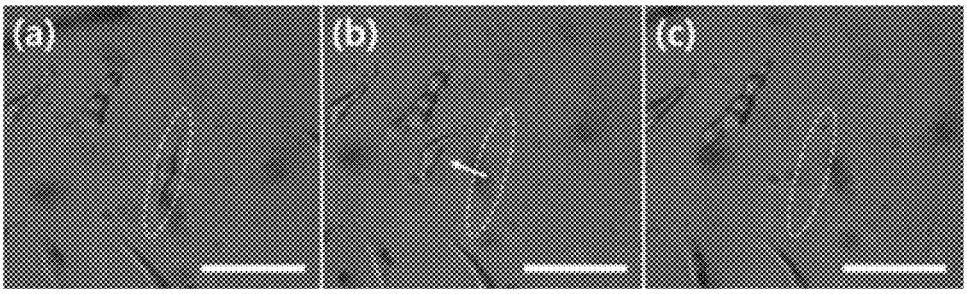

FIGS. 21(*a*)-(*c*): show cell detachment (scale bar=100 μm). 21(*a*) shows the target cell within the white-dotted region before treatment with high-frequency, high-amplitude, laser light-generated focused ultrasound (LGFU) according to certain embodiments of the present disclosure. 21(*b*) is an image taken immediately after cell detachment. The floating cell is shown, moving leftward. 20(*c*) shows the cell is completely removed, floating out of view.

Figures 22A, 22B, 22C, 22D, 22E, 22F, 22G, 22H:
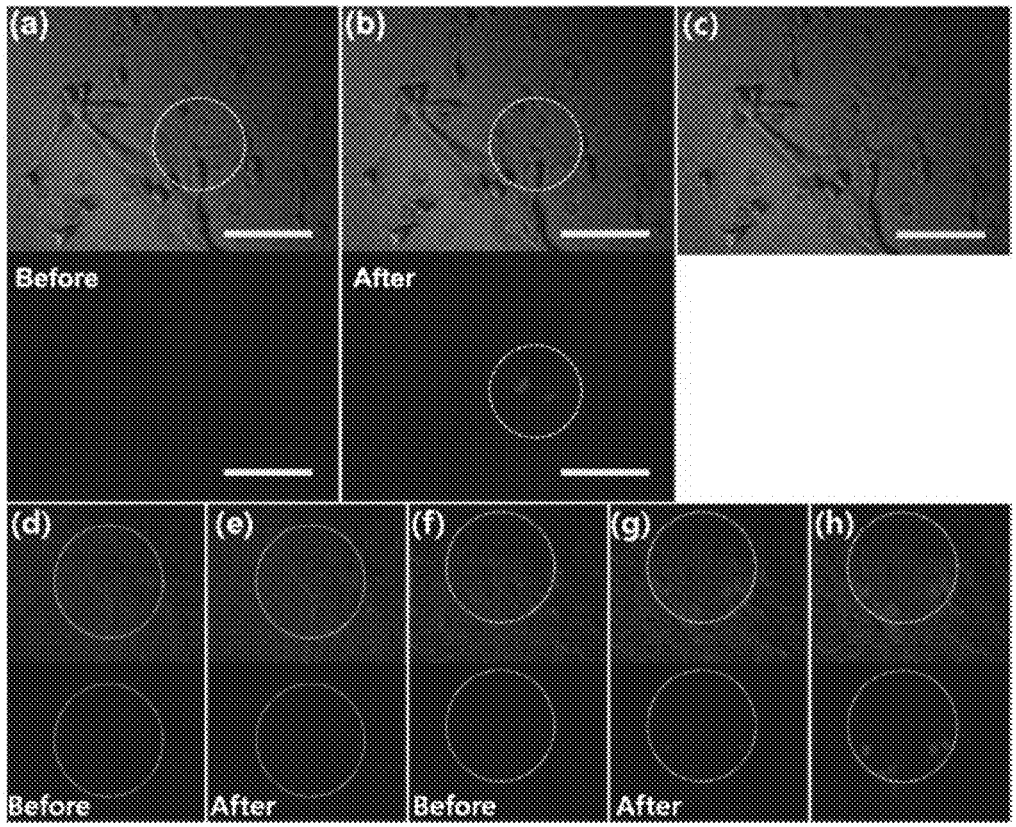

FIGS. 22(*a*)-(*h*): shows biomolecule delivery by use of high-frequency, high-amplitude, laser light-generated focused ultrasound (LGFU) according to certain embodiments of the present disclosure at the near-threshold regime for cavitation (E=0.9 $E_{th}$, 200 pulses) in FIGS. 22(*a*) to 22(*c*), the sub-threshold (E=0.7-0.8 $E_{th}$, 12 000 pulses) in FIGS. 22(*d*) to 22(*e*), and the over-threshold (E=1.2 $E_{th}$, 1200 pulses) in FIGS. 22(*f*)-22(*h*) (bright-field images in the above row and fluorescence in the bottom). White circles indicate the regions treated by LGFU (diameter=100 μm, scale bar=100 μm). FIGS. 22(*a*) and 22(*b*) show cells before and after LGFU at the near-threshold. Two images of 22(*b*) are merged in 22(*c*). Active ingredient propidium iodide (PI) entry is observed, but without cell morphology change. A new spot is chosen in 22(*d*). No fluorescence change is observed in 22(*e*) after LGFU exposure at the sub-threshold regime. Finally, another spot is chosen in 22(*f*). With LGFU above the cavitation threshold in 22(*g*), some cells are detached at the center, but PI entry is still observed in the periphery. After obtaining the images shown in 22(*g*), the LGFU is deactivated and 2 minutes passed prior to obtaining post-treatment images shown in 22(*h*).

Figures 23A, 23B:
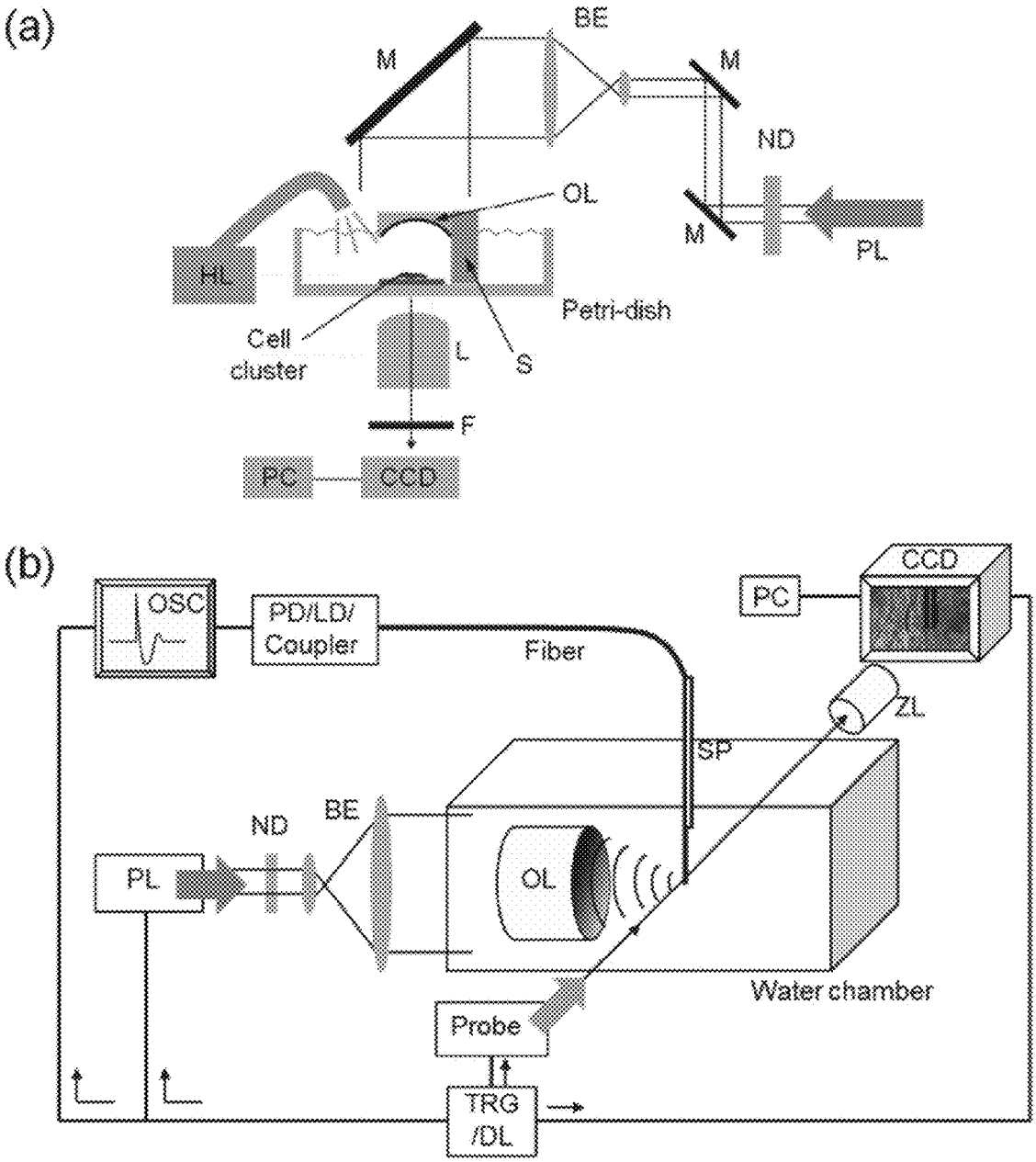

FIGS. 23(*a*)-(*b*): show schematics of an experiment. 23(*a*) shows a setup for micro-fractionation of cell clusters by high-frequency, high-amplitude, laser light-generated focused ultrasound (LGFU) according to certain embodiments of the present disclosure. The setup is prepared on the inverted microscope (BE: beam expander, F: optical filter, HL: halogen lamp, L: objective lens, M: mirror, ND: neutral density filter, OL: optoacoustic lens, PL: Nd:YAG pulsed laser beam (6-ns pulse width), S: supporting frame,). 23(*b*) is a shadowgraphic imaging setup (LD: laser diode, OSC: digital oscilloscope, PD: photodetector, Probe: probe laser beam (1-ns pulse width), SP: supporting plate, TRG/DL: trigger and delay generator unit, ZL: zoom lens).

Figures 24A, 24B, 24C, 24D, 24E:
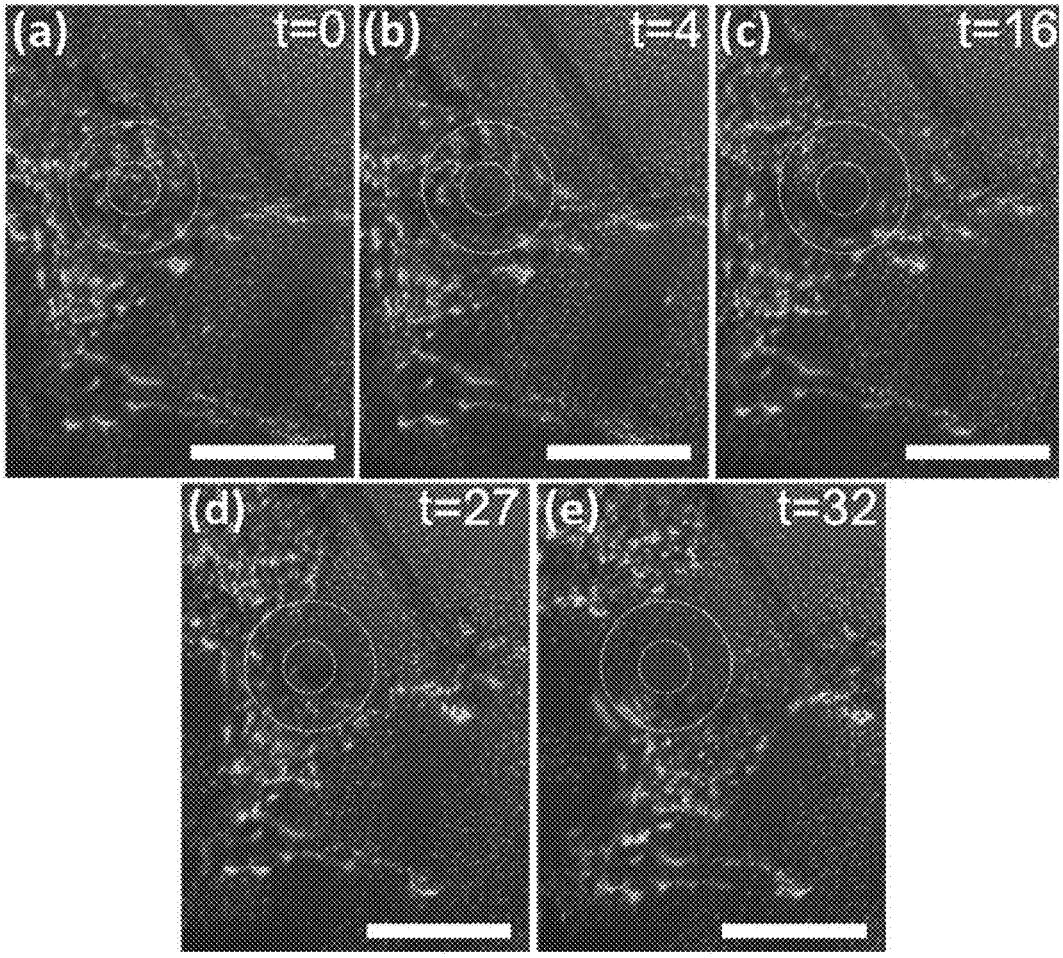

FIGS. 24(*a*)-(*e*): shows a demonstration of micro-fractionation by high-frequency, high-amplitude, laser light-generated focused ultrasound (LGFU) according to certain embodiments of the present disclosure (scale bar=100 μm). The LGFU spot is fixed while the cell culture plate is slowly moved to the upper-right direction 24(*a*) to 24(*e*). For convenience, the disruption zones are guided by the inner and outer circles (35 and 90 μm in diameter, respectively). A captured time (t) is shown on the right-top corner (unit: second): 24(*a*) shows the cultured cell cluster is shown with a target spot; 24(*b*) shows under LGFU, the cluster is fractionated primarily at the focal center; 24(*c*) shows that prolonged exposure to LGFU enlarges the fractionated zone over the periphery; 24(*c*) to 24(*e*) as the cluster is moved, LGFU finally cleaves the cluster into two pieces.

Figures 25A, 25B, 25C, 25D, 25E:
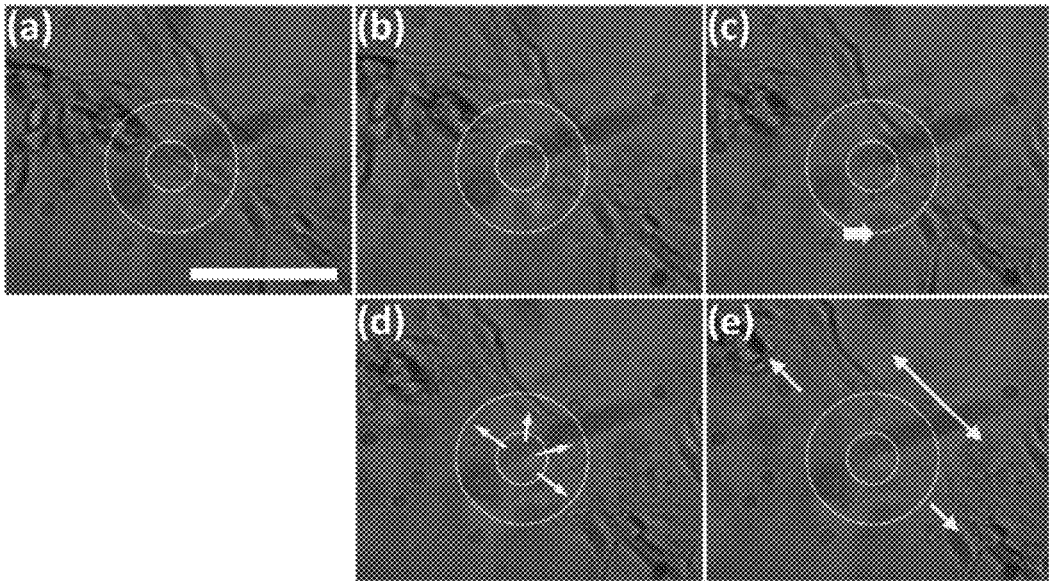

FIGS. 25(*a*)-(*e*): shows micro-fractionation processes in a sparse cell network that is used for distinctive morphology deformation (scale bar=100 μm; inner and outer circle diameters=35 and 90 μm; time t (second)). 25(*a*) shows that a spot formed by high-frequency, high-amplitude, laser light-generated focused ultrasound (LGFU) according to certain embodiments of the present disclosure is positioned at the cell-cell junction. 25(*b*) shows that in a short amount of time, the junction is sharply cut by LGFU at the focal center. 25(*c*) shows that the spot is re-positioned slightly to the rightward direction. FIGS. 25(*c*) to 25(*e*) have the spot staying at the same position to observe the peripheral disruption effects under prolonged LGFU. The cells are pushed away along the radial directions (arrows in 25(*d*)), and their retreat is clearly shown in 25(*e*) (compare with 25(*c*)), indicated by two small arrows. In addition, the cell-cell connection is pulled away along the bidirectional arrow.

FIGS. 26(*a*)(1)-(*d*)(2) show shadowgraphic imaging of high-frequency, high-amplitude, laser light-generated focused ultrasound (LGFU)-induced disruptions (all scale bars: 100 μm). Instantaneous images are shown sequentially. A captured time is shown on the left bottom (unit: μs) as relatively defined from the moment of cavitation inception. The fiber thickness is 125 μm for all figures: 26(*a*)(1) to 26(*a*)(3) shows incidence of LGFU from the left to the right. The wave fronts are indicated by the arrows. 26(*b*)(1) to 26(*b*)(3) show tiny bubbles generated under high-frequency, high-amplitude, laser light-generated focused ultrasound (LGFU) according to certain embodiments of the present disclosure with the outgoing pressure wave (thin red arrow). FIGS. 26(*c*)(1) to 26(*c*)(2) show a cloud formation by the merged bubbles. FIGS. 26(*c*)(3) to 26(*c*)(4) show shrinkage steps. FIG. 26(*d*)(1) shows a collapse-induced shock is shown as the spherical wave front (arrow), while FIG. 26(*d*)(2) shows shock propagation indicated by the left arrow (a direct outgoing wave) and the right arrow (a reflected wave from the substrate).

Figure 27:
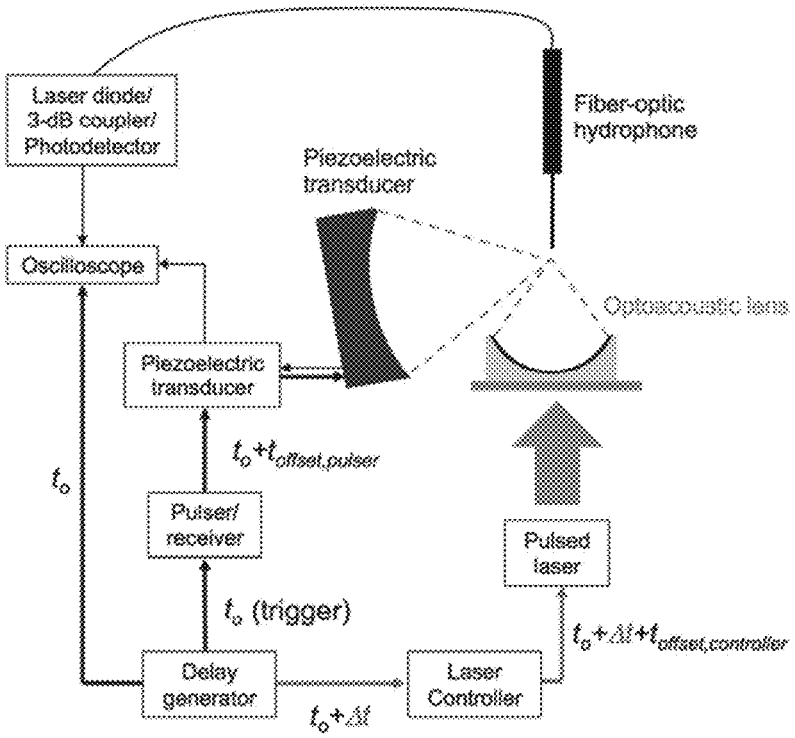

FIG. 27: shows an experimental schematic for dual-frequency focused ultrasound according to certain aspects of the present disclosure. A time delay (Dt) is added on the pulse laser path for temporal synchronization.

Figure 28A:
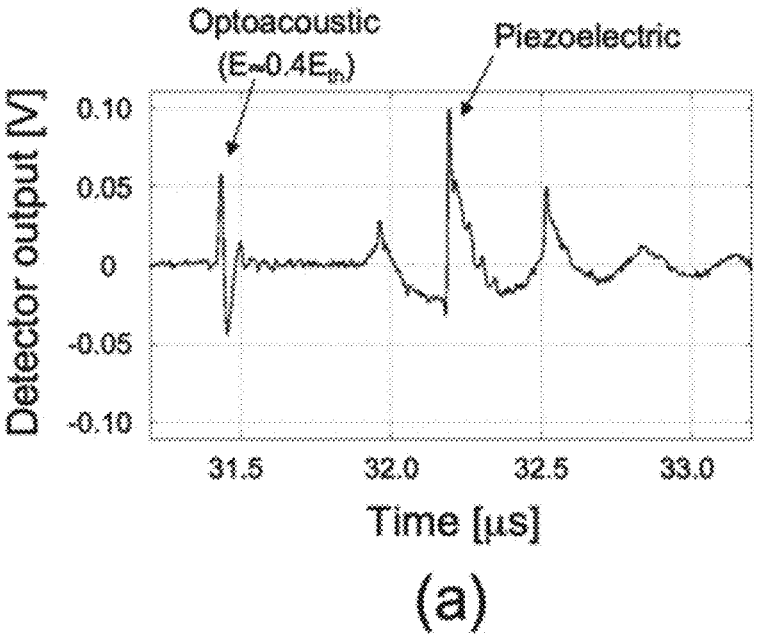
Figure 28B:
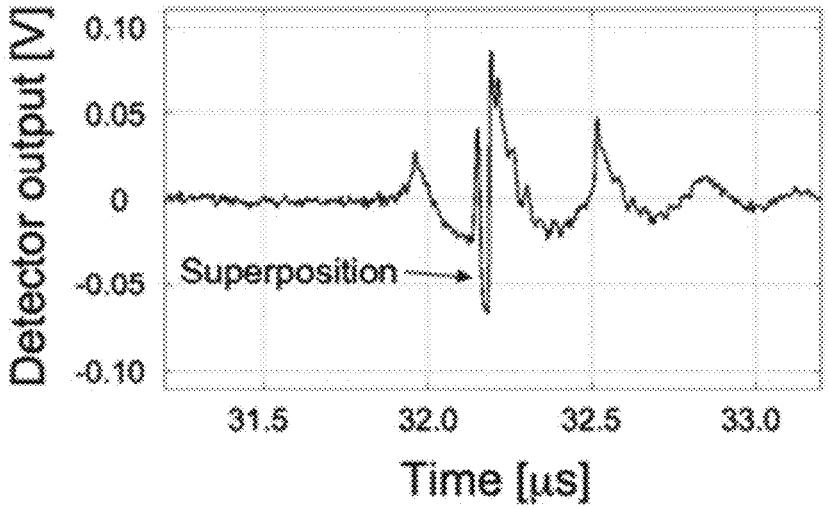
Figure 28C:
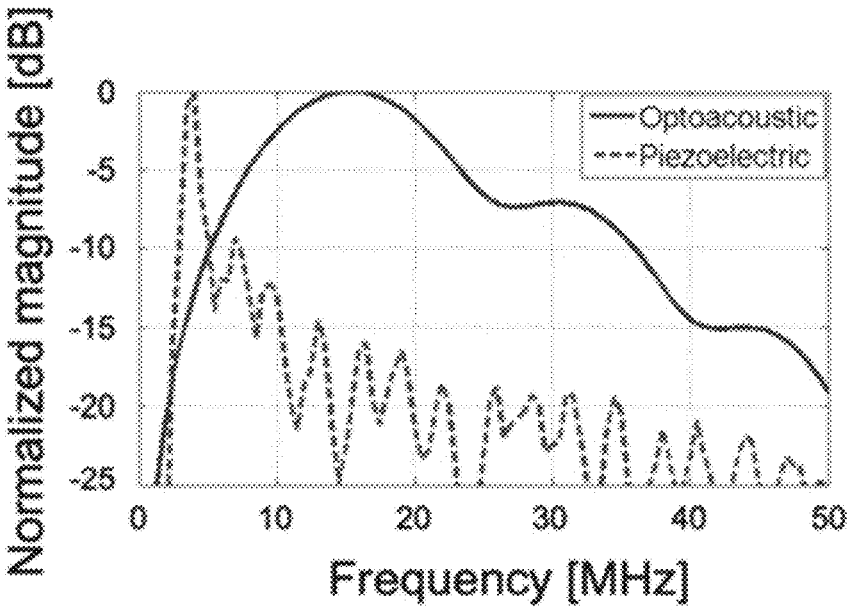

FIGS. 28(*a*)-(*c*): shows temporal waveforms 28(*a*) before and 28(*b*) after the superposition of optoacoustically (i.e. high-frequency, high-amplitude, laser light-generated focused ultrasound (LGFU)) and piezoelectrically generated ultrasound pulses (average of 50 traces). The time in the horizontal axis is relative, including electronic delays. The single LGFU pulse is shifted to the first minimum of the low-frequency waveform shown in 28(*b*). The normalized frequency spectrum for each waveform is shown in 28(*c*).

Figures 29A, 29B, 29C:
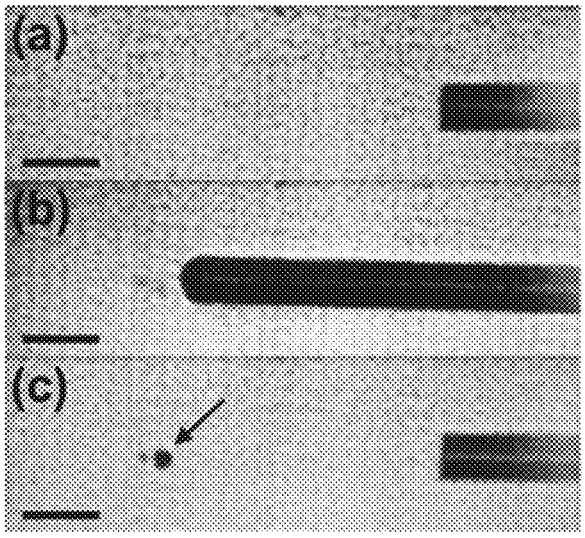

FIGS. 29(*a*)-(*c*): shows high-speed photographic imaging of single-pulsed cavitation (scale bar=200 μm). 29(*a*) is a reference image without cavitation under the optoacoustic transmitter (no superposition). The fiber hydrophone is away from the focal zone. 29(*b*) shows cavitation formed on the fiber surface under the superposed ultrasound. The fiber is located at the focal zone. 29(*c*) shows free-field cavitation (arrow) under the superposed ultrasound.

Figures 30A, 30B, 30C:
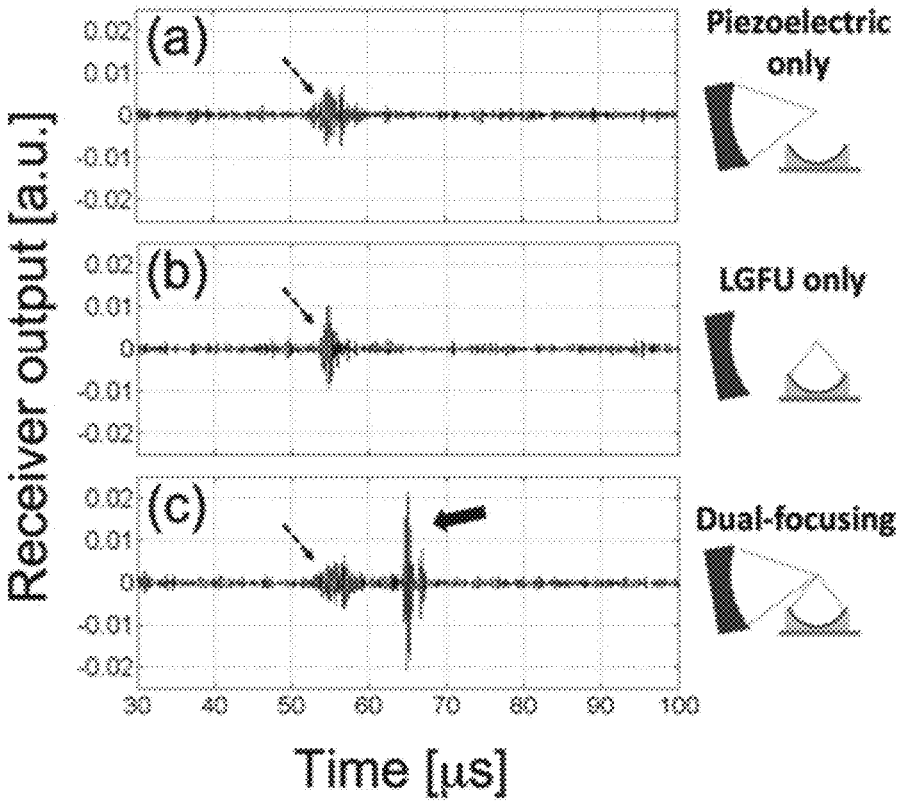
Figure 30D:
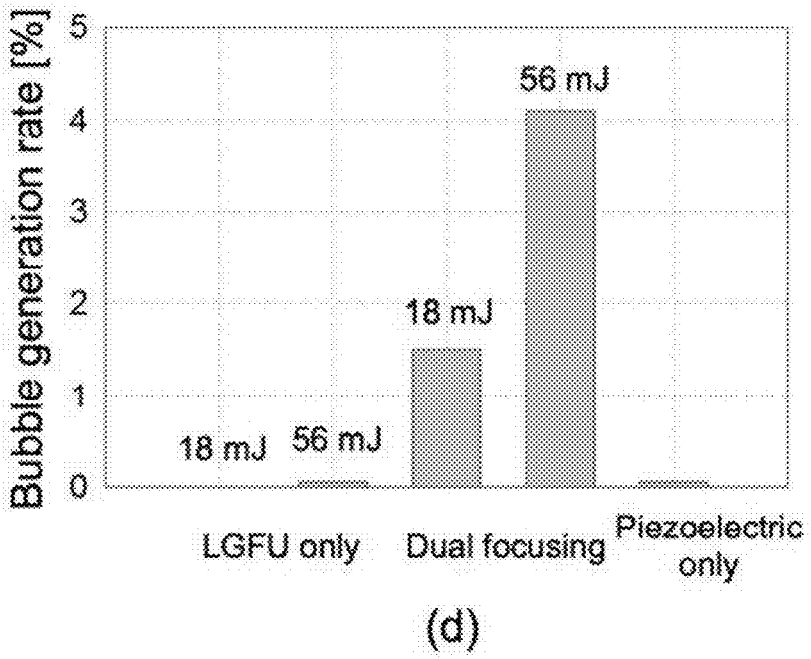

FIGS. 30(*a*)-(*d*): shows cavitation signal measurement. Receiver responses are shown in 30(*a*) to 30(*c*) (the dotted arrows indicate artifacts). 30(*a*) shows focused ultrasound by piezoelectric transmitter only; 30(*b*) shows optoacoustic transmitter only (high-frequency, high-amplitude, laser light-generated focused ultrasound (LGFU) according to certain embodiments of the present disclosure); 30(*c*) shows dual-focusing configuration, including high-frequency, high-amplitude, laser light-generated focused ultrasound (LGFU) and a low frequency piezoelectric generated ultrasound according to certain embodiments of the present disclosure. The thick arrow in 30(*c*) shows the acoustic transient signal due to bubble collapse. 30(*d*) shows the generation rates of cavitation bubbles under each mode of operation with and without superposition. The laser energy used to excite the optoacoustic lens is shown above each bar.

Figure 31:
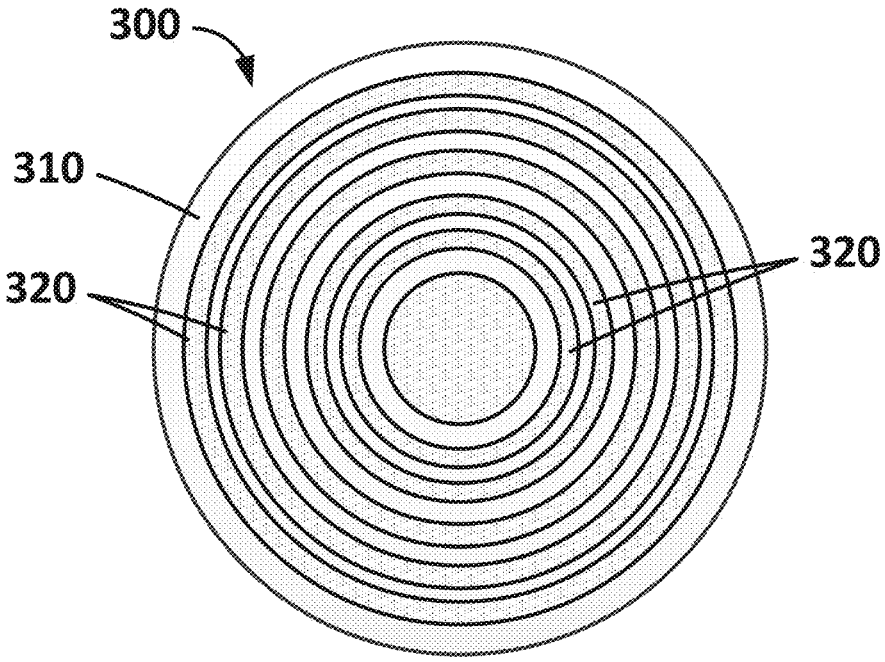

FIG. 31 shows a Fresnel-type optical zone plate formed in accordance with certain alternative variations of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

In addition, disclosure of ranges includes disclosure of all values and further divided ranges within the entire range, including endpoints given for the ranges.

In various aspects, the present disclosure provides a new design for focused ultrasound transmitter devices based on optoacoustic generation of ultrasonic energy. Focused ultrasound can be generated from a thin composite layer of light-absorbing material, which is excited by an energy source, such as a pulsed laser beam. A simplified one-dimensional model of an optoacoustic generator 20 is shown in FIG. 10 to demonstrate general operational principles of an optoacoustic source. As can be seen, an optoacoustic source material 22 is disposed on a substrate 24. The optoacoustic source material 22 is capable of converting electromagnetic light radiation from an electromagnetic light source 26 (e.g., a laser) to mechanical displacement that generates ultrasound energy waves. A dielectric material 28, such as a polymeric material, is disposed over the optoacoustic source 22, for example, by spin-coating. Further, the polymeric material 28 can be disposed in a medium, such as water 30. When laser energy from laser 26 is applied through the substrate 24 to the optoacoustic source 22 it generates ultrasound energy into the water 30. Z is the distance from the optoacoustic source 22 indicating where the measurement is taken, e.g., z=0 is at the optoacoustic source and z=h at the outer thickness of the polymeric material 28 forming a composite layer. For example, carbon nanotubes (CNTs) as light-absorbing optoacoustic sources 22 can be grown on the substrate 24 and then positioned at z=0. Note that the polymer 28 can be infiltrated within the CNT network, resulting in a CNT-polymer composite structure. The individual CNTs are surrounded by the polymer that can be thermally expanded.

In accordance with various aspects of the present disclosure, such nano-structured films can be fabricated on a curved surface in the same manner as shown in FIG. 11. A concave lens 40 can be used to define optoacoustic source material 42. It should be noted that lens is intended to include a structure with curved sides for concentrating or dispersing electromagnetic lights rays. Thus, in certain embodiments, the lens is a structure that has at least one concave surface (but may include biconcave surfaces). In other variations, the lens may be a fiber, so that the nano-structured films are formed on a curved fiber structure. In yet other variations, the lens may be formed on a substantially flat or planar surface and define a pattern, e.g., concentric rings, that create a Fresnel-type optical zone plate. In certain examples, suitable lenses may be made of fused silica with deep curvatures, can be directly used for the CNT growth that forms the optoacoustic source material 42. D is a lens aperture, r is a radius of curvature, and $\phi$ is a half-angle subtended to the lens aperture. It is assumed here that r is approximately equal to the focal distance of the lens 40. The f-number of the lens 40 is a ratio of r to D. The above-mentioned design principle uses typical optical lenses (e.g., commercially available) for creating a generator for ultrasonic focusing, so that lenses with low f-numbers (0.5 to about 1) can be selected to achieve high focal gain, which is desirable for high-frequency ultrasound focusing. In comparison, it is difficult to realize thin and uniform piezoelectric layers on such deep spherical curvatures, because they are conventionally made by dicing, carving, and shaping. The low f-numbers in the lens designs of the present disclosure are contrasted to those of conventional focal transducers, e.g., those based on the piezoelectric technique. Typical therapeutic transducers have high f-numbers (>2.5), even working at low frequency (a few MHz), which can result in low focal gains as compared to the optoacoustic focusing scheme according to principles of the present teachings, which allow higher focal gains of more than one order-of-magnitude over a high-frequency range. Thus, when compared to conventional piezoelectric transducers, various embodiments of the present teachings provide advantages like high-frequency generation and high-geometrical gain. In other aspects, the present disclosure provides methods for forming focused ultrasound transmitter devices. In yet other aspects, the present teachings provide for methods of using such high-intensity, high-frequency light-generated focused ultrasound (LGFU) from such devices.

For highly efficient transmitters of strong and high-frequency ultrasound generation, it is desirable to have a material with high optical absorption, low optical reflection, high thermal expansion, fast thermal conduction or thermal transition, acoustic impedance matching with a surrounding medium, and a geometrically thin structure. Further, a generator or transmitter having an acoustic transit time shorter than a laser pulse width is desirable for high-frequency generation with low acoustic attenuation. The transmitters according to certain aspects of the present teachings advantageously exhibit small acoustic attenuation due to a short focal distance. It is also desirable that the transmitter material has a high damage threshold for a maximum-available pressure. Further, the transmitter material is desirably formed of a non-corrosive or inert material that can be used long-term in an aqueous environment. Under 6-ns Nd:YAG pulsed laser irradiation, a carbon nanotube-polydimethylsiloxane (CNT-PDMS) composite film prepared in accordance with certain aspects of the present disclosure shows about 7 to about 9 times higher damage threshold than those of other metallic structures: for example, a Cr film with 100-nm thickness and two-dimensional gold nano-structures formed on the same fused silica substrate. As the higher laser energy is available for use with the CNT-PDMS structures without laser-ablated thermal damage, this provides an additional advantage to achieve higher-amplitude ultrasound. In certain aspects, the present teachings provide an optoacoustic material for use in a high-frequency light-generated focused ultrasound device, which can be used as an optoacoustic emission source and fulfill one or more of the criteria listed above.

As mentioned above, primary considerations for optimal generation of high-frequency ultrasound are high optical absorption and high thermal expansion, both of which are linearly proportional to output pressure amplitudes. Simultaneously, optically thin structures are highly preferred to reduce broadening of output ultrasonic pulses and acoustic attenuation through the source films. This is important because the high-frequency characteristic is one of the major reasons for using the optoacoustic generation approach.

Thus, in certain variations, an optoacoustic transmitter or lens according to the certain principles of the present teachings comprises a composite layer on a surface. The surface may define an arcuate shape, such as a concave shape and thus be an arcuate or concave lens. Concave shape means that the surface or layer defines a contour or outline that curves or arches inward between two points, for example, two points along a perimeter of an oval, circle, or sphere. In other aspects, the surface may be substantially flat or planar, where the composite layer is selectively applied in a pattern (e.g., concentric circles) to define an optical zone plate. Therefore, in certain embodiments, the optoacoustic composite layer comprises a dielectric, polymeric material and a plurality of light absorbing particles distributed therein. It is desirable to maximize light absorption to the composite material, while also maximizing thermal expansion, so that absorbed energy can be efficiently converted to volumetric expansion that results in physical displacement. In various aspects, the polymeric material has a large coefficient of thermal expansion, as will be discussed in greater detail below. In certain variations, the polymeric material comprises an elastomer, such as a siloxane, like polydimethylsiloxane (PDMS).

In certain embodiments, a plurality of energy or light absorbing particles is preselected to be strongly absorptive for the wavelengths of electromagnetic radiation applied by an energy source, such as a laser applying light energy. In certain aspects, a strongly light absorbing material absorbs or has an extinction of greater than or equal to about 60% of the electromagnetic radiation that is applied to the material; optionally greater than or equal to about 70%; optionally greater than or equal to about 75%; optionally greater than or equal to about 80%; optionally greater than or equal to about 85%; optionally greater than or equal to about 90%; optionally greater than or equal to about 95%; and in certain variations, optionally greater than or equal to about 97% of the electromagnetic radiation that is applied to the material. In certain aspects, the light absorbing material absorbs greater than or equal to about 50% to less than or equal to about 100% of light directed at the material. In certain variations, the plurality of light absorbing particles comprises axially shaped particles, such as carbon nanotubes. In other alternative variations, depending upon the wavelength of radiation to be applied, the light absorbing particles may be selected from gold particles (e.g., gold nanoparticles), silver particles, silver quantum dot particles, or other particles having strong light absorbing properties, and any combinations thereof. In certain variations, the light absorbing particles are carbon nanotubes that comprise graphene, such as multi-walled carbon nanotubes or single-walled carbon nanotubes, oxidized forms of graphene, and any combinations thereof. In certain aspects, the light absorbing particles may comprise carbon nanotubes, graphene oxide, or combinations thereof. In particularly desirable variations, the plurality of light absorbing particles comprises multi-walled carbon nanotubes.

However, in accordance with certain aspects of the disclosure, the composite material is substantially free of certain compounds or species, such as carbon black particles. The term "substantially free" as referred to herein is intended to mean that the compound or species is absent to the extent that undesirable and/or detrimental effects are negligible or nonexistent. In certain aspects, a composite layer that is "substantially free" of such compounds comprises less than or equal to about 1% by weight, optionally less than or equal to about 0.5% by weight, optionally less than or equal to about 0.1% by weight, and in certain preferred aspects, 0% by weight of the undesired species, like carbon black.

Thus, in certain variations of the present disclosure, a nano-composite layer structure is used as an optoacoustic emission source, which comprises a carbon nanotube-embedded concave substrate made of an elastomeric dielectric polymer. A nano-composite film of carbon nanotubes (CNTs) and elastomeric polymer can be formed on a surface of a concave lens, and thus used as an efficient optoacoustic source due to the high optical absorption of the CNTs and rapid heat transfer to the polymer upon excitation by pulsed laser irradiation. In certain aspects, the CNT-coated lenses can generate unprecedented optoacoustic pressures of greater than or equal to about 50 MPa in peak positive on a tight focal spot of about 75 μm in lateral and about 400 μm in axial widths, by way of non-limiting example. Such pressure amplitudes are remarkably high in this frequency regime, producing pronounced mechanical shock effects and non-thermal pulsed cavitation at the focal spot. These can be used as high-precision disruption sources for micro-scale fragmentation of solid materials and a single-cell surgery for removing cells from substrates and neighboring cells.

Thus, the present disclosure provides a new optical approach to generate a high-frequency and high-amplitude focused ultrasound, which can be used for non-invasive ultrasound therapy, by way of non-limiting example. By "high-frequency" ultrasound, it is meant that the ultrasound frequency generated is greater than or equal to about 10 MHz, typically known as a diagnostic ultrasound range. By "high amplitude," it is meant that an amplitude of the generated high-frequency and high-amplitude focused ultrasound has an output pressure, which may be a positive optoacoustic pressure that can induce pronounced shock effect on the order of tens of MPa, and/or a negative optoacoustic pressure that can induce acoustic cavitation. Both positive and negative optoacoustic pressure amplitudes are measured at or near a focal point of the curved optoacoustic lens. For example, in certain variations, an amplitude of the high-amplitude generated focused ultrasound has a positive optoacoustic pressure on the order of MPas, for example, at greater than or equal to about 1 MPa, greater than or equal to about 5 MPa, greater than or equal to about 10 MPa, optionally greater than or equal to about 15 MPa, optionally greater than or equal to about 20 MPa, optionally greater than or equal to about 25 MPa, optionally greater than or equal to about 30 MPa, optionally greater than or equal to about 35 MPa, optionally greater than or equal to about 40 MPa, optionally greater than or equal to about 45 MPa, and in certain variations, in excess of about 50 MPa.

Such high-amplitude focused ultrasound can provide localized perturbation in liquids and tissues by inducing shock, acoustic cavitation, and heat deposition on focal volumes. Such mechanical and thermal disturbances have been widely used to deliver targeted impacts on cells and tissues for biomedical therapy: for example, trans-membrane drug delivery (e.g., trans-dermal and blood-brain barrier opening), neural activity modulation in brain, and thrombolysis, often relying on acoustic cavitation or externally injected micro-bubbles. Further, high-intensity focused ultrasound (HIFU) has been used in clinical areas, like kidney-stone fragmentation, as well as ablation-based tumor therapy. Moreover, cavitation-based ultrasound therapy, such as lithotripsy, has shown some success as a new invasive mechanical ablation tool. Thus, the high-frequency, high-amplitude light-generated focused ultrasound provided in accordance with the present disclosure can be used in any of these applications.

Although conventional techniques have been used over a broad range of biomedical applications, such techniques suffer from having focal accuracy that is fairly limited, due to bulky focal dimensions. Typically, the focal accuracy is greater than 2 mm in a lateral plane and often greater than 10 mm in an axial plane. Such large focal accuracy occurs because focused ultrasound has been generated by using low-frequency piezoelectric transducers (a few MHz). Moreover, the low-frequency pressure waves necessitate large lens sizes on the order of several centimeters, which are not suitable for intra-operative applications.

For example, conventional piezoelectric transducers for high-intensity focused ultrasound (HIFU) typically generate a low frequency ranging from 0.8 to 4 MHz with large focal spots on the order of several mm of resolution. See, e.g., Zhou, Yu-Feng, "High intensity focused ultrasound in clinical tumor ablation," World Journal of Clinical Oncology, Vol. 2, No. 1, pp. 8-28 (Jan. 10, 2011) (published online Jan. 10, 2011), the relevant portions of which are incorporated herein by reference. High-frequency ultrasound (tens of MHz) on the other hand, provides obvious advantages for spatial and temporal confinement, which is suitable for high-accuracy cell therapy, as well as ablation-treatment over single tissue layers and micro-vasculature. It should be also noted that tumors often grow adjacent to a vital blood vessel, which should be kept intact. Thus, the bulky focal spots of conventional HIFU and other ultrasound devices cannot be used in the selective manner necessary for such high-precision surgical techniques. In contrast, in certain aspects, the present disclosure provides a high-frequency and high-amplitude focused ultrasound with high resolution and relatively small focal spots from light-generated focused ultrasound devices, particularly suitable for high-precision ablation required in critical surgery conditions.

As further background, certain challenges exist to achieve therapeutic pressure amplitudes in the high-frequency regime (e.g., higher than about 10 MHz). For example, stronger tensile pressure (P) is required at higher frequency (f) to induce the acoustic cavitation (i.e., $P \propto f^{1/2}$ approximately) which can create significant impacts upon adjacent media through liquid micro-jets and shock waves when the bubbles are collapsed. Furthermore, such high pressure ideally should be achieved at the focal spot after experiencing severe acoustic attenuation especially in the high-frequency range, e.g., $2.2\times10^{-3}$ dB/(cm×MHz$^2$) in water. A single pulsed cavitation in this regime is even more challenging, because of negligible heat deposition. The pulsed cavitation has a particular significance when the cellular treatment is associated with the gene therapy and the intra-membrane process, which desirably occur primarily in the mechanical disruption regime, as thermal heating can cause irreversible transformation in the cells.

Conventional high-frequency ultrasound has been alternatively generated by using pulsed laser irradiation on light-absorbing materials and then creating thermo-elastic volume expansion. The optoacoustic generation from such conventional systems can lead to several tens of MHz up to GHz in the frequency, but its poor energy conversion efficiency is a major drawback, resulting in weak pressure amplitudes. The high-frequency advantage is further compromised in such systems by the frequency-dependent acoustic attenuation over long-range propagation. Due to these limitations, the optoacoustic pressure as a high-frequency source has not been previously considered for deep-tissue imaging or therapeutic purposes.

In certain variations, the present teachings provide a light-generated focused ultrasound (LGFU) as a new modality, which can produce a high-frequency (e.g., 6-dB roll-off around 30 MHz frequency) and unprecedented optoacoustic pressure of tens of MPa, and in certain variations in excess of 50 MPa optoacoustic pressure. In certain variations, the present disclosure provides a laser light-generated focused ultrasound. Furthermore, in certain variations, such a high-frequency and high-amplitude ultrasound also has a desirably tight focal spot of less than or equal to about 200 μm, optionally less than or equal to about 75 μm in a lateral dimension, and less than or equal to about 1,000 μm, optionally less than or equal to about 400 μm in axial directions from a single-element lens. In certain variations, such a high-frequency and high-amplitude LGFU ultrasound is generated from a single-element lens that is about 6 mm in diameter. However, the lens dimensions for LGFU in accordance with the present teachings are not limited to this value. The lens may include arbitrary curved substrates ranging from micro-scale (e.g., micro-lenses made of silica and sapphire) to several centimeters in diameter, typically used for optical imaging and focusing, as long as the light-absorbing optoacoustic source materials can be formed thereon. The LGFU is generated by using a uniquely designed optoacoustic emission film, which in certain preferred aspects, can be made of an energy absorbing carbon-nanotube (CNT)-polymer composite formed on a concave surface for acoustic focusing. LGFU according to various aspects of the present disclosure produces high-amplitude ultrasound, which going into a therapeutic regime, is obtained due to an efficient energy conversion process by the energy absorbing material (e.g., CNT-composite) and a high focal gain in the optoacoustic lens platform. In certain embodiments, the acoustic performance of the LGFU is temporally and spatially characterized at the focal spot. Remarkably, it is shown that the LGFU of the present teachings produces powerful shock waves and single-pulsed cavitation, both of which can be used as strong sources of mechanical disruption. These enable micro-scale lithotripsy and targeted cell therapy with high precision. In certain embodiments, such high-frequency LGFU ultrasound devices have a spatial dimension of the mechanical disruption that can be controlled from a smaller dimension of about 6 μm to about 10 μm up to a larger dimension of about 300 to 400 μm at the focal zone. Higher amplitude of LGFU increases the destruction zone near a focal spot (or vice versa) because the stronger pressure is given upon a wider area. A threshold pressure for destruction depends on properties of specific materials exposed to the LGFU, for example, hardness of target materials. Therefore, such a disruption zone by the LGFU can be smaller or larger than the focal spot dimension (e.g., 75 μm), depending on the LGFU amplitude.

A high-frequency light-generated focused ultrasound (LGFU) device may comprise a source of light, such as a source of laser energy, and an optoacoustic lens prepared in accordance with the present teachings. The optoacoustic lens optionally comprises a composite layer that comprises a dielectric polymeric material and a plurality of light absorbing particles. In certain preferred aspects, the composite layer defines a concave shape. In certain embodiments, a suitable optoacoustic lens comprising the composite may have an f-number (f#) of less than 1, expressed by:

$$\# = \frac{r}{D},$$

where r is radius of curvature of the arcuate (concave) surface and D is a diameter of the lens. As the optoacoustic lenses may have low f-numbers (about 0.5 to about 1), their geometrical gains at focal spots are higher than those of the conventional piezoelectric transducers. Furthermore, the operation is realized over a high-frequency range. This enables formation of pronounced shock waves in a short propagation distance.

Maximum and minimum diameters of optoacoustic lenses can be determined in certain variations by commercial availability of concave or convex structures. In certain variations, a diameter of an optoacoustic lens according to certain aspects of the present teachings comprising a composite layer is less than or equal to about 25 mm. This is because a typical lens dimension made of fused silica and commercially available is less than 25 mm. However, in certain preferred variations, a suitable optoacoustic lenses has a diameter of less than or equal to about 10 mm, thus satisfying an f-number of less than 1 and providing a frequency of higher than 10 MHz for high-frequency focusing applications. However, optoacoustic lenses having larger dimensions are useful for low-frequency focusing applications. An appropriate radius-of-curvature of an optoacoustic lens is determined according to proper requirements of f-numbers and geometrical gains, as appreciated by those of skill in the art.

As noted above, in the high-frequency light-generated focused ultrasound (LGFU) device, a light energy source is directed to the optoacoustic lens, which is capable of generating high-frequency and high-amplitude focused ultrasound. In certain variations, the light energy may originate from a non-coherent source of light. Although in other variations, the light energy may be coherent laser energy generated by a laser energy source. In certain aspects, light energy used in the device has a wavelength ranging from ultraviolet (UV) to far infrared (FIR), thus such electromagnetic radiation may have a wavelength of greater than or equal to about 100 nm to less than or equal to about 1 mm. Such electromagnetic waves may include ultraviolet light (UV) having wavelengths of about 100 nm to about 390 nm, visible light having wavelengths ranging from about 390 to about 750 nm and infrared radiation (IR) (including near infrared (NIR) ranging from about 0.75 to about 1.4 μm; short wave infrared (SWIR) ranging from about 1.4 to about 3 μm; mid wave infrared (MWIR) ranging from about 3 to about 8 μm; long wave infrared (LWIR) ranging from about 8 to about 15 μm; and far infrared (FIR) ranging from about 15 μm to 1 mm). In certain aspects, a laser is used that has a pulse width of less than or equal to about 10 nanoseconds (e.g., 6 ns) for efficient optoacoustic generation because an optoacoustic pressure in a far field is proportional to the time-derivative of the original laser pulse shape. Therefore, the sharper the laser pulse in a temporal width, the higher the optoacoustic pressure. The narrower temporal pulse also increases the operation frequency of the LGFU, which results in a tighter focus. Nanosecond laser pulses are commonly available, which are sufficient to generate ultrasonic pulses with several tens of MHz of frequency spectra. In certain variations, the laser is a nanosecond laser capable of generating a pulse of less than or equal to about 100 ns, optionally less than or equal to about 75 ns, optionally less than or equal to about 50 ns, and optionally less than or equal to about 25 ns. In certain preferred variations, the laser is a nanosecond laser capable of generating a pulse of less than or equal to about 20 ns, optionally less than or equal to about 15 ns, optionally less than or equal to about 10 ns, and in certain aspects, less than or equal to about 6 ns. In certain aspects, the repetition rate used in the device ranges from a few Hz (e.g., 2-3 Hz) up to MHz. For example, in certain aspects, a laser may have a repetition rate of greater than or equal to about 10 Hz. A higher repetition rate of the laser pulses can be required to increase an acoustic intensity at a focal spot. While depending on the application, laser pulse energy may vary, in certain aspects, a nanosecond laser may have a pulse energy of greater than or equal to about 5 mJ/pulse to less than or equal to about 55 mJ/pulse, optionally greater than or equal to about 6 mJ/pulse to less than or equal to about 51 mJ/pulse. In certain variations, an exemplary pulse energy may be about 10 to 11 mJ/pulse.

While exemplary, a laser having a 6-ns laser pulse width, 20 Hz in the repetition rate, and tens of mJ in laser energy can be used as the light source. In certain embodiments of the present disclosure, the spatial peak-pulse average (SPPA) intensity of the light-generated focused ultrasound (LGFU) is less than 0.2 $W/cm^2$ due to the low repetition rate. For high-intensity applications, lasers with high repetition rates (greater than about 100 kHz) are commercially available with the similar pulse energy (tens of mJ) and temporal width (5 ns to about 8 ns). For example, a pulse repetition of greater than 1 kHz would result in SPPA greater than 100 $W/cm^2$ in the pressure intensity. This would accumulate significant heat at focal volumes. Accordingly, the LGFU performance, in terms of pressure amplitude, intensity, frequency spectrum, and focal spot sizes, can be controlled externally by the excitation lasers.

In certain variations, a frequency of the generated high-frequency and high-amplitude focused ultrasound from such a device is greater than or equal to about 10 MHz. Furthermore, in certain variations, an amplitude of the generated focused ultrasound has a positive optoacoustic pressure of greater than or equal to about 10 MPa, and in certain variations on the order of tens of MPa as discussed previously above, for example, a positive optoacoustic pressure of greater than or equal to about 20 MPa, optionally greater than or equal to about 30 MPa, optionally greater than or equal to about 40 MPa, and in certain aspects, optionally greater than or equal to about 50 MPa.

FIGS. 8 and 9 show a comparison of detector amplitude for a composite layer comprising carbon nanotubes and polydimethylsiloxane (CNT-PDMS) according to the present teachings as compared to a conventional chromium film (Cr). FIG. 8 also shows an alternative embodiment of the present teachings having a composite layer comprising gold nanoparticles and polydimethylsiloxane (AuNP-PDMS). FIG. 8 illustrates optoacoustic behavior of different thin films on flat, planar substrates (rather than a curved lens) as described in Baac, Hyoung Won, et al., "Carbon nanotube composite optoacoustic transmitters for strong and high frequency ultrasound generation," Applied Physics Letters, Vol. 97, pp. 234104-1-244104-3 (2010) (published online Dec. 8, 2010), incorporated herein by reference. A 6-ns pulse of laser energy is applied to each respective material and measured at 1.6 mm distance (plane-wave configuration). Detection of amplitude occurs by an optical micro-ring resonator (broadband frequency response). The detector amplitude for the CNT-PDMS is significantly greater (over 18 times larger) than the amplitude of the Cr film for the same wavelength of light having a pulse of 6 ns applied. Notably, amplitude for the AuNP-PDMS is also improved over the Cr film by about three times, but is significantly less than the CNT-PDMS amplitude. While the AuNP-PDMS structure also enables an efficient energy conversion and is desirable for high-frequency generation, it is typically not easy to achieve high optical absorption (e.g., >70%), although it is possible to design the AuNPs in various shapes and dimensions to enhance the absorption over a specific wavelength range. Furthermore, the CNT-PDMS material has about 7 to 9 times higher damage threshold for laser ablation than that of the AuNP-PDMS. Therefore, almost one order-of-magnitude higher laser energy is additionally available in the CNT-PDMS design to generate stronger optoacoustic pressure.

FIGS. 8 and 9 show strong ultrasound is produced by the CNT-PDMS material with excellent frequency spectrum (e.g., almost the same as that of the laser pulse). As the CNT-PDMS structure exhibits uniform enhancement over a broadband frequency range up to 120 MHz as compared to the Cr reference film, the increased laser energy directly enhances the high-frequency components in a proportional manner. The enhanced amplitudes over the high-frequency range mean that high-frequency ultrasound is available over a long propagation distance.

In certain variations, the composite layer of the optoacoustic lens (the region or layer comprising carbon nanotubes distributed or embedded with a dielectric polymeric material) is a thin film having has a depth of optical absorption less than or equal to 30 μm; optionally less than or equal to about 25 μm, and optionally less than or equal to about 20 μm. In certain variations, a depth of optical absorption of the composite layer is optionally greater than or equal to about 10 μm to less than or equal to about 20 μm. A thickness of the thin film may be the same as the depth of optical absorption.

In certain variations, the light absorbing particles in the composite layer comprise carbon nanotubes, such as multi-walled carbon nanotubes, which have excellent photoabsorption/extinction capabilities. As noted above, in alternative variations, light absorbing particles in the composite layer may comprise other light absorbing/photoextinction materials, such as gold nanoparticles. In certain aspects, the plurality of light absorbing particles may comprise different combinations of species of particles. However, in certain preferred aspects, the plurality of light absorbing particles in the composite layer of the optoacoustic lens consists essentially of carbon nanotubes. For strong pressure output, uniform, high density CNT distribution over the curved substrate is desirable. Thus, in certain aspects, the plurality of light absorbing particles is substantially uniformly distributed within the concave composite layer. In certain aspects, the plurality of light absorbing particles is disposed on the convex surface at a substantially uniform density, meaning that the particles are not agglomerated to cause significant variation in optical extinction over the entire film. The desirable variation of optical extinction on the film, which can be measured by a laser spot of around 3 mm in diameter, is preferably less than or equal to about 30%, optionally less than or equal to about 25%, optionally less than or equal to about 20%, optionally less than or equal to about 15%, and optionally less than or equal to about 10%.

Further, in certain aspects, the CNT coverage as grown over the substrate is greater than or equal to about 60%. Thus, in certain aspects, the plurality of light absorbing particles covers greater than or equal to about 60%, optionally greater than or equal to about 65%, optionally greater than or equal to about 70%, optionally greater than or equal to about 75%, optionally greater than or equal to about 80%, and in certain preferred aspects, optionally greater than or equal to about 85% of the surface area of the substrate defining the optoacoustic composite source material comprising light absorbing particles, like carbon nanotubes.

In certain variations, the light absorbing particles disposed within the composite are highly energy absorptive and thus capable of absorbing greater than or equal to about 50% of the electromagnetic waves or laser energy directed at the optoacoustic lens; optionally greater than or equal to about 60%; optionally greater than or equal to about 70%; optionally greater than or equal to about 80%; optionally greater than or equal to about 75%; optionally greater than or equal to about 80%; optionally greater than or equal to about 85%;

optionally greater than or equal to about 90%; and in certain variations, optionally greater than or equal to about 95%. As noted above, in certain preferred aspects, carbon nanotubes are particularly advantageous for use as the light absorbing particles. In certain aspects, the carbon nanotubes may be coated with an additional absorption material that further enhances the light absorbing particles' ability to absorb laser energy or plasmonic enhancement. Such an additional electromagnetic absorption material may comprise highly absorptive metals, such as gold, silver, aluminum, and the like. In certain variations, the highly absorptive material applied to the light absorbing particles, like carbon nanotubes, is gold. The high absorptive material can be applied as a layer over the particles, optionally having a thickness of less than or equal to about 30 nm. In certain variations, a suitable thickness of the highly absorptive additional material over the light absorbing particles may be about 20 nm.

The polymeric material of the composite layer preferably has a thermal coefficient of volume expansion of greater than or equal to about $1\times10^{-5}\times K^{-1}$, and optionally in certain variations, greater than or equal to about $2.1\times10^{-4}$ $K^{-1}$ (the value of water), optionally greater than or equal to about $5\times10^{-4}$ $K^{-1}$, and in certain variations, greater than or equal to about $9.2\times10^{-4}$ $K^{-1}$. In certain variations, the polymeric material comprises polydimethylsiloxane and thus has a thermal coefficient of volume expansion of $9.2\times10^{-4}$ $K^{-1}$. In certain aspects, the polymeric material may comprise different monomers, oligomers, or combinations of polymeric materials. However, in certain aspects of the present disclosure, the polymeric material of the composite layer of the optoacoustic lens consists essentially of siloxane polymers, like polydimethylsiloxane.

The high-frequency light-generated focused (LGFU) ultrasound device may comprise a source of light, such as a source of laser energy, and an optoacoustic lens. The laser energy source, in certain exemplary embodiments, may have a laser energy pulse of 6 ns with a wavelength of about 532 nm. For example, a 6-ns Nd:YAG pulsed laser may be used. In certain variations, such an LGFU device can generate ultrasound with a focal spot of less than or equal to about 200 μm, optionally less than or equal to about 75 μm in a lateral dimension and less than or equal to about 1,000 μm, optionally less than or equal to about 400 μm in an axial dimension. While the focal spot size depends upon the diameter and radius of curvature of the optoacoustic lens, while not limiting, in certain variations the focal spot for the LGFU ultrasound device can be very small with high resolution.

Accordingly, in certain aspects, the present teachings provide a high-frequency light-generated focused ultrasound (LGFU) device, like that shown in FIGS. 1(*c*) and 7, which employs laser energy as the light source. In FIG. 1(*c*), the high-frequency light-generated focused ultrasound device 100 optionally comprises a source of electromagnetic radiation, such as laser 110, and an optoacoustic lens 120. Optoacoustic lens 120 comprises a composite layer 122 that has a concave shape. As shown in FIG. 1(*c*), one or more filters 124 or beam expanders 126 or other components well known in the art may be used to direct the laser energy from the laser 110 towards the optoacoustic lens 120. The composite layer 122 comprises a polymeric material and a plurality of light absorbing particles. When laser energy is directed to the optoacoustic lens 120 having the concave composite layer 122, it is capable of generating a high-frequency and high-amplitude focused ultrasound (which is generated in water tank 130 in which the optoacoustic lens 120 is in contact). As can be seen in FIGS. 1(*c*) and 7, a single-mode fiber-optic hydrophone 132, including a photodetector 134 with a coupler (e.g., a 3-dB coupler) and digital oscilloscope 136, are also disposed in the water tank 130 for measurements. In certain aspects, the high-frequency ultrasound generated by the device is greater than or equal to about 10 MHz, while an amplitude is greater than or equal to about 10 MPa, optionally greater than or equal to about 25 MPa, optionally greater than or equal to about 50 MPa. FIG. 1(*d*) shows 2 distinct lenses having concave-shaped surfaces onto which the composite layer is applied according to certain aspects of the present teachings. The first lens is formed from a commercially available Type I lens having a diameter of 6 mm (which will be described in greater detail below), while the second is a larger commercially available Type II lens with a diameter of 12 mm.

In various aspects, the present disclosure provides methods for making a focused optoacoustic transmitter or lens capable of generating high-frequency light-generated focused ultrasound (LGFU). The various materials for the optoacoustic lens may be the same as any of those discussed above in the context of the high-frequency light-generated focused ultrasound (LGFU) device. In certain embodiments, the methods optionally comprise disposing a plurality of light absorbing particles on a surface. The surface may be an arcuate lens or an optical zone plate. Where the surface is an optical zone plate, the plurality of light absorbing particles and polymer may be selectively applied to the surface to form concentric rings of a zone plate in any pattern desired, for example, by masking or other patterning techniques well known in the art. In certain aspects, the surface is an arcuate surface of a template, such as a fused silica lens. Then a polymeric material precursor can be applied to the plurality of light absorbing material, so that the arcuate surface of the template contacts the polymeric material precursor. Notably, in alternative embodiments, the plurality of light absorbing particles can be mixed with the polymeric material precursor first, so that the disposing of a plurality of light absorbing particles on a surface and the disposing a polymeric material precursor on the plurality of light absorbing particles on the surface are conducted in the same step.

Next, the polymeric material precursor is dried or cured to form a solid polymeric material. In certain variations, the arcuate surface is a concave surface of a lens, and after curing, a cured composite layer is formed thereon. The surface may be planar to form an optical zone plate. In other variations, the arcuate surface can be a convex surface and a transfer technique can be used to form a concave composite layer. For example, the arcuate surface (convex surface) of the template can be removed from the cured polymeric material to create a second arcuate concave surface in the cured polymeric material. The convex arcuate surface, which serves as a mold or template, has a contra-positive shape to the concave arcuate surface. During such a process of formation, the plurality of light absorbing particles is transferred from the first arcuate convex surface of the template to the second arcuate concave surface of the cured polymeric material to form a composite layer defining the focused optoacoustic lens. The transferring can include embedding of the light absorbing particles in the cured polymeric material, so that the cured polymeric material surrounds each respective particle of the plurality of light absorbing particles. In certain variations, pressure may be applied to the first arcuate surface in contact with the polymer precursor or cured polymeric material to further increase transfer of carbon nanotubes.

In certain preferred variations, the light absorbing particles comprise carbon nanotubes and the disposing comprises growing the carbon nanotubes on the surface. In certain aspects, the inventive technology provides unique advantages when employing CNTs, which can be directly grown on arbitrary shaped surfaces. As the growth of CNT films is conformal to the surface, spherical lenses with deep curvatures (i.e., low f-number) can be selected to achieve high focal gains. However, as noted above, it can be important to ensure uniform growth of CNTs and high levels of coverage to ensure strong pressure output from the transmitting lens. Some difficulty has been encountered in uniformly growing CNTs over curved substrates. Thus, in certain variations, by introducing a catalyst material layer and/or by controlling gas exposure conditions, uniform, high density CNT growth on an arcuate surface can be achieved. Thus, in certain embodiments, the method may comprise applying a catalyst to the surface, such as an arcuate surface, prior to the growing step, to facilitate growth of the carbon nanotubes. In certain aspects, the catalyst comprises at least one compound selected from the group consisting of: iron (Fe), aluminum oxide ($Al_2O_3$), and combinations thereof. The iron or aluminum oxide may be applied by e-beam evaporation or sputtering. In certain variations, an iron catalyst can be applied to the substrate at a thickness of about 1 nm and an aluminum oxide can be applied to the substrate at a thickness of about 3 nm. The carbon nanotubes can grow in a furnace at temperatures of about 775° C. by chemical vapor deposition (CVD) in the presence of $C_2H_4/H_2/He$, for example.

In certain preferred aspects, the plurality of light absorbing particles is substantially uniformly distributed on the surface. In certain aspects, the plurality of light absorbing particles is disposed on the surface, such as an arcuate surface, at a substantially uniform density, as described above. The cured polymeric material optionally comprises polydimethylsiloxane. In certain variations, prior to the applying a polymeric material precursor, an additional absorption material is applied to the plurality of light absorbing particles. In certain variations, the light absorbing particles comprise carbon nanotubes and the additional absorption material comprises gold.

In certain embodiments, such as that shown in FIG. 2, a method according to certain aspects of the present teachings optionally comprises disposing a plurality of light absorbing particles on an arcuate surface that defines a convex shape. As noted above, by convex, it is meant that the arcuate surface or layer defines a contour or outline that curves or arches outwardly between two points, which can form a perimeter or circumference of an oval, circle, or sphere, for example. In FIG. 2, a commercially available lens 200 is shown which defines a convex lens surface 202. Such a lens 200 can comprise fused silica, for example. A plurality of light absorbing particles, such as carbon nanotubes, is disposed onto the convex lens surface 202. In certain variations, for high optical absorption, multi-walled carbon nanotubes (MW-CNTs) are selected as the light absorbing particles. The methods of the present disclosure optionally comprise a step of disposing or growing light absorbing particles on the surface of lens 200. For example, in certain embodiments, the CNTs can be densely grown on fused silica substrates by high-temperature chemical vapor deposition (CVD). In alternative variations, other techniques known to those of skill in the art may be used to form CNTs on the surface.

In certain variations, while not shown, a catalyst layer may be deposited on the substrate (surface of lens 200) prior to forming the CNTs to further facilitate growth of CNTs. Thus, MW-CNTs can be initially grown on an arcuate lens substrate (fused silica) 200 coated with a catalyst layer of Fe (about 1 nm thickness), which can be deposited by e-beam evaporation, for example. The CNTs can be grown in a mixture of $C_2H_4/H_2/He$ in an atmospheric pressure tube furnace at about 775° C. This process desirably leads to a tangled CNT layer that forms part of optoacoustic material 210 with high density and even coverage, as compared to those from solution-based approaches. In certain embodiments, the CNT length and areal density can be controlled to have an optical extinction (for preselected electromagnetic waves) of at least about 60% to about 70%. Both the CNT length and the areal density increase with a growth time at the high-temperature furnace. Typically, it takes less than 2 minutes in such furnace conditions to have the optical extinction of higher than 60%. This can be further increased up to 100% by growing over a longer time period, resulting in a CNT forest or layer that creates at least a portion of optoacoustic source 210 with a thickness on the order of tens of micrometers. However, such a thick and high density CNT forest or layer within optoacoustic source 210 may be undesirable in certain aspects, because such thick CNTs in the optoacoustic source 210 can cause significant acoustic attenuation within the optoacoustic transmitter. In certain variations, the optical extinction is at least about 80% for predetermined electromagnetic waves. In certain variations, to further increase optical extinction, an additional absorptive material can be applied over the CNTs; for example, a layer of gold may be deposited by chemical vapor deposition at thicknesses specified previously above.

For efficient optoacoustic generation, it is desirable that the CNTs or light absorbing particles in optoacoustic source material 210 are embedded or surrounded by polymers, which have high thermal expansion coefficients. In certain variations, a method of making a focused optoacoustic lens for a high-frequency light-generated focused ultrasound comprises first disposing a plurality of light absorbing particles on an arcuate surface 202 of lens 200. In the case of carbon nanotubes used as the light absorbing particles, the carbon nanotubes may be grown on the arcuate surface 202. In certain variations, the arcuate surface 202 may be a commercially available concave lens 200, such as is shown in FIG. 11. In FIG. 11, the concave lens 40 comprises fused silica and optoacoustic source layer 42 comprises cured dielectric polymer comprising polydimethylsiloxane (PDMS) and a plurality of light absorbing particles comprising carbon nanotubes.

In other variations, such as the embodiment described below and in FIG. 2, the arcuate surface 202 may be a convex surface of a template. Next, a dielectric polymeric material precursor is applied to the plurality of light absorbing particles disposed on the arcuate surface. Such a polymeric material precursor can be applied by spin-casting or by other known techniques for applying polymer precursor include jetting, spraying, and/or by gravure application methods, by way of non-limiting example. The dielectric polymeric material precursor can then be solidified, for example, by curing or drying to form a polymeric film having a high coefficient of volume thermal expansion. Notably, in alternative variations, the composite may be formed by first mixing the light absorbing particles and polymeric precursor, which is then applied to the surface and dried to form the polymeric film. In certain variations, the dielectric polymeric material precursor forms a composite layer having a high coefficient of volume thermal expansion of greater than or equal to about $1\times10^{-5}\times K^{-1}$, and optionally in certain variations, greater than or equal to about $5\times10^{-4}$ $K^{-1}$. Where the arcuate surface is a concave lens, the solidifying by drying or curing forms an arcuate composite layer.

In certain other variations, the optoacoustic lens can be created by using a transfer-based scheme (FIG. 2). The method next comprises positioning a planar substrate, such as a silica or glass substrate 214, a predetermined distance away from the convex surface 202, thus forming a gap 216 there between. At least a portion of the gap 216 between the glass substrate 214 and convex surface 202 is then filled with a polymeric material precursor 220, so that at least a portion of the convex surface 202 having the light absorbing particles defining optoacoustic source 210 contacts the polymeric material precursor 220. For example, an elastomeric polymeric material precursor (that will form polydimethylsiloxane (PDMS) after curing is completed, for example) is spin-coated over the plurality of CNTs. In certain variations, the polymeric material precursor 220 is then cured or cross-linked to form a polymeric material 220. Other known techniques for applying polymer precursor in the gap 216 are also contemplated, such as spin casting, jetting, spraying, and/or by gravure application methods, by way of non-limiting example. After curing at 100° C. for 1 hour, the polymer replica is de-molded bringing the CNTs from the fused substrate onto the surface of the polymer.

In the next step, the convex surface 202 of lens 200 is removed from the cured polymeric material 222 to create a concave surface in the cured polymeric material, wherein the plurality of light absorbing particles is transferred from the convex surface to the concave surface 224 that defines a composite layer (comprising the plurality of light absorbing particles 210 transferred from the convex surface 202 of lens 200 and embedded into the cured polymeric material 222). This composite optoacoustic source 210 layer forms the focused optoacoustic lens. Notably, pressure may be applied to the convex surface 202 of lens 200, polymeric material 220, and/or substrate to further facilitate transfer of the CNTs to the polymeric material 220. Using the CNT-grown convex substrate, a molded replica is formed, which is a concave structure of PDMS (SYLGARD™ 184, Dow Corning) with a layer of embedded CNTs. In this manner, the convex surface 202, serves as a mold for the polymeric material 220. Fused silica optical lenses (having convex surfaces) thus are used in such methods as a concave substrate mold to form the optoacoustic lens comprising a composite layer having a polymeric material, like PDMS, and a plurality of light absorbing particles, like CNTs.

In certain alternative embodiments, like that shown in FIG. 31, an optoacoustic lens can be a Fresnel-type optical zone plate 300. Such optical zone plates 300 typically define a surface pattern of absorptive grating, for example, concentric or circular diffraction grating to create high-frequency light-generated focused ultrasound. Thus, a transparent flat substrate 310 has a plurality of surface regions 320 that comprise a composite material with a plurality of light absorbing particles and a polymer that serves as a dielectric material having a high coefficient of volume thermal expansion greater than or equal to about $1\times10^{-5}\times K^{-1}$ and optionally in certain variations, greater than or equal to about $5\times10^{-4}$ $K^{-1}$, as discussed in the context of other embodiments. Notably, a variety of different patterns and dimensions for the concentric grating are contemplated and not limited by the exemplary periodicity shown. When the light energy is directed to the optical zone plate 300, it is capable of generating high-frequency and high-amplitude focused ultrasound having a frequency of greater than or equal to about 10 MHz and an output pressure of greater than or equal to about 1 MPa.

Thus, the disclosure also contemplates methods of making a focused optoacoustic lens for a high-frequency light-generated focused ultrasound. The method may comprise disposing a plurality of light absorbing particles on a flat surface. Then, a polymeric material precursor may be disposed on the plurality of light absorbing particles disposed on the surface. The method further includes solidifying, e.g., drying or curing, the polymeric material precursor to form a polymeric film having a high coefficient of volume thermal expansion greater than 1×10-5 K-1 to form the optical zone plate optoacoustic lens for generating high-frequency light-generated focused ultrasound. Notably, any of the formation techniques generally described above in the context of the arcuate surface formation may be used to form a zone plate on a planar surface. The grating pattern for the optical zone plate may be formed by masking prior to applying the light absorbing materials and polymeric material precursor, by way of non-limiting example. Furthermore, in certain variations, the plurality of light absorbing particles can be mixed with the polymeric material precursor, so that the disposing of a plurality of light absorbing particles on the surface and the disposing a polymeric material precursor on the plurality of light absorbing particles disposed on the surface are conducted in the same step.

Such optoacoustic lenses in accordance with various aspects of the present disclosure desirably have high optical absorption, efficient heat transduction, and high thermal expansion. In certain variations, an additional layer of absorbing material is applied over the CNTs to enhance optical extinction to greater than or equal to about 85% for the light absorbing particles. FIGS. 1(*a*) and 1(*b*) show cross-sectional views of a gold-coated CNT-PDMS composite layer fabricated on a concave lens.

Thus, the method may further comprise disposing an additional layer of absorptive material (not shown) over the light absorbing particles prior to positioning it near the glass substrate 214 to form the gap 216 to be filled with polymeric material precursor 214. This step may also occur in the direct coating formation process shown in FIG. 11. In certain embodiments, the additional layer of absorptive material is created by depositing a gold layer over the light absorbing particles, e.g., CNTs, to further increase extinction ratio and absorption of electromagnetic radiation. In certain variations, a thickness of the additional layer of absorptive material may have a thickness of less than 30 nm. A fast thermal transition property of the CNTs is still maintained after the gold deposition. In other embodiments, the additional layer of absorptive material may be other highly absorptive materials, like aluminum, silver, copper, nickel and/or chromium.

In certain variations, where the plurality of light absorbing particles is carbon nanotubes coated with gold (as described above), the nano-scale thermal properties of the CNTs are used to design efficient optoacoustic transmitters. Rapid heat diffusion to a surrounding medium is one important characteristic for selecting light absorbing nano-particles. For a given heat diffusion time determined by the nano-particle dimension, a fraction of thermal energy η can be estimated within the absorbers after the laser pulse duration as $$\eta = \frac{\tau_{HD}}{\tau_L} \times \left[1 - \exp\left(-\frac{\tau_L}{\tau_{HD}}\right)\right], \quad (1)$$

where $\tau_{HD}$ and $\tau_L$ are the heat diffusion time and the laser pulse duration. For a cylinder with diameter d, the diffusion time can be described as $\tau_{HD}=d^2/16\chi$ where $\chi$ is the thermal diffusivity of the surrounding medium. This results in $\tau_{HD}$ less than 0.4 ns for the gold-coated CNT (about 25 nm in diameter) surrounded by the PDMS ($\chi=1.06\times10^{-7}$ $m^2/s$). It is much faster than the temporal width of laser pulses (6 ns), leading to the negligible energy remaining within the CNT ($\eta=0.06$) after the optical pulse excitation. This means that, as soon as the CNTs are heated by the light absorption, they give out most of the thermal energy to the surrounding polymer, which can cause instantaneous thermal expansion with high amplitudes. The surrounding polymer is selected to have high thermal conductivity. For example, PDMS has a desirably high thermal coefficient of volume expansion, $0.92\times10^{-3}$ $K^{-1}$, which is about 3 to 4 times higher than that of water and typical polymers, like epoxy, and about 20 times higher than those of typical metals. The large volume deformation by the surrounding medium with materials having a high thermal expansion coefficient distinguishes various embodiments of the present teachings from the case of micro-scale optical absorbers commonly used as optoacoustic imaging contrast agents. For a micro-scale cylinder of 1 μm in diameter, most of the generated heat is confined ($\eta=0.99$) after the same pulse duration of 6 ns. Therefore, the volume deformation is dominated by the optical absorbers themselves.

For growth of CNTs, fused silica substrates are prepared by coating catalyst layers of Fe (about 1 nm) and $Al_2O_3$ (about 3 nm) deposited by using a sputtering system. The fused silica substrates are plano-concave optical lenses (purchased from Edmund Optics, Barrington, N.J.) with 5.5-mm radius-of-curvature (r) and 6-mm diameter (D) (type I lens), and 11.46 mm and 12 mm (type II lens), respectively, see Table I below. With renewed reference to FIG. 11, an optoacoustic lens having a concave surface (formed on a fused silica substrate) with a nanocomposite layer defines a concave shape comprising carbon nanotubes and polydimethylsiloxane. The lens has a diameter D, a radius of curvature r, and $\phi$ is half angle of lens aperture.

TABLE I

| | Diameter (D) | Radius-of-curvature (r) | Angle of aperture (2$\phi$) | f-number (r/D) |
|---|---|---|---|---|
| Type I | 6 mm | 5.5 mm | 66° | 0.92 |
| Type II | 12 mm | 11.46 mm | 63° | 0.96 |

Multi-walled CNTs are grown on the plano-concave surface in a mixture of $C_2H_4/H_2/He$ in an atmospheric pressure tube furnace at 775° C. This process leads to a tangled CNT layer that conforms to the curved surface of the lens. The as-grown CNTs, which have an optical extinction of about 60 to about 70% by themselves, are then coated by a 20 nm thick gold layer deposited by e-beam evaporation. This further enhances the optical extinction of the coated CNTs to higher than 85%, without increasing the overall source thickness significantly. Then, PDMS is spin-coated over the CNT-grown surface at 2000 r.p.m. for 2 minutes, and then cured at 100° C. for 1 hour. PDMS infiltrates the CNT network forming a well-organized nano-composite film.

Experimental configurations for temporal and spatial characterizations are as follows. As discussed above, FIG. 1(*c*) shows an experimental schematic used for generation and characterization of the focused ultrasound. A 6-ns pulsed laser 110 (SURELITE™ I-20, Continuum, Santa Clara, Calif.) is used with a repetition rate of 20 Hz. The laser beam initially has 5 mm in diameter. The laser beam is first attenuated by the neutral density filters 124 and then expanded (×5) via a beam expander 126. The collimated beam is illuminated to the transparent (planar) side of the lens 120. The focused acoustic waves are detected by scanning the single-mode fiber-optic hydrophone 132 (6-μm core and 125-μm cladding in diameters) at the focal zone. Both the lens 120 and the optical fiber 132 are mounted on 3-dimensional motion stages for accurate alignment. The optical output is 3-dB coupled and transmitted to the photodetector, which includes photodetector 134 and digital oscilloscope 136. The photodetector has a broad electronic bandwidth over 75 MHz. The hydrophone operation is similar with that reported elsewhere, but the fiber hydrophone 132 here has a significantly smaller active sensing diameter (6-μm) which is suitable for measurement of the highly localized, high-frequency pressure field. Because of the finite aperture of the fiber, diffractive effects typically play a role in the frequency response, and a deconvolution of the waveform is required for such a probe. However, given that the lateral dimension of the LGFU focal spot is smaller than the fiber diameter, the diffractive effects are minimized. Then, the interaction of the incoming waves with the probe can be considered a pure reflection from an acoustically rigid surface for focal measurements. The probe sensitivity is considered constant (i.e., doubled) over the bandwidth over greater than 15 MHz. By substitution comparison with a calibrated reference hydrophone, a sensitivity of 4.5 mV/MPa at 3.5 MHz frequency is obtained. As this value is the result of about a 1.5 fold enhancement due to the low-frequency diffraction effect, it is determined 6 mV/MPa as a final sensitivity of the current fiber-optic hydrophone. Both dc and ac signals are monitored by using a digital oscilloscope (WAVESURFER™ 432, LeCroy, Chestnut Ridge, N.Y.). The waveforms in FIG. 4(*a*) are the result of averaging 20 signal traces in time-domain. For the passive detection measurement of the acoustic cavitation, a separate piezoelectric transducer is used with a center frequency of 15 MHz (Model V319, Panametrics, Waltham, Mass.). The transducer output is directly recorded by using the digital oscilloscope.

In order to capture the transient growth of cavitation, a high-speed camera (V210, Vision Research, Wayne, N.J., USA) is used. It is integrated into an inverted optical microscope. The experimental schematic is not shown here. For a polymer fragmentation experiment, the ultrasonic focus and the microscope view are fixed while the polymer film is moved on the microscope stage. For a cell experiment, the cultured cell substrates are moved to a petri-dish including the culture media on the microscope stage aligned with the LGFU waves generated in accordance with the present teachings. The bright-field and the fluorescence images of the cells are obtained in real time under the LGFU exposure.

A cell culture uses SKOV3 human ovarian cancer cells initially seeded on glass slides spin-coated with poly(methyl methacrylate) (PMMA) (950K PMMA A4 4% solid contents) (Microchem, Newton, Mass.). Then, the cells are cultured in a Roswell Park Memorial Institute (RPMI) medium with 10% fetal bovine serum and 1% penicillin/streptomycin in a humidified incubator (5% $CO_2$, 37° C.). Trypsin/Ethylenediaminetetraacetic acid (EDTA) is used to re-suspend the cells in solution. These cells are diluted to $10^6$ cells/mL and finally plated on the glass substrates spin-coated with the PMMA-based copolymer at 2000 r.p.m. for 30 seconds (from the solution of 4% by weight in tetrahydrofuran). Before the cell inoculation, the copolymer film is dried for 6 hours at 100° C. to remove the solvent.

Two lenses are used for experimental demonstration, by way of non-limiting example. The first lens has 5.5-mm radius of curvature and 6-mm diameter (named as type I), and the second has 11.46-mm radius of curvature and 12-mm diameter (type II). The focal gain G of a spherical lens can be represented as a ratio of the pressure at the focus to that on the spherical surface where the source layer is located:

$$G = \frac{2\pi f}{c_0} r\left(1 - \sqrt{1 - \frac{1}{4f_N^2}}\right), \tag{2}$$

where f, $c_o$, r, and $f_N$ are the acoustic frequency, the ambient sound speed, the radius of curvature, and the f-number, which is defined as a ratio of the radius of curvature to the lens diameter. As both lenses have the low f-numbers, 0.92 (type I) and 0.96 (type II), their focal gains could be significantly enhanced as compared to the typical HIFU transducers only having $f_N$=about 2 to about 3. According to Equation (2), the gain G at $f_N$=0.92 can be about 5 to about 11 fold higher than those at $f_N$=about 2 to about 3. Considering the acoustic attenuation in water, effective focal gains $G_{eff}$ can be obtained by multiplying G with a frequency-dependent attenuation coefficient ($2.2\times10^{-3}$ dB/(cm×MHz$^2$)). $G_{eff}$ (type I) is estimated to be about 54 and $G_{eff}$ (type II) at about 100 at 15 MHz frequency at each focal distance.

As shown in FIG. 12, lens gain per frequency is shown for a typical piezoelectric transducer used with a conventional HIFU (where a focal distance is $z_f$=55 mm and f# is 2.5) as compared to an optoacoustic transmitters prepared according to certain embodiments of the present teachings (comprising a nano-composite having multi-walled carbon nanotubes and polydimethylsiloxane), which has a focal distance of $z_f$=5.5 mm and f# of 0.92. As can be seen, the optoacoustic lens prepared in accordance with the present disclosure has a high geometrical gain (and a low f-number). It is particularly suitable for high frequency focusing, unlike the comparative HIFU lens. As can be seen, the LGFU generated from the optoacoustic lens prepared in accordance with the present disclosure has high gain at high frequency and experiences small acoustic attenuation due to a short focal distance.

Using the type I optoacoustic lens, strong shock waves can be observed at the lens focus measured using a single-mode fiber-optic hydrophone (FIGS. 1(*c*) and 7). Experimental waveforms of the LGFU are shown in FIG. 3(*a*). In principle, optoacoustic pressure waveforms should be close to the time-derivative of the original laser pulse (i.e., Gaussian) due to linear wave propagation in a far-field regime. However, the measured waveform is highly asymmetric near the focal point (assuming a radius-of-curvature of lens approximately equal to focal length, i.e., $z_f$=5.5 mm). The asymmetric distortion is caused by nonlinear propagation of the finite-amplitude pulse, which leads to the development of pronounced shock front in the positive phase and longer trailing in the negative phase, similar to that observed in typical shockwave lithotripsy. Confirmation that the distortion only develops within the focal zone as a symmetric waveform is clearly observed in the pre-focal zone at $z=z_f-0.3$=5.2 mm. The peak positive pressure of the focal waveform of FIG. 3(*a*) corresponds to about 22 MPa and the negative is about 10 MPa, both of which are determined after excluding the bandwidth effect of the fiber (the detail of hydrophone sensitivity is described previously above). These are obtained for the laser energy of about 12 mJ/pulse (about 33 mJ/cm$^2$/pulse). A spatial-peak pulse-average (SPPA) intensity of the focal waveform is 46 mW/cm$^2$. Note that the maximum-available laser energy, which does not cause transmitter damage, is 7-fold higher.

Next, pressure amplitudes are investigated by increasing the excitation laser energy. Focal waveforms are investigated from the type I lens, and then determined the peak positive and peak negative pressure. As shown in FIG. 3(*b*), the positive peak values are saturated to about 340 mV over the high laser energy level. The saturation can be attributed to the measurement reaching the bandwidth limit of the hydrophone. As a result, the highest frequency components of the shock wave cannot be correctly detected. The detector amplitude of 340 mV corresponds to an acoustic pressure of about 57 MPa. For the negative amplitudes, the peak values could not be accurately determined at the high laser energy level. This is due to involvement of acoustic cavitation on the fiber surface, which distorts the negative waveforms. In FIG. 3(*b*), the measurable negative peak values reach about 13.3 MPa at the laser energy of 14 mJ/pulse. However, it is estimated that higher than 25 MPa would be reached in the negative phase by an extrapolation over the high laser energies.

FIG. 3(*c*) shows the corresponding frequency spectra of the LGFU. These experimental spectra include frequency bandwidth effects of the detector. Due to the finite diameter of the optical fiber (125 μm), its sensitivity has a primary peak around 12 MHz and higher-order peaks at 36 and 60 MHz. These are confirmed for the frequency spectrum of the symmetric waveform at the pre-focal zone (z=5.2 mm). In contrast, the spectrum at the focal zone (z=5.5 mm) shows significant enhancement over the high-frequency amplitudes (greater than 15 MHz), which manifests in the time domain as the distorted waveform with steep shock front. This also moved the experimental center frequency $f_C$ to about 15 MHz. Due to the strong nonlinear distortion, the higher-order spectral peaks are also observed around $2f_C$, $3f_C$, and $4f_C$.

The high-frequency characteristics of the optoacoustic focusing are further manifested spatially as a tightly focused beam. In FIGS. 3(*d*) and 3(*e*), the focal profiles of the type I lens are shown at the lateral plane and along the axial direction, respectively. Tight focal widths of about 75 μm are achieved in the lateral dimension and 400 μm in the axial direction, which are determined by 6-dB positive amplitudes. For the type II lens with two-fold longer focal length but a similar f-number, the lateral and axial widths are broadened to 100 μm and 650 μm because of acoustic attenuation of the high-frequency components over the long propagation distance.

LGFU-induced acoustic cavitation is explored in the context of FIGS. 4(*a*)-(*b*). As shown in FIG. 3(*b*), a measurable negative maximum is given as about 13.3 MPa (type I lens) before the cavitation inception. This corresponds to a cavitation threshold on the fiber surface. In the type II lens, the measurable value is also limited by the cavitation. The inset of FIG. 4(*a*) shows that the micro-bubbles formed on the fiber surface are visualized by the high-speed camera recording. Under a single LGFU pulse, a few bubbles are observed depending on the incident pressure amplitude. The bubbles exist transiently over a few microseconds (μs) to tens of μs. The lifetime is quantitatively characterized by using an additional detector (1.5-inch focal length and 15-MHz center frequency) which is aligned to have the same focus with the optoacoustic lens (type II). The transducer first receives direct acoustic reflection of the LGFU from the tip of the fiber hydrophone (e.g., 132 shown in FIG. 1(*c*)). After temporal delay, it is followed by short transient signals, which are radiated from the bubble collapse. Here, the temporal delay is defined as the lifetime of the micro-bubbles. An example of bubble collapse signal is shown in FIG. 4(*a*). The lifetime is shorter than 15 μs at the laser energy lower than 40 mJ/pulse. At the cavitation threshold (laser energy is equal to about 10 to about 11 mJ/pulse), only single-bubble collapse is monitored. The detection rate of the bubble collapse is less than 50% for each laser pulse. Just above the cavitation threshold, the rate is increased to almost 100% (i.e., a single bubble forms per a single laser pulse). This is marked as a triangle at 11 mJ/pulse in FIG. 4(*b*). Then, the number of bubbles increased with the laser energy. The threshold for two bubbles is about 14 mJ/pulse, and for three bubbles about 18 mJ/pulse. Thus, by this approach, single bubbles can be generated in a controlled and predicted manner.

In this example, reproducible generation of a single micro-bubble at a solid boundary using a short pressure pulse (e.g., less than or equal to about 100 ns) with a high negative amplitude (e.g., greater than or equal to about 10 MPa). In this experiment, laser-flash shadowgraphy is used to visualize the strong pressure impulse induced densely nucleated micro-bubbles (several μm) within an acoustic focal zone (less than or equal to about 100 μm). This example helps with understanding the process of bubble nucleation by a nanosecond pressure pulse for various potential applications of the high-frequency light-generated focused ultrasound (LGFU).

Acoustic bubbles have been extensively used in various applications, ranging from ultrasonic cleaning to sonochemistry, because radial collapse of the bubble or liquid jet due to symmetry break can greatly increase local temperature (about 5000 K) and pressure. Single bubble dynamics in a pressure field has been theoretically studied for several decades, although multiple bubbles are usually involved in most practical applications. Experimental understanding of single bubble dynamics is commonly based on the behavior of laser-induced thermal bubbles whose nucleation process is fundamentally different from that of acoustic bubbles. A single acoustic bubble tends to form only in controlled laboratory conditions (e.g., for single bubble sonoluminescence). Alternatively, acoustic bubbles are known to be generated by high-intensity focused ultrasound (HIFU), which enables the spatial localization of cavitation and thus its applications to targeted therapies such as histotripsy. However, the focused ultrasound typically produces a cloud of bubbles over a relatively large focal spot (several mm). In other conventional methods, while a single micro-bubble has been generated near a solid boundary, limiting an acoustic streaming, the bubbles nucleate only under multiple pressure pulses (tens of μs).

In this experiment, it is shown that bubbles coalesce into a single large bubble. With laser-flash photography, a defined bubble edge is shown and a stable signal measured by a fiber-optic hydrophone. This unique merging and single bubble formation is attributed to the fact that seed bubbles grow to many times their initial size and have a high density of active nucleation sites. By using the Rayleigh-Plesset equation, an isolated single bubble under the pressure impulse is calculated to rapidly grow to at least hundreds times an initial size. Moreover, the estimated density of active nucleation sites is approximately $6\times10^2$ within the focal area. Upon adding artificial nucleation sites, the bubble nucleation zone at the micropatterned surface becomes wider, resulting in a larger single bubble.

Cavitation dynamics of a single micro-bubble under a sub-microsecond pressure pulse can be considered with the simplest theoretical treatment. However, it is experimentally challenging to simultaneously achieve a short pulse duration (less than or equal to about 100 ns) and a high negative pressure (greater than or equal to about 20 MPa) to create bubbles. In general, a strong pressure pulse (i.e., compressive wave) with tens of MHz frequency can be induced by a short laser pulse with a temporal width of greater than or equal to about 5 to less than or equal to about 10 ns. When a short laser beam is delivered by an optical fiber in contact with an absorbing liquid, a thermoelastic wave is generated by the localized heating of the liquid on the fiber tip (e.g., liquid-solid interface). A strong tensile stress and subsequent cavitation bubbles are induced by acoustic diffraction of the thermoelastic wave in an acoustic near field. On the other hand, in a case where a short laser pulse is focused on an absorbing liquid surface (e.g., a free surface), the generated acoustic pressure pulse includes the compressional phase followed by the rarefactional one that results from the sign reversal of the reflection wave at the free surface. Similarly, a tensile stress wave is produced when a strong compressive wave due to a laser (direct focusing)-induced plasma expansion is reflected at the free surface (air-water interface). The resulting tensile stress is reported to be sufficiently high for homogenous bubble nucleation. However, the cavitation generated by laser-induced tensile stress occurs in close proximity to the laser absorption zones where thermal bubbles are created. These processes in a near field increase the complexity of understanding the related cavitation phenomena.

Unlike the acoustic near-field processes, the light-generated focused ultrasound (LGFU) technique in accordance with the present disclosure (e.g., that uses a carbon-nanotube (CNT)-polymer composite lens for highly efficient optoacoustic conversion) relies on a strong acoustic pressure pulse at the focus for highly localized cavitation. The compressive wave inherently excited by the acoustic lens evolves into a bipolar wave (less than or equal to about 100 ns) at the focus in a far field. The high frequency nature enables focusing of the LGFU pulse on an acoustic spot (less than or equal to about 100 μm) together with a high negative amplitude (greater than or equal to about 10 MPa). This localized acoustic pressure is found to generate cavitation bubbles at a solid boundary in a reproducible way.

However, bubbles may either nucleate over the entire focal zone or a bubble may nucleate at a preferential location within the acoustic focal area (i.e., heterogeneous nucleation). In the former case, the application of cavitation is more controllable because it is regulated by an acoustic focal spot. Here, bubble dynamics induced by a LGFU pulse are characterized using a laser-flash shadowgraph technique complimented by acoustic signal measurement through a fiber-optic hydrophone. Bubbles nucleated densely at the glass surface upon a high negative pressure and a primary shock wave is produced during the bubble nucleation process. Due to a high density of active nucleation sites and explosive bubble growth, the densely spaced bubbles subsequently merge into a single large bubble that collapses violently under an ambient pressure. To understand the process, a bubble growth rate and a density of activated nucleation sites are estimated using Rayleigh-Plesset equation and shadowgraph images. The single bubble generation is also investigated in a glass surface patterned with a micro-hole array that works as artificial nucleation sites.

As shown in FIGS. 13(*a*)-13(*c*), in the experiment, micro-bubbles are generated in deionized water by a single LGFU pulse that has a short pulse duration (less than or equal to about 100 ns), high frequency (having a center at 15 MHz), and high negative pressure (greater than or equal to about 10 MPa) at the focal zone. The ultrasound is produced by means of optoacoustic effect using carbon nanotube (CNT)-polymer composite transmitters according to certain variations of the present teachings.

A concave lens is coated by a nano-composite layer (see detailed view in FIG. 13(*b*)) is irradiated by a pulsed Nd:YAG laser beam (Continuum, Surelite I-20, λ=532 nm, pulse width=6 ns) for optoacoustic excitation. This structure is an optoacoustic lens, where the CNTs serve as efficient light absorber and the heat generated from the absorbed energy can be transferred rapidly to the PDMS in the composite, generating high amplitude ultrasound pulse due to the high thermal expansion coefficient of the PDMS material. The light-generated ultrasound wave is focused from the optoacoustic lens (focal length of about 5.5 mm) on either a water-glass interface or an air-water interface, leading to bubble nucleation.

In order to investigate the bubble dynamics, LGFU-induced shock waves and bubbles are visualized by the laser-flash shadowgraph technique. This imaging technique is a pump-probe method that allows a probe laser pulse ($N_2$-pumped dye laser, FWHM=1 ns) to obtain images at a different temporal moment specified by the time delay between the pump (Nd:YAG laser) and the probe pulses through the delay generator (Stanford Research Systems, DG535). In this technique, time-resolved images of the wave propagation and bubble dynamics can be captured on a nanosecond time scale due to the short exposure time of the probe beam (1 ns). A broadband fiber-optic hydrophone (bandwidth up to 75 MHz) is employed to measure the acoustic signal of LGFU and locate the acoustic focus for bubble nucleation. The tip of the hydrophone functioned as the water-solid interface for bubble formation, and detected simultaneously the bubble-induced refractive index changes (FIG. 13(*b*)).

For top-view imaging, acoustic pulses are focused on a flat cover glass (thickness: about 130-170 μm; commercially available from VWR Scientific, Inc.) with a surface roughness of about 1-2 nm). The glass substrate is cleaned in an ultrasonic bath using acetone and isopropyl alcohol (IPA), and then dried using nitrogen gas. The glass substrate is tilted slightly with respect to the vertical axis (e.g., the left half is closer to the optoacoustic transmitter) to accommodate both an acoustic lens and a CCD camera in a same side for top-view imaging. In order to study the bubble nucleation at an artificial nucleation site, a micro-hole array (8 μm in diameter, 20 μm in spacing) is fabricated on the cover glass using photolithography followed by a deep reactive ion etching process. The acoustic focal spot (about 100 μm in diameter) holds approximately twenty micro-holes.

When an acoustic wave generated by the optical excitation in the CNT-composite layer is focused on the glass surface, cavitation bubbles start to be generated on the surface at a laser energy of 14 mJ/pulse ($E_{th}$: the threshold energy for bubble nucleation), which results in a negative pressure amplitude of about 10 MPa at the acoustic focus. In the absence of the solid surface, no cavitation bubbles are observed at the focus. This is because the cavitation threshold for water is generally higher than a maximum negative pressure achievable by the acoustic lens, although the threshold pressure can be decreased significantly by pre-existing nucleation sites such as contaminants (e.g., particles) and gas bubbles.

The visualization of a single bubble generation process is conducted for a laser energy well above the threshold energy ($E=3.7E_{th}$) as the obtained images are shown in FIGS. 14(*a*)-14(*c*). This laser energy is high enough to form sufficiently large bubbles that can be readily imaged. Before bubble nucleation starts, a LGFU wave front (I) is captured propagating at a speed of about 1500 m/s (from the time-resolved images). The reflected wave (R) and the primary shockwave (S1) expanding hemispherically from the cavitation zone are also observed at 100 ns. At a delay time of 1 μs, a thin bubble layer is formed at the cavitation zone.

The early stage of bubble growth is carefully examined as shown in FIG. 14(*b*) for top view images. Closely spaced small bubbles started to appear on the edge of the circular zone (dashed circle) at the glass surface shortly after the focused ultrasound wave had arrived at the surface as shown in the image (at 80 ns). The glass substrate is tilted with respect to the vertical axis; left half of the glass is closer to the optoacoustic transmitter leading to early bubble nucleation. Although some seed bubbles at the edge of the circular area are clearly seen, the dense bubbles formed the thin layer covering the focal area on the glass surface. The area covered by the densely nucleated bubbles is approximately 100 μm in diameter. The cavitation area can be enlarged by increasing peak amplitude of the pressure profile and thus the high pressure region above the cavitation threshold. The individual seed bubbles are rarely identified after 1 μs, because they grew and overlapped completely. Noticeably, the seed bubbles are found to coalesce into a single large bubble showing a defined bubble edge in the images, which stands in sharp contrast to conventional acoustic focusing methods, by which bubble clouds at the focal region form without noticeable bubble merging. Unlike a hemispherical bubble growth, the merged bubble layer continues to grow upward on the surface and reached a maximum radius of about 110 μm (at 11 μs). The shrinkage of the merged bubble takes place in two stages. While the height of the bubble remains the same, the side walls of the bubble approach each other for a relatively long time (about 12 μs to about 20 μs) evolving into a "mushroom" shape. The bubble collapses rapidly at about 22 μs through the radial shrinkage, which is followed by a cavitation shockwave (S2), but a jet flow is not clearly observed. Interestingly, the cavitation shockwave is generated at a distance of about 40 μm from the interface due to the asymmetric bubble collapse, which propagates and is reflected as shown in FIG. 14(*c*). The overall behavior of the merged bubble cannot be categorized into that of the laser-induced bubbles near a solid boundary because the acoustic bubble is evolved from the thin bubble layer at the interface. The bubble dynamics is very similar to the one induced by laser excitation of a thin absorbing liquid layer in contact of a glass substrate.

Ultrasound-induced bubbles on the tip of the fiber-optic hydrophone are characterized simultaneously using the back-illumination shadowgraphy technique and signals obtained by the hydrophone for different laser energies (about 11 to about 51 mJ/pulse), The hydrophone signals recorded for acoustic wave and bubble nucleation are shown in FIG. 15(*a*) for different laser energies applied (e.g., 11, 14, 19, 22 mJ/pulse). The signals are substantially different whether bubbles are present or not. At the laser energy below the cavitation threshold ($E<E_{th}$), a single LGFU pulse, a characteristic bipolar shape (less than about 100 ns pulse duration), is detected by the hydrophone as shown in the schematic of FIG. 15(*d*). The waveform features a leading positive compression phase followed by a trailing negative tensile phase in an acoustic far field. At the laser energy above the threshold ($E>E_{th}$), cavitation bubbles at the hydrophone tip greatly increase the negative phase of the signals. However, these enlarged negative values do not indicate tensile pressure because they are caused by a large refractive index contrast due to the low refractive index of vapor bubble covering the detection area of the fiber-optic hydrophone (6 μm in core diameter). On the other hand, the positive values represent compressive pressure amplitudes regardless of the presence of cavitation bubbles. This rapid increase in the negative amplitudes again indicates that the bubble starts to expand rapidly within the acoustic pulse duration (<100 ns). After the negative amplitude reaches its maximum value, it gradually decreases and reaches a plateau. Finally, the signal recovers to a positive value after the bubbles collapse.

The time-resolved images of bubble nucleation at the tip are exhibited in FIG. 15(*b*) for the laser energy of 22 mJ/pulse ($E=1.6E_{th}$). The temporal duration of the signal agrees with the bubble lifetime visually confirmed in FIG. 15(*b*) (22 mJ/pulse). The negative signal traces in the presence of cavitation bubbles lasted longer at a higher laser energy, which indicates the prolonged bubble lifetime. By correlating the shadowgraphic images with the hydrophone signal (indicated as (1) to (4) in FIG. 15(*c*)), it is identified that bubble growth signals shows a highly oscillatory behavior due to the merging of individual micro-bubbles. In contrast, the hydrophone response at a longer time becomes relatively stable, which is attributed to the formation of a single bubble completely covering the sensing zone on the fiber surface. The signals of secondary shockwave that are higher than positive amplitudes of the LGFU pulses are also shown upon the bubble collapse, and these are marked by the arrow and "cavitation".

The bubble merging may be attributed to the fact that the high negative pressure of LGFU can activate a large number of nucleation sites at the glass surface. In the theory based on the crevice model, the bubble nucleation threshold increases with reducing cavity size at the solid surface. Thus, a high negative pressure can additionally activate smaller cavities that are distributed with a higher areal number density at the solid surfaces. The closely packed bubbles can grow to many times their initial size. Therefore, in order to minimize the total surface area of the overlapped bubbles, the growing seed bubbles are likely to merge into a single large bubble. It is noted that the LGFU-induced bubble nucleation at the glass surface is very reproducible as no significant deactivation of nuclei is observed after the nucleation events.

The number of the bubble nuclei (n) is approximately estimated by dividing the nucleation area ($A_{zone}$) covered with the seed bubbles by the cross-sectional area of each bubble ($A_{seed}$). The seed bubbles are apparently formed within the duration of the acoustic pulse. Thus, initial stages of small bubbles growth are dominated by inertia due to the high rarefaction stress and its short duration. The radius of isolated seed bubbles (R) is calculated by using the Rayleigh-Plesset equation assuming spherical symmetry and an adiabatic gas law $$R\ddot{R} + \frac{3}{2}\dot{R}^2 = \frac{1}{\rho}\left\{\left(p_0 + \frac{2\sigma}{R_0} - p_v\right)\left(\frac{R_0}{R}\right)^{3\gamma} + p_v - \frac{2\sigma}{R} - \frac{4\eta\dot{R}}{R} - p_o - P(t)\right\}, \quad (3)$$

where R is bubble radius, $R_0$ is initial bubble radius, ρ is density ($\rho=1{,}000\ kg\cdot m^{-3}$), σ is coefficient of surface tension ($\sigma=0.073\ N\cdot m^{-1}$), η is water viscosity ($\eta=1.0\times10^{-3}$ Pa·s), $p_v$ is water vapor pressure, $p_0$ is static ambient pressure and P(t) is acoustic pressure, respectively. In an LGFU-induced cavitation process, because the acoustic pulse duration (less than about 100 ns) is two orders of magnitude shorter than the bubble lifetime, after bubbles nucleation the rest of the bubble dynamics is driven by inertia under static ambient pressure (i.e., transient bubble). The symmetry time evolution of the seed bubble with an initial size of 100 nm is exhibited as shown in FIG. 16(*a*) for three different negative amplitudes. The bubble grows to many times initial radius ($R_o$) in that the ratio of maximum radius ($R_{max}$) to the initial radius is large ($R_{max}/R_0>100$). Moreover, FIG. 16(*b*) indicates that the bubble expands to many times seed bubble size ($R_{seed}$) that is clearly seen in shadowgraph images at a delay time of 80 ns ($R_{max}/R_{seed}>3$). Bubble-bubble interaction decreases the maximum radius and leads to extended bubble lifetime. For a negative peak pressure (about 15 MPa), the bubble radius is approximately 2 μm (defined as a $R_{seed}$) at a delay time of 80 ns. Therefore, the activated cavities (n) on the glass surface are at least $6\times10^2$ [$n=(R_{zone}/R_{seed})^2$ where $R_{zone}$ is the cavitation zone radius, 50 μm], which correspond to 0.08 $\mu m^{-2}$, areal density of the activated sites ($n_d=n/A_{zone}$ where $A_{zone}$ is the cavitation zone area). The actual number of the activated nuclei can be much larger than the estimated one due to bubble departures and cavity cancellation that occurs during multiple-bubble interactions. Again, such a high density of activated nuclei and explosive bubble growth can increase the possibility of bubble interaction, leading to bubbles coalescence uniquely observed in this experiment.

Interestingly, void formation or the abrupt expansion of existing cavities under a strong tensile stress condition produces the primary compressive wave, which is analogous to shock wave emission due to plasma expansion during laser (direct focusing)-induced bubble generation. The speed of bubble growth is calculated to be about 100 m/s as illustrated in FIG. 16(*b*). It is also observed that the velocity of bubble layer (bubble I) in FIG. 14(*a*) is around 30 m/s. This fast expansion leads to a primary shock wave as the detailed images are shown in FIG. 17. Two wave fronts are observed right after the focused acoustic wave reaches at the interface (at 100 ns). The outmost one is the LGFU wave front reflected by the interface. The other is the primary shockwave emitted by the formation of a thin bubble layer at the interface. LGFU-induced bubble nucleation accompanied by the shock wave can deposit a strong momentum in an adjacent substrate, which could be a possible mechanism for localized material removal. The time delay between the two wave fronts is estimated to be about 40 ns, which corresponds to the temporal duration of the LGFU's negative phase. This confirms that LGFU-induced cavitation process is evidently based on bubble nucleation under a strong tensile pressure.

Merged bubble radii with respect to time are plotted in FIG. 18(*a*) for different laser energies (E=14, 19, 22, 39, 51 mJ/pulse). The maximum bubble radius and lifetime increases with laser energy. Comparisons between characteristic times representing single bubble dynamics indicate that the bubble shrinkages proceeded faster than their expansions as shown in FIG. 18(*b*) for bubble collapse ($t_c$), Rayleigh collapse ($t_R$), and bubble lifetime ($t_l$). Note that collapse times are shorter than Rayleigh collapse time ($t_R$) that is defined to describe the symmetric motion of a spherical bubble in an infinite liquid. This discrepancy could result from the assumptions that bubbles remain hemispherical shape for determining bubble sizes; a deviation from a hemi-spherical shape increases especially for an early stage of bubble growths and a final stage of bubble collapses. Moreover, the solid boundary might affect the bubble dynamics limiting water flow due to liquid-solid friction.

It is well known that bubble nucleation is strongly affected by surface properties, such as the number of nucleation sites. To investigate the effect of micron nucleation sites at the solid surface on single bubble generation, the acoustic pulses are focused on the glass surface patterned with a micro-hole array that can work as artificial nucleation sites. First, at a low laser energy ($E<E_{th}$; below the cavitation threshold of the flat glass), bubbles are observed to nucleate preferentially at the micro-structured surface, as shown in FIG. 19(*a*) (quadrant or frame 3), whereas no cavitation bubbles are observed on the flat glass (quadrant or frame 1). In such a low pressure, the bubble nucleation distinctly exhibits a heterogeneous nature, e.g., individual bubbles nucleate only at the holes within the acoustic focal area. In contrast, above the cavitation threshold of the flat glass ($E>E_{th}$), the small bubbles nucleate within the entire focal area rather than nucleate only at the predetermined sites (micro-holes). The overall behavior is similar to that at the flat surface (quadrant or frame 2, 4) except that maximum bubble sizes are much larger as plotted in FIG. 19(*b*) for the flat glass and the patterned glass. Moreover, it can be seen that a bubble with larger maximum radius has longer bubble lifetime. As explained earlier, a bubble nucleation area can be widened by increasing a laser energy (e.g., negative pressure at the focus). Similarly, a reduction of cavitation threshold can expand the cavitation bubble zone. Therefore, the nucleation sites in the form of micro-holes can significantly decrease a cavitation threshold, leading to an enlarged cavitation zone compared to that at the flat glass. This result suggests that in a high negative pressure regime (greater than about 10 MPa) where submicron nucleation cavities could be dominantly activated, the overall dynamics of a single bubble is rather insensitive to a relatively large nucleation sites provided by the micro-holes.

As such, this experiment shows that a pulsed ultrasound wave (less than or equal to about 100-ns pulse duration) can generate single micro-bubbles at glass surfaces both with and without microstructures. The early stage of bubble nucleation is investigated in detail using a laser-flash shadowgraphy technique and a fiber-optic hydrophone. Densely nucleated micro-bubbles (a few μm) form and eventually coalesce into a single bubble at the glass interface due to a high density of active nucleation sites ($n>10^2$) and explosive bubble growth ($R_{max}/R_0>100$). This single bubble generation is reproducible and controllable. However, the process of the bubble formation exhibits unique features: primary shock wave emission due to explosive bubble growth, an asymmetry bubble collapse, cavitation shock wave emission at some distance from the interface. The primary shock waves are distinctly generated at the boundaries when LGFU-induced bubbles nucleate abruptly at the surfaces compressing the surrounding liquid. This strong pressure transient generation evidently indicates that a strong mechanical momentum can be deposited on a substrate at an early stage of bubble nucleation. Therefore, in the LGFU process, localized mechanical forces induced by either bubble collapse and bubble nucleation could be considered to be a mechanism for applications related to mechanically selective material removals. Micro-structured surfaces decrease cavitation thresholds, producing larger single bubbles compared to bubbles at the flat glass. The single bubble is formed in a controlled manner at the impedance mismatched boundaries in a subject to a strong nanosecond acoustic pulse, which allows an alternative way to investigate interactions between acoustic bubbles and boundaries for potential applications.

In certain aspects, the present teachings thus provide methods for generating a high-frequency and high-amplitude focused ultrasound, which may be highly controlled. The control can include selectively generating a single bubble or a preselected number of multiple bubbles. The method comprises directing laser energy at an optoacoustic lens comprising a composite layer defining a concave shape. The concave composite layer comprises a polymeric material and a plurality of light absorbing particles, such as those described previously above. The laser energy directed at the optoacoustic lens thus generates a high-frequency and high-amplitude focused ultrasound. As noted above, a desirably high frequency ultrasound is greater than or equal to about 10 MHz and a high amplitude ultrasound generates a pressure output of greater than or equal to about 10 MPa.

The focused ultrasound transmitters, designed by using the optoacoustic generation techniques of the present disclosure, provide various advantages including a tight focusing geometry (low f-number) and a high gain over high-frequency ranges. The output pressure can be further increased by several techniques. For example, in the excitation setup in the experiments described above, the laser beam is not spatially uniform over the lens dimension. While the laser beam energy is strongest at the center of lens, it decays to lower than 30% at an edge of the lens. This may cause uneven focusing and may also limit the available laser energy to a moment of sample damage at the center. This can be addressed by using a beam expander in laser alignment, which permits more laser energy to be used for pressure generation in a spatially uniform manner. Larger dimensional lenses can be considered to have higher geometrical gain at the expense of lowering the operation frequency. For the choice of polymer, other materials with smaller shrinkage rates are also suitable. The present disclosure contemplates modifying these variables to further provide better focusing performance.

In another experiment, laser light-generated focused ultrasound (LGFU) prepared in accordance with certain aspects of the present disclosure is used to create targeted mechanical disturbance on a few cells. The LGFU is transmitted through an optoacoustic lens that converts laser pulses into focused ultrasound. The tight focusing (less than about 100 μm) and high peak pressure of the LGFU produces cavitational disturbances at a localized spot with micro-jetting and secondary shock-waves arising from micro-bubble collapse. In this example, it is shown that LGFU can be used as a non-contact, non-ionizing, high-precision tool to selectively detach a single cell from its culture substrate. Furthermore, biomolecule delivery in a small population of cells targeted by LGFU at pressure amplitudes below and above the cavitation threshold is explored. Cavitational disruption is required for delivery of active ingredients, such as propidium iodide, a membrane-impermeable nucleic acid-binding dye, into cells.

As noted above, ultrasonic techniques can be used to modify or activate biochemical functions of cells and tissues in a non-invasive, localized, and temporally controlled manner. At the cellular level, most of these techniques rely on acoustic cavitation to create liquid micro-jets, shear stress, and shock-waves that disrupt cell membranes. This enhances uptake of membrane-impermeable molecules such as plasmid DNA and some drugs. These mechanical forces can also selectively remove cells from their culture substrates for cell harvesting and patterning.

For direct ultrasonic disruption, high-pressure amplitudes generated by focused transducers (e.g., shock-wave lithotripters and high-intensity focused ultrasound (HIFU) transducers) are required to produce shock effects and acoustic cavitation at a target location. However, as discussed above, the spatial accuracy of these conventional transducers approximates a focal zone of several millimeters or larger in diameter due to their low operation frequency (only a few MHz). These transducers have been used to analyze macroscale shear stress and cavitation-induced effects on large populations of cells; however, it is difficult to elucidate microscopic interactions between localized acoustic effects and individual cells.

However, preformed micro-bubbles can be used to localize mechanical forces on cells. These bubble agents can be prepared with bio-functional units that target them to cells. The bubbles can then be collapsed under focused ultrasound with moderate pressure amplitudes (1 MPa), leading to mechanical cell disruption that triggers various biochemical phenomena within the cells. Unfortunately, these techniques require additional methods for micro-bubble delivery that often involve preparation of microfluidic devices for in vitro studies or injection channels for in vivo delivery. Moreover, the efficiency of micro-bubble disruption depends on microbubble location (e.g., proximity to cells). Thus, it would be advantageous to develop more consistent and predictable approaches for targeting ultrasound to single cells.

Light-generated focused ultrasound (LGFU) in accordance with certain aspects of the present disclosure produces high-amplitude (greater than or equal to about 50 MPa), high-frequency (greater than or equal to about 15 MHz) acoustic pressure within a small focal spot (less than or equal to about 100 μm diameter). The optoacoustic lens converts a nano-second laser pulse into a focused acoustic pulse. Since this acoustic pulse has both high peak-positive and peak-negative amplitudes, it can generate shock effects as well as acoustic cavitation forming transient micro-bubbles. This technique has an order-of-magnitude higher accuracy than conventional high-pressure transducers and thus provides a tool with precise localization.

In this example, LGFU is used to generate microscale ultrasonic disruption, targeting a focal spot that can cover a single or a few cells. LGFU-induced forces are shown to be strong enough to detach a single cultured cell from its substrate without affecting neighboring cells. LGFU-targeted disruption for biomolecule delivery across cell membranes without causing detachment is also explored. Further, membrane responses to cavitational conditions by varying the LGFU amplitudes to achieve pressures below and above the cavitation threshold are explored, demonstrating that acoustic cavitation is required for biomolecule entry into cells.

For optoacoustic generation of the high-frequency focused ultrasound, a 6-ns pulsed laser beam with 532-nm wavelength and 20-Hz repetition rate (Surelite I-20, Continuum, Santa Clara, Calif.) is used to irradiate a carbon nanotube (CNT)-coated optoacoustic lens (12 mm in diameter and 11.46 mm in radius-of-curvature). The 6-dB focal width of the LGFU is 100 μm as characterized using a fiber optic hydrophone (bandwidth up to 75 MHz). The experimental setup for LGFU measurement is as described above in the context of FIGS. 1(*c*), 7, and 13(*a*)-13(*c*) (and as described in H. W. Baac, et al., Sci. Rep. 2, 989 (2012), incorporated herein by reference). Confirmation that transient microbubbles are formed at glass substrates by using time-domain signals at the detector and high-speed camera recordings.

For cell detachment and membrane disruption experiments, the LGFU setup is combined with an inverted microscope (not shown). Briefly, the ultrasonic focal plane is aligned with cell culture substrate on the microscope stage. Halogen and mercury lamps are used to illuminate the sample for bright-field and fluorescence imaging, respectively. Since the CNT-coated optoacoustic lens blocked some of the halogen illumination, the incidence direction of the halogen lamp is slanted. For easy focal alignment, the optoacoustic lens is attached to a fixed-length spacer to position the cell culture substrate.

A 4-inch petri-dish is used as a chamber filled with culture media. HeLa cells are cultured on plasma treated glass coverslips (No 1.5). The cells are maintained at 37° C. in DMEM with 10% fetal bovine serum and 1% antibiotic solution, in a humidified atmosphere containing 5% $CO_2$. Before experiments, the cultures are grown to 50-70% confluence. They are then transferred to the LGFU setup for cell detachment. For biomolecule delivery experiment, the medium is replaced with fresh medium containing 10 mL propidium iodide (PI). Here, PI is used as a model biomolecule, which is membrane-impermeable nucleic-acid binding dye. Once PI enters cells, it binds DNA and RNA, dramatically enhancing its fluorescence. As the LGFU is only a source of disturbance, the characteristic fluorescence from PI is used as an indicator of ultrasonic trans-membrane delivery.

LGFU is generated through the optoacoustic lens, leading to shockwaves and acoustic cavitation at the focal spot. FIG. 20(*a*) shows cavitational disturbance formed on a glass substrate. FIG. 20(*a*) shows the focal waveforms from pulsed laser irradiation at two different energies (E): a sub-threshold regime for cavitation ($E=0.6E_{th}$) and an over-threshold regime ($E=1.2E_{th}$). Here, Eth is set as a threshold laser energy per pulse to generate acoustic cavitation (10-11 mJ/pulse). A generation rate of cavitation ($\eta$), which is defined as number of times cavitation occurs per number of incident LGFU pulses, is approximately 50% at this threshold. The laser energy is measured at the location of the optoacoustic lens with ±10% error.

The inset in FIG. 20(*a*) shows an enlarged view of the waveforms. The inset compares two waveforms at the focal plane. A stiff shock-front is present in the positive phases for both waveforms. The asymmetric waveform at $E=0.6E_{th}$ is a typical shape of LGFU. A stiff shock-front occurs at the leading edges for both waveforms. This is due to nonlinear evolution of acoustic propagation. For LGFU with a laser energy of $E=1.2E_{th}$, however, this waveform is severely distorted in the negative phase because cavitation occurs directly on the detector surface. The detector range is limited to ±0.4 V-peak in this setup. In this example, the temporal trace of the over-threshold waveform reveals that the cavitational disturbance is prolonged by 1.7 μs (e.g., 7.75-9.45 μs) on the detector surface. This corresponds to the approximate lifetime of the bubble, which could be increased up to tens of μs using higher laser energies.

Acoustic cavitation is observed using a high-speed camera (FIG. 20(*b*)). FIG. 20(*b*) shows an image of a transient micro-bubble (scale bar=100 μm). The micro-bubble is shown under high brightness and low contrast. FIG. 20(*c*) shows the same image as in FIG. 20(*b*), but with enhanced contrast. Micro-jetting is indicated by black arrows. The white-dotted line indicates the glass/water boundary.

A 1-mm thick glass plate is used for cavitation, removing the fiber-optic hydrophone from the focal zone. This confirms cavitation on planar substrates (as used with cells), excluding acoustic diffraction due to the finite dimensions of the fiber hydrophone (diameter=125 μm). FIG. 20(*b*) shows a side view of a micro-bubble at the glass/water boundary generated using E=1.4-1.5 $E_{th}$. The bubble in this increased laser energy has a longer lifetime of >10 μs. Such longer lifetime allows the camera to have a sufficient exposure time to capture the micro-bubble image clearly.

As noted above, the same image is also shown in FIG. 20(*c*), but with an enhanced contrast. Interestingly, micro-jetting is clearly observed at the top of the bubble and at the interface with the glass (black arrows). The liquid jet from the top creates a stream towards the center of the bubble. The side jets generate shear stress along the glass surface. Bubble collapse generates secondary shock waves in addition to these forces. These on-demand cavitational disturbances deliver strong mechanical forces on microscopic targets such as cells.

Biomolecule delivery by LGFU at the near-threshold regime for cavitation (E=0.9 $E_{th}$, 200 pulses) is explored in FIGS. 22(*a*)-22(*c*), the sub-threshold (E=0.7-0.8 $E_{th}$, 12 000 pulses) in 22(*d*)-22(*e*), and the over-threshold (E=1.2 $E_{th}$, 1200 pulses) in 22(*f*)-22(*h*) (bright-field images in the above row and fluorescence in the bottom). White circles indicate the regions treated by LGFU (diameter=100 μm, scale bar=100 μm).

LGFU is next used to detach cells with single-cell resolution (FIGS. 21(*a*)-21(*c*)). Using LGFU with a laser energy of E=1.4-1.5 $E_{th}$, individual cells can be removed without affecting neighboring cells. In this condition, η is equal to approximately 100%. FIGS. 22(*a*) and 22(*b*) show cells before and after LGFU at the near-threshold. FIG. 21(*a*) shows the target cell within the white-dotted region before LGFU. FIG. 21(*b*) shows an image taken immediately after cell detachment. The floating cell is shown, moving leftward.

Two images of FIG. 22(*b*) are merged in FIG. 22(*c*). PI entry is observed but without cell morphology change. FIG. 21(*c*) shows the cell is completely removed, floating out of view. Single cells can thus be detached using fewer than 20 pulses, each of which are given in a 50 ms interval (i.e., total exposure time<1 second). Clusters containing several cells can also be removed using hundreds of pulses, depending on their shape and geometry. However, in the subthreshold cavitation regime ($E<E_{th}$), cell detachment did not occur. This suggests that acoustic cavitation is required for cell detachment.

This example further explores biomolecule delivery to cells. In order to avoid cell detachment, the laser energy is reduced to a near-threshold regime ($E=0.9E_{th}$). Although this regime is below the nominal threshold $E_{th}$, acoustic cavitation with a few % of generation rate still occurs. Moreover, the bubbles have much shorter lifetimes (about 1 μs) than those used for cell detachment (tens of μs). Therefore, LGFU at this near-threshold condition produces gentle, intermittent disturbances on cells.

Membrane disruption is confirmed using PI as a marker of trans-membrane delivery as mentioned above. The cells are placed in the PI-enriched medium. FIGS. 22(*a*) and 22(*b*) show bright-field and fluorescence images taken before LGFU. No fluorescence is observed in FIG. 22(*a*), indicating that PI entry is blocked by the cell membrane. In FIG. 22(*b*), the cells are exposed to LGFU (~200 pulses or 10-second exposure). The bottom image of FIG. 22(*b*) clearly shows PI fluorescence in the targeted cells. FIG. 22(*c*) shows the merged image of both bright-field and fluorescence of FIG. 22(*b*), showing that cell morphology barely changed at the disrupted region. This suggests that LGFU can be used for precise disruption of cells (about 60 μm diameter) without cell removal.

Cavitational dependence of membrane disruption is further investigated by comparing two different regimes: sub-threshold and over-threshold to induce cavitation. FIGS. 22(*d*) and 22(*e*) show cell images before and after LGFU exposure at the sub-threshold condition (E=0.7-0.8 $E_{th}$). A new spot is chosen in FIG. 22(*d*). No fluorescence change is observed in FIG. 22(*e*) after LGFU exposure at the sub-threshold regime, even after 10-min exposure (about 12,000 pulses), as shown in the bottom row of FIG. 22(*e*). These results indicate that membrane disruption requires cavitational disturbance.

Finally, another spot is chosen in FIG. 22(*f*). With LGFU above, the cavitation threshold in FIG. 22(*g*), some cells are detached at the center, but PI entry is still observed in the periphery. FIGS. 22(*f*) and 22(*g*) show cells at another location before and after the LGFU exposure with E=1.2 $E_{th}$ (1,200 pulses for 1 min). Although some cell detachment at the center of the focal spot is observed, the cells in the peripheral focal region remain intact for biomolecule delivery, resulting in PI labeling as shown in the bottom row of FIG. 22(*g*). After obtaining the images shown in FIG. 22(*g*), the LGFU is turned off for 2 min to obtain post-treatment images shown in FIG. 22(*h*). FIG. 22(*h*) shows the same region 2 min after LGFU exposure. Brighter fluorescence in FIG. 22(*h*) indicates that PI continued to enter the cells, diffusing within the cell and binding to nucleic acids in the cell nucleus. The disruption zone in FIG. 22(*g*) is 100 μm, which is wider than the near-threshold condition (60 μm) in FIG. 22(*b*).

Using LGFU, acoustic cavitation at targeted positions of less than or equal to about 100 μm in diameter is obtained. Such tight focal spots require high-frequency ultrasound (f>15 MHz) and therefore stronger tensile pressure (P) to induce cavitation, than those at the low-frequency regime ($P \propto f^{1/2}$). However, in the configuration of the embodiments used here, the pressure requirement is significantly relieved due to the existence of solid substrate. As LGFU is strongly reflected from the glass substrate, the tensile pressure is substantially increased within a shallow depth from the glass/water interface (<100 μm). Moreover, it plays a role as a supporting boundary for tiny seed bubbles before they grow and merge into a large bubble. Therefore, the cavitation threshold pressure is greatly reduced on the glass substrate as compared to cases without supporting boundaries. It is also confirmed in this example that the cavitation can be formed on soft substrates, such as tissues and elastomeric polymers, but with higher LGFU amplitudes. The cavitation threshold can be further reduced using topographic structures. The topographic approach would have an additional advantage in terms of regulating micro-scale shear forces in a designed manner.

In certain aspects of the present disclosure, the cavitational disturbance is controlled by the incident laser energy E that dictates the LGFU amplitude. In the over-threshold regime, $E>E_{th}$, the disruption is strong enough to cause cell detachment. By decreasing the LGFU to the near-threshold level, intermittent cavitation can be generated with a shorter lifetime. This moderate cavitation condition is successfully used to disrupt cell membranes without causing cell detachment or other morphological changes.

Furthermore, in accordance with certain aspects of the present technology, biomolecule delivery using PI as a model cell-impermeable material is demonstrated. The LGFU technique is also promising for delivery of other agents, such as nano-particles, which can be useful for controlled drug release. Pulsed conventional HIFU systems have been used already with some success to enhance localized nano-particle delivery into tissues. For the biomolecule delivery, the pulsed approach is preferred to avoid irreversible thermal deformation of cells and tissues. A thermal relaxation time in tissues is estimated as 6 ms over 100 μm diameter. As the inventive technology can provide each pulse in 50 ms interval, heat deposition is negligible despite the tight focal dimension.

The present disclosure contemplates LGFU produced cavitational disruptions at a microscale regime (less than about 100 μm). Localized micro-jets surround the cavitation micro-bubbles, producing mechanical forces in addition to collapse-induced shock waves. These localized forces can be used to detach single cells. The LGFU is also used as a delivery system for cell-impermeable biomolecule delivery. Membrane opening is confirmed by intra-cellular PI signal, depending on cavitational conditions. The targeted molecular delivery in high precision just over a few cells is provided. Moreover, it is contemplated that the LGFU techniques in accordance with certain aspects of the present disclosure are useful for high-precision cell detachment for harvesting and patterning, as well as on-demand delivery of various molecular agents across biological membranes.

In certain other variations, the high-frequency and high-amplitude focused ultrasound has superior resolution and is particularly suitable for surgical techniques, such as ablation or lithotripsy, without limitation. In certain aspects, methods for lithotripsy or ablation employ high-frequency light-generated focused ultrasound (LGFU) according to the principles of the present teachings. Such a method comprises generating a high-frequency and high-amplitude focused ultrasound energy by directing laser energy at an optoacoustic lens comprising a composite layer defining a concave shape. The composite layer comprises a polymeric material and a plurality of light absorbing particles. The composite layer, optoacoustic lens, and laser source can be any of the embodiments described previously above. In certain variations, the focal spot has a lateral dimension of less than or equal to about 200 μm, optionally less than or equal to about 75 μm and an axial dimension of less than or equal to about 1,000 μm, optionally less than or equal to about 400 μm. The laser energy directed at the optoacoustic lens thus generates a high-frequency and high-amplitude focused ultrasound that can be directed at a target. The target may be in an organism, such as an animal like a mammal. As noted above, a desirably high frequency ultrasound is greater than or equal to about 10 MHz and a high amplitude ultrasound has a positive pressure output of greater than or equal to about 10 MPa, or any of the pressure outputs described above. The target may be selected from tissue within an organism, such as a cell, tissue or an organ within a mammal. By way of non-limiting example, organs may be selected from the group consisting of: kidney, gall bladder, bladder, urinary tracts, liver, heart, lungs, brain, vasculature, and combinations thereof. Thus, in certain aspects, the high-frequency and high-amplitude focused ultrasound energy is directed to a target within an organism. The target may be selected from the group consisting of: a cell, an organ, tissue, a tumor, vasculature, and an abnormal growth. In certain aspects, the target is an abnormal growth selected from the group consisting of: kidney stones, gallstones, urinary tract stones, and abnormal aggregations, such as crystals, mineralization, or undesirable solids. In certain variations, the target may be an abnormal growth, such as solid aggregations like kidney stones, gallstones, urinary tract crystals, and the like. In other aspects, a target may be tissue, such as a tumor or malignant cells. In certain variations, the ultrasound energy may be applied indirectly to the target (e.g., via lithotripsy to an organ or kidney stones or gallstones) or may be used in near proximity to the target to achieve surgical ablation.

Thus, such methods of the present disclosure may direct the high-frequency and high-amplitude focused ultrasound energy at a target, for example, within an organism, where the focal spot of the generated high-frequency and high-amplitude focused ultrasound energy has a lateral dimension of less than or equal to about 75 μm and an axial dimension of less than or equal to about 400 μm. Directing the high-frequency and high-amplitude focused ultrasound energy at the target can serve to detach, rupture, disintegrate, remove, comminute, and/or fragment the target.

For example, directing the high-frequency and high-amplitude focused ultrasound energy at a target can cause micro-scale fragmentation of solid materials. Strong impacts from the shock waves and the acoustic cavitation have been used for fragmentation of kidney stones and soft tissues. LGFU according to the present teachings is shown to capable of use as a non-contact mechanical tool for micro-scale fragmentation, with demonstrations being shown on an artificial kidney-stone and a polymer film (poly[(methylmethacrylate)-co-(Disperse Red 1 acrylate)], Sigma Aldrich; i.e., PMMA-copolymer).

First, the model stone is exposed to the focal zone of the type II lens (greater than 50 MPa in the peak positive). FIG. 5(*a*) shows the treatment results. The single spot on the upper position of artificial stone is destroyed by delivering greater than 1,000 pulses (or greater than 50 sec). Under this saturated exposure condition, the destroyed spot is about 300 to about 400 μm in size. For comparison, line patterns by short exposure to the LGFU are also produced. The stone is translated with a speed of about 0.4 mm/sec, while fixing the ultrasonic focal spot. This allows less than 30 pulses delivered on each position (or 1.5 sec dwell time) along the lines of the stone surface. The destroyed line width is about 150 μm. Such a dimension is an order of magnitude smaller than those from typical low-frequency transducers.

The zone of mechanical disruption zone can be controlled by changing the laser energy and thereby the high-pressure area at the focal spot. The disruption zone is determined by where the pressure amplitude is higher than a specific threshold level to destroy given physical structures, e.g., depending on hardness and acoustic impedance. In this experiment, the disruption zone of the model stone is larger than the full width at half maximum (FWHM) (type II lens, 100 μm) as the focal pressure is sufficiently high and then even the surrounding focal zone had higher pressure than the destruction threshold in the stone. The disruption zone can be much smaller than the FWHM by reducing the high-frequency and high-amplitude focused ultrasound energy (LGFU) amplitude. As shown in FIG. 5(*b*), a micro-hole can be produced on the polymer film. Here, the polymer film is coated on the glass substrate for microscopic visualization. The micro-hole produced by a single LGFU pulse of certain embodiments of the present disclosure as a micro-scale polymer piece is torn off from the substrate by the highly focused ultrasound. A typical dimension of the micro-hole is about 6 to about 15 μm.

Then, cavitational contribution is investigated in the fragmentation process by using a high-speed recording system on an inverted microscope. FIG. 5(*c*) shows the focal spot image including a cloud of micro-bubbles formed on the polymer film. The LGFU amplitude is about 40 MPa in the peak positive and higher than the cavitation threshold in the negative. As the LGFU-treated spot is scanned from the bottom to the top direction in FIG. 5(*c*), it leaves many bright dots due to the torn-off polymer micro-pieces. FIG. 5(*d*) is taken in the same spot, but about 1.5 seconds after the image of FIG. 5(*c*). The prolonged exposure produced more micro-cracks than in FIG. 5(*c*). As the defect regions, including such micro-cracks, facilitate the cavitation process (indicated by the black arrows), the fragmentation is expedited by the collapse of the collateral micro-bubbles in contact with the polymer.

In other aspects, the high-frequency and high-amplitude focused ultrasound energy of the LGFU can be used for targeting cell removal with high precision. The high-precision mechanical disruption of the LGFU is further exploited for a single-cell surgery by removing individual cells from substrates and from neighboring cells. FIG. 6(*a*) shows human ovarian cancer cells (2 days after inoculation) before the ultrasound exposure. The cells are cultured on the PMMA-copolymer film that is used as an adhesion layer on the glass substrate. FIG. 6(*b*) shows the result of LGFU exposure according to certain aspects of the present disclosure (having 27 MPa at the peak positive). The LGFU has a high enough resolution to be capable of selectively removing a single cell within the white dotted region. Continuously, the LGFU spot is slightly moved to the adjacent region (black dotted) where the cell-cell junction is formed beforehand. As shown in FIG. 6(*c*), the single cellular junction can be precisely ruptured by the LGFU generated. Several to tens of LGFU pulses are used to detach the cells, depending on the individual cell shape on the substrate and the formation of cellular network with the surrounding cells. The disruption dimension under control is about 25 μm in the LGFU amplitude of 27 MPa in the peak positive, which is smaller than the FWHM of the focal spot. Under the higher pressure regime (greater than 50 MPa) that results in a wider disruption zone, a cluster of cells over 100 μm in diameter can be removed.

In another example, high-frequency, high-amplitude, light-generated focused ultrasound (LGFU) according to certain aspects of the present teachings are used as a non-contact, non-thermal, high-precision tool to fractionate and cleave cell clusters cultured on glass substrates. In this example, fractionation processes are investigated in detail, which confirms distinct cell behaviors in the focal center and the periphery of LGFU spot. Such ultrasonic micro-fractionation is readily available for in vitro cell patterning and harvesting. Moreover, this example demonstrates the ability to use LGFU in accordance with certain aspects of the present disclosure for high-precision surgery applications.

Focused ultrasound with high intensity or high peak pressure can produce localized disruptions in terms of acoustic cavitation, streaming, and heat deposition. These effects have been broadly utilized for non-contact therapeutic applications such as shockwave lithotripsy, hyperthermia-based tumor treatment, and thrombolysis. In the local disruption process, cavitational disturbances are of interest because they can disintegrate tissues non-thermally (known as histotripsy) and facilitate thermal ablation processes collaboratively. Furthermore, the cavitational impacts, together with shock-induced effects, have offered great potentials for in vitro cellular engineering in terms of selective cell detachment, patterning, and harvesting for cell-based assays and secondary analyses. However, as discussed above, conventionally most of these ultrasonic disruptions are available over a bulky focal dimension (typically several mm) due to low operation frequencies (a few MHz) of existing high-pressure transducers. Such dimensions are unsuitable not only for performing micro-scale therapies and cellular engineering, but also for exploring microscopic interaction mechanisms with cells in a new regime.

Higher precision has been recently achieved by high-frequency, high-amplitude, light-generated focused ultrasound (LGFU) that simultaneously allows single-pulsed cavitation in a controllable and on-demand manner. High peak pressures of tens of MPa can be tightly focused onto a spot diameter of less than or equal to about 100 μm due to inherent high-frequency characteristics of the optoacoustic generation (centered at about 15 MHz with a 6-dB cutoff around 30 MHz). Thus, LGFU-induced disruptions can be conducted in a micro-scale regime, enabling single-cell detachment and trans-membrane delivery over a few cells. Particularly, acoustic cavitation under LGFU can be delicately controlled with pressure amplitudes near a cavitation threshold. This allows a tightly confined impact only at the focal center (less than or equal to about 60 μm in diameter for a given 6-dB focal spot of about 100 μm), barely affecting the peripheral region. Such focal disruption mechanism is partly clarified as originated from micro-jet formation upon bubble collapse. However, more details regarding bubble growth and collapse are explored here.

In this example, a dense cluster of cultured cells is fractionated and cleaved with sharpness defined by LGFU. In the micro-cutting process, radial disturbances over the peripheral region of focal spot that facilitate cell cluster separation are investigated. Then, LGFU-induced cavitation and shockwaves are investigated without cells to clarify surface-mediated mechanisms due to cavitation and shockwaves. Micro-scale disturbances are visualized by laser-flash photography over the focal and the peripheral zones, which can be responsible for the cell cluster fractionation.

Two distinct optoacoustic lenses are formed and used in this example. One has a 12 mm diameter and 11.46 mm radius of curvature for cell experiments, and the other has 6 mm diameter and 5.5 mm radius of curvature for the laser shadowgraphy. Each lens has a carbon nanotube-polymer (CNT) composite film on a concave surface, working as an optoacoustic conversion layer. Multi-walled CNTs are grown on fused silica concave substrates by chemical vapor deposition, and then coated by a 20-nm thick Au layer by using an electron-beam evaporation process. The Au deposition further enhances the optical extinction of the as-grown CNT film of greater than or equal to about 85%. Finally, the CNT film is spin-coated by polydimethylsiloxane (PDMS). The nano-composite film thickness is approximately 16 μm (±20%) on the spherical curvature. The Grüneisen parameter is calculated as 0.72, obtained from the physical properties of PDMS.

LGFU has a bipolar waveform with a sharp positive shock front followed by a broad tensile phase (single pulse duration is less than about 100 ns). It has a center frequency around 15 MHz and 6-dB roll-off points at 7 and 30 MHz, measured by using a broadband fiber-optic hydrophone. The 12-mm lens with a longer focal distance allows more spacing and convenient ultrasonic alignment with an optical microscope. The optoacoustic lenses are excited with a 6-ns pulsed laser beam (532-nm wavelength; Surelite I-20, Continuum, Santa Clara, Calif., USA) with an energy of 20-60 mJ/pulse that allows LGFU to produce cavitation. The laser energy is measured at the lens location. LGFU from the 12 mm lens had 6-dB focal widths of 100 μm (lateral) and 650 μm (axial). The 6-mm lens allows slightly tighter dimensions of 75 μm and 400 μm, respectively.

An LGFU setup is prepared on an inverted microscope (FIG. 23(*a*)). In 23(*a*), BE is a beam expander, F is an optical filter, HL is a halogen lamp, L is an objective lens, M is a mirror, ND is a neutral density filter, OL is an optoacoustic lens, PL is a Nd:YAG pulsed laser beam (6-ns pulse width), and S is a supporting frame. The pulsed laser beam (initially, 5 mm diameter) is expanded by 5-fold and collimated. The optoacoustic lens, mounted on a 3-dimensional motion stage, is irradiated uniformly with the enlarged beam. A spacer (made of UV-curable epoxy) is used that is attached on the side of the optoacoustic lens. The bottom surface of the fixed-length spacer easily guides the acoustic focal plane. Once the bottom is in contact with the surface of 4-inch petri-dish, the optoacoustic lens is slightly lifted to compensate for an offset due to the culture substrate thickness. This locates the ultrasonic focus exactly on the cells.

A halogen lamp is used as an illumination source for optical imaging. A notch filter (centered at 532-nm wavelength; Edmund Optics, Barrington, N.J.) is used to block the scattered laser from being incident to the detector. The images are recorded by a charge-coupled device (CCD).

SKOV3 ovarian cancer cells are cultured on polymer-coated glass substrates with two different confluences. First, a densely packed cell cluster is prepared for the ultrasonic cutting experiment. A surface-modified polymer film is used for adhesion promotion of the high-density cells. The other cells are cultured in a relatively low density to form a sparse network on the substrate. All the process of ultrasonic alignment and cell detachment are confirmed microscopically.

A laser-flash shadowgraphy setup is prepared without the optical microscope (FIG. 23(*b*)). In FIG. 23(*b*), LD is a laser diode, OSC is a digital oscilloscope, PD is a photodetector, probe is a probe laser beam (1-ns pulse width), SP is a supporting plate, TRG/DL is a trigger and delay generator unit, and ZL is a zoom lens. The same pulsed laser is used as a pump for the optoacoustic excitation. A probe beam (UV-pumped dye laser, 1-ns pulse duration) is chosen to provide fast temporal resolution and sufficient illumination for high-contrast imaging along the laser path. A fiber-optic hydrophone (125-μm diameter) is placed at the focal zone as a guidance of ultrasonic focus as well as a supporting boundary to induce cavitation. A glass supporter firmly holds the thin fiber (glued with a UV-curable epoxy). The optoacoustic lens (6-mm diameter) and the glass supporter are mounted to 3-dimensional motion stages, respectively. LGFU is measured using the fiber-optic hydrophone with a broad bandwidth up to 75 MHz.

Although the fiber detects the pressure in a perpendicular alignment to the optoacoustic lens axis as shown in FIG. 23(*b*), the hydrophone sensitivity is sufficient to find the ultrasound focus. Once the focal spot is located, then the fiber is slightly moved down to work as a cavitation boundary. Simultaneously, the cylindrical fiber is used as a thin optical object in the perpendicular direction to find a shadowgraphic focus. A pulse repetition rate of the probe beam is less than or equal to 20 Hz. Using the trigger-and-delay unit (TRG/DL) (DG535, Stanford Research Systems, Sunnyvale, Calif., USA), the pump beam, the probe beam, the oscilloscope, and the CCD are synchronized. A proper time delay is given between the pump and the probe pulses to obtain an instantaneous image in each step of LGFU-induced disruption processes. Finally, the shadowgraphic images are recorded by the CCD.

Using LGFU, a chunk of cell cluster cultured on a glass substrate is cut. The laser energy (E) of greater than or equal to about 50 mJ/pulse is used to generate the focused ultrasound, resulting in pressure amplitudes of greater than or equal to about 50 MPa in the peak positive and higher than the cavitation threshold in the peak negative (estimated amplitude: greater than or equal to about 20 MPa). The laser energy is >4.5 fold higher than the threshold value ($E_{th}$=11 mJ/pulse for the 12 mm optoacoustic lens) to generate the cavitation. In this regime, a generation rate of cavitation per a single LGFU pulse is approximately 100% on the glass substrate.

In FIGS. 24(*a*) to 24(*e*) micro-fractionation by LGFU is demonstrated by showing a sequential process of ultrasonic cleaving, displayed as a series of photographs captured from video recording. The LGFU spot is guided by the concentric circles that indicate a focal center and a periphery. The disruption zones are guided by the inner and outer circles (35 and 90 μm in diameter, respectively). The LGFU spot is fixed while the cell culture plate is slowly moved to the upper-right direction in FIGS. 24(*a*) to 24(*e*), which are separated according to cell fractionation behaviors. A captured time (t) is shown on the right-top corner (unit: second): FIG. 24(*a*). The cultured cell cluster is shown with a target spot. In FIG. 24(*b*), under LGFU, the cluster is fractionated primarily at the focal center. In FIG. 24(*c*), the prolonged exposure of LGFU enlarges the fractionated zone over the periphery. In FIGS. 24(*c*) to 24(*e*), as the cluster is moved, LGFU finally cleaves it into two pieces.

Under the LGFU exposure in FIG. 24(*b*), the cell cluster is disintegrated mostly within the inner zone. Then, the prolonged LGFU exposure over FIGS. 24(*c*) and 24(*d*) swept away the peripheral cells, noticeably widening the damage zone. Here, two phenomena are observed. First, individual cell detachment is frequently observed at the focal center. The cells at the focal center are exposed to the sharply focused shockwave (greater than or equal to about 50 MPa) and cavitational disturbances in terms of a collapse-induced liquid jet and secondary shockwaves toward the focal center. Second, also observed is the fact that the cells in the peripheral region (i.e. outer circle) are pushed away radially from the focal center, rather than individually detached. This outward effect can be attributed primarily to a cavitation-induced liquid jet along the wall. Such "pushing effect" in the periphery facilitated the cleaving process. The peripheral effect is distinctively observed after the focal fractionation shown in FIG. 24(*b*). This means that the peripheral disruption requires continual and repetitive LGFU exposure as compared to the focal center (a pulse repetition rate of LGFU=20 Hz). During the steps of FIGS. 24(*c*) to 24(*e*), the cell culture plate is moved slightly to the upper-right direction. The cluster is completely cut after 32-second exposure as shown in FIG. 24(*e*). From the results of FIGS. 24 (*a*)-24(*e*), it is confirmed that the cell cluster can be ultrasonically fractionated and divided by collateral disruptions over the center and the periphery of LGFU spot.

It is interesting to note that the cells exhibit different behaviors with respect to their location under the ultrasound focal zone. The outward pushing effect on the peripheral region is confirmed, using cells cultured sparsely on the substrate (FIG. 25(*a*)). These spread cells, cultured with low density (less than about 200 cells/mm$^2$), allows easy observation of fine variation on their morphology that can be overlooked in the densely packed cells. LGFU is produced using E=about 20 to about 25 mJ/pulse. As shown in FIG. 25(*b*), the cell-cell junction is quickly disconnected within the central zone. In FIG. 25(*c*), the LGFU spot is repositioned by moving the cell culture plate. The spot stays at almost the same position during the steps of FIGS. 25(*c*) to 25(*e*). In these steps, the cell morphology is deformed along the radial directions (arrows in FIG. 25(*d*)). The comparison of FIGS. 25(*c*) and 25(*e*) clearly reveals that the cells are deformed as they retreat outwards, as indicated by two small arrows in FIG. 25(*e*). The cellular junction is stretched by these radial forces (a bidirectional arrow in FIG. 25(*e*)). The cell deformation is observed even over 300-μm diameter in FIG. 25(*e*). Such damage dimension varies along individual cell morphology and adhesion on the substrate. Again, the relatively slow process over about 10 to about 20 seconds means that the cells are swept away by the repeated disturbances under the prolonged LGFU exposure.

Although the cell clusters are controllably and sharply cleaved by LGFU, the fractionation mechanisms are further explored herein. Here, a control experiment without cells is performed to elucidate the background mechanisms mainly associated with cavitational disturbances. A laser-flash shadowgraphic technique is used to fully visualize instantaneous microscopic processes under LGFU and to provide reasonable hypotheses for the focal and peripheral disruptions.

Entire procedures of the LGFU-induced disruption are shown in FIGS. 26(*a*)(1)-26(*d*)(2), from the incidence of the focused ultrasound wave successively to the bubble collapse moment. LGFU is incident from left to right onto the glass fiber, which has a fiber thickness of 125 μm for all figures. The LGFU axis is perpendicular to the shadowgraphic images. The wave fronts are indicated by the arrows. FIGS. 26(*a*)(1)-26(*d*)(2) show shadowgraphic imaging of LGFU-induced disruptions, where the instantaneous images are shown sequentially. In 26(*a*)(1)-26(*a*)(3), incidence of LGFU from the left to the right is shown. The top row (FIGS. 26(*a*)(1)-26(*d*)(2)) shows the LGFU propagation process before the inception of cavitation. As the shock front of LGFU has greater than or equal to about 50 MPa in the peak amplitude, local variation of water density is clearly visualized with high contrast.

The second row (FIGS. 26(*b*)(1)-26(*b*)(3)) shows an initial stage of cavitation containing tiny bubbles. The tiny bubbles are generated under LGFU with the outgoing pressure wave (thin arrow). Formation of these bubbles can push out the surrounding water, producing an outgoing pressure wave. Note that the generated wave front FIG. 26(*b*)(1) agrees with the region of tiny bubbles. Specifically, two wave fronts at this moment are marked. The incident wave front propagating rightward (marked as I) appears as a dark line that is almost interfaced with the right fiber surface. The reflected wave front (marked as R) is located in the left, which has the same propagation distance with that of the incident wave from the nucleation boundary (i.e. the left fiber surface). As shown here, there is a time delay between the bubble-induced outgoing pressure wave (thin white arrow) and the incident wave (I). This can be calculated as approximately 40 ns through the image that approximately agrees with the temporal difference between positive and negative phases of the bipolar LGFU waveform. This means that the bubble-induced outgoing wave front is due to the negative pressure exerting on the boundary, rather than the direct scattering of the incident shockwave. While the initial evolution of cavitation takes places over a short period of a few 100 ns, the following steps progress over a relatively long duration FIGS. 26(*c*)(1)-26(*c*)(4) along with the bubble lifetime, about 14 to about 15 μs in this example. Thus, FIGS. 26(*c*)(1)-26(*c*)(2) show cloud formation by the merging of bubbles, while FIGS. 26(*c*)(3)-26(*c*)(4) show shrinkage steps. After the growth and shrinkage steps, the collapse-induced shock emission FIG. 26(*d*)(1) that propagates to the outgoing direction. FIG. 26(*d*)(1) is a collapse-induced shock shown as the spherical wave front (arrow). As the right half-portion of this spherical shockwave is reflected from the substrate, two shock fronts appear in FIG. 26(*d*)(2). FIG. 26(*d*)(2) shows shock propagation by the left arrow (a direct outgoing wave) and the right arrow (a reflected wave from the substrate).

Without limiting the present teachings to any particular theory, with the visual evidence of focal and peripheral disruptions provided by the high-speed shadowgraphy, the cell fractionation mechanisms are believed to be as follows. Apparently, the cells at the focal center are exposed to stronger disturbances than those at the surrounding zone. In addition, micro-jetting can be formed as the merged bubble cloud is collapsed. This produces local stresses towards the focal center. Because all these effects are concentrated at the focal center, the single cells can be individually and sharply detached from the cluster.

The outward pushing mechanism over the peripheral region can be explained by a liquid jet along the wall. Following the bubble collapse, a transient liquid jet can be formed and directed toward the substrate surface, then spreading radially along the wall. It is believed that cultured cells can be detached by this wall jet-induced shear stress due to bubble collapse. It is known that impacts of such transient fluid depend on the location of the bubble above the surface.

For example, a radius of a cell detachment zone can be determined by bubble collapse ($R_{det}$) as a function of a stand-off distance of the bubble ($\gamma=h/R_{max}$ where h is the distance of the bubble center to the wall and $R_{max}$ is the maximum radius of the bubble). Similarly, from FIG. 26(*d*)(1), γ is about 0.39 for LGFU-induced bubble, which results in $R_{det}=0.72R_{max}=65$ μm. This means that cells within the diameter of $2R_{det}$ appear to undergo significant wall shear stress due to the liquid jet.

FIGS. 24(*a*)-24(*e*) show that the ultrasonic cleaving process substantially occurs within the diameter of $2R_{det}=130$ μm that is placed under the wall jet impact. The wall jet would lead to complete cell detachment within $2R_{det}$ if cells are monolayer-cultured. However, the cells in the cluster can be mechanically more resistive due to interconnections with neighboring cells and substratum, significantly increasing a critical shear stress for cell detachment. In FIGS. 24(*a*)-24(*e*), indeed, the outward pushing effect on the peripheral zone is primarily observed with less detachment. Thus, the wall shear stress can be responsible to the outward pushing effect over the periphery of focal spot.

It should be also noted that the wall shear stress gradually decreases over the radial distance. Therefore, cells in the vicinity of the detachment zone ($R>R_{det}$) can still be influenced by the shear stress. In FIGS. 25(*a*)-25(*e*), the sparsely cultured cells (mono or a few layers having a cell density less than about 200 cells/mm$^2$) can respond to delicate disturbance. Cell deformation can be observed over the region of $R>R_{det}$ (=65 μm) (FIGS. 25(*a*)-25(*e*)). Such a delicate change over the broad zone is not easily observed in the cell cluster.

Accordingly, LGFU-induced cavitation can produce various disruption mechanisms during bubble formation and collapse. Together with shock-induced effects by the incident LGFU, the cavitational disruptions are readily available for micro-patterning and harvesting of cultured cells. In these applications, a rigid substrate plays both roles as a nucleation boundary for micro-bubbles and a cell culture plate. For non-rigid substrates, such as tissue, a threshold pressure for cavitation can increase significantly in the high-frequency regime of LGFU. An intrinsic cavitation threshold ($P_{int}$) to induce micro-bubbles depends on acoustic properties of objects (e.g., tissues) and their morphological characteristics. In some cases, the cavitation requirement can be relaxed, for example, in fat ($P_{int}$ about −16 MPa at 1-MHz frequency) as compared in water (−27 MPa) and kidney (−30 MPa). As appreciated by those of skill in the art, the threshold can vary as external variables are taken into account, such as temperature and initial densities of nucleation sites in the surrounding liquid.

Thus, the inventive technology can be used for ultrasonic micro-fractionation of cell clusters. Using LGFU, a densely packed cell cluster can be cleaved with ultrasonic sharpness of 100 μm. The fractionation process is differentiated by the focal and the peripheral regions of LGFU spot. The cells are sharply disintegrated from the cluster at the focal center. In addition to the focal fractionation, the overall ultrasonic cutting process is facilitated by the peripheral effect that pushes away the surrounding cells out of the focal zone. The peripheral disturbances are further confirmed using a sparse cell network. The laser-flash shadowgraphic imaging successfully visualized LGFU-induced shockwaves and cavitation, providing detailed processes of bubble inception, growth, collapse, associated jetting and shock emissions. The fractionation mechanism can in part be explained by the outward pushing effect of the wall shear stress, for example, which makes primary impact within the diameter of $2R_{det}$=130 μm and gradually spreads into the vicinity. Accordingly, LGFU in accordance with the present teachings can be used as a non-contact, nonthermal modality for cellular and tissue applications such as ultrasonic cleaving, patterning, harvesting, trans-membrane molecular delivery, and high-precision in vivo surgery.

In this example, a spatio-temporal superposition approach using two ultrasound pulses is explored for producing a single-pulsed free-field cavitation in water over a tight focal zone of 100 μm. This configuration overlaps light-generated focused ultrasound (LGFU; 15-MHz frequency) with a low-frequency focal pressure generated by a piezoelectric transducer (3.5 MHz) in which a cavitation zone is primarily defined by the high-frequency focal spot. The generation rate of cavitation bubbles can be dramatically increased up to 4.1% (compared with about 0.06% without the superposition) with moderated threshold requirement. This provides an alternative way to produce pulsed cavitation with high precision, instead of using LGFU alone, which in certain applications, may require extremely high laser energy.

For example, a supporting substrate (e.g. glass or tissue surface) that plays a role to substantially enhance the pressure on the boundary surface by the overlap of the incident and reflected waves in cavitation under LGFU. For example, in certain aspects, incident pressure amplitude from the existing LGFU system can fall short of the tensile pressure threshold ($P_{th}$) to induce cavitation directly in water (deionized; 18.2 M ohm $cm^{-1}$) without the presence of a solid substrate. Although cavitation nuclei can be externally injected to the region of interest to moderate the threshold, it would be desirable to have a different method for comprehensive non-contact therapy. Optical heating by pulsed laser irradiation may be also used to reduce the threshold in situ under the focused ultrasound, but the treatment depth could be limited by strong light scattering. Thus, this example explores utilizing LGFU for pulsed cavitational therapy where "unbound" cavitation in water without any supporting substrate occurs for furthering non-contact treatment techniques.

A spatio-temporal superposition approach for two focused ultrasound waves in accordance with certain aspects of the present teachings, enables single-pulsed free-field cavitation in the middle of a water medium. The tight focal spot of LGFU (center frequency of about 15 MHz) is precisely overlapped onto the center of the other focal pressure, generated by a low-frequency piezoelectric transducer (about 3.5 MHz). Free-field cavitation is confirmed by high-speed photographic imaging and acoustic signal measurement due to bubble collapse. The high-speed imaging reveals that a tight cavitation zone of 100 μm can be produced in water, mainly determined by LGFU. This means that the main advantage of tight focusing with LGFU is realized. Moreover, the dual-focusing approach moderates the threshold requirement in terms of tensile pressure peak.

High-frequency, high-amplitude, light-generated focused ultrasound (LGFU) according to certain embodiments is produced by using two optoacoustic lenses (lens I and II), both of which have a carbon nanotube (CNT)-polymer composite film used as an ultrasound transmitter. The nanocomposite film is formed on the spherical surface and converts an incident laser beam (Nd:YAG, 6-ns pulse; Surelite I-20, Continuum) into focused ultrasound. The lens I has r=5.5 mm (radius of curvature) and d=6 mm (aperture diameter), and the lens II has larger dimension of r=9.2 mm and d=15 mm, respectively. These lenses are merely exemplary sizes for use in this experiment.

The low-frequency ultrasound pulse is generated by a piezoelectric transducer (25.4-mm diameter, 38.1-mm focal distance; Panametrics). The experimental schematic is shown in FIG. 27. First, each spatial focus is aligned into the same position, being guided by a fiber-optic hydrophone. The angle between two focal axes is about 65 to about 75°. Then, a delay generator temporally synchronizes two ultrasound pulses. The low-frequency piezoelectric ultrasound is first transmitted and followed by LGFU with time delay (Δt) to compensate different acoustic transit time: Δt=21.7 μs (lens I) and Δt=19.3 (lens II). Time lags ($t_{offset}$) due to the electronic operation of laser controller and piezoelectric pulser/receiver are also taken into account (i.e. $t_0+\Delta t+t_{offset,controller}=t_0+t_{offset,pulser}$). For cavitation measurement, the same piezoelectric transducer is used as a signal detector, which is connected to a digital oscilloscope (WaveSurfer 432, LeCroy). The signal on the oscilloscope is monitored to count the number of cavitation event.

FIGS. 28(*a*)-28(*c*) show the superposition process of two focused ultrasound waveforms that are measured by the fiber-optic hydrophone. The time shown in the horizontal axis is relatively defined, including internal delays of the pulser/receiver and the laser controller. The LGFU waveform in FIG. 28(*a*) is obtained using the lens I (shown at approximately 31.4 μs) before superposition. The lens II can produce a similar waveform. By application of the time delay, the superposed waveform can be obtained under precise tuning (FIG. 28(*b*)).

FIG. 28(*c*) shows acoustic frequency spectra obtained from each pulse shown in FIG. 28(*a*). The primary peak of each spectrum is located around 3.5 and 15 MHz, respectively. Here, as guidance to show the superposition process, low laser energy (E) of 6 mJ/pulse is used, although this is non-limiting. This produces the pressure peaks of +10 MPa and −7 MPa in which the tensile peak is much lower than the cavitation threshold on the fiber surface. LGFU with E=14 mJ/pulse produces cavitation on the fiber or glass substrate. This laser energy ($E_{th}$) is used as a reference value in this example. The 3.5-MHz pressure pulse is shown at greater than or equal to about 31.9 μs with the long oscillatory tail. The first negative peak at 32.2 μs chosen for superposition with LGFU.

Free-field cavitation in water is confirmed by high-speed photographic imaging. For comparison, FIG. 29(*a*) shows an image without cavitation where only the optoacoustic transmitter (lens II) is used. The fiber is pulled out of the focal zone. The fiber is used to find the focal spot and keep an optical focus of camera. As the fiber is moved back to the focal zone in FIG. 29(*b*), the cavitation bubble is observed on the fiber surface, which is shown with the hemispherical contour. The images in FIGS. 29(*b*) and 29(*c*) are obtained under the dual-focusing configuration. In FIG. 29(*c*), the free-field cavitation is clearly observed without any supporting substrate (indicated by the arrow). The cavitation can be produced over a micro-scale zone of 100 μm (lateral) by 155 μm (longitudinal). This confirms that the cavitation zone is primarily determined by the sharper spot produced by LGFU pulse.

Then, cavitation signal due to collapse-induced acoustic transient is measured. The piezoelectric and optoacoustic transmitters are turned on and off alternately, and then turned on simultaneously as shown in FIGS. 30(*a*) to 30(*c*). Each mode of operation is described schematically to the right of measured waveforms. The lens I is used for LGFU. The artifact at about 50 to about 60 μs (dotted arrow) is due to acoustic reflection from the fiber hydrophone. No cavitation signal is observed under the single transmitter, either piezoelectric (FIG. 30(*a*)) or optoacoustic (FIG. 30(*b*)). In contrast, the collapse-induced transient is detected under the superposed ultrasound (FIG. 30(*c*); thick arrow) by the same piezoelectric transducer. A bubble lifetime is several to a few tens of μs.

The cavitation process is quantified in terms of the generation rate of cavitation bubble (η) that is determined by the number of detected collapse events per the number of incident ultrasound pulses. A single experiment is performed during 30 seconds using 600 ultrasound pulses. In FIG. 30(*d*), the generation rates are determined by using 1,800 to about 3,600 ultrasound pulses. Only with LGFU, cavitation is rarely generated: η=0% with E=18 mJ/pulse (=1.3$E_{th}$) and η=0.06% with E=56 mJ/pulse (=4$E_{th}$). LGFU alone with these laser energies produces a peak negative of about 15 and about 25 MPa, respectively. This shows potential difficulty of obtaining the cavitation in water by LGFU alone when using such low laser energies. On the glass substrate, η of approximately 100% can be easily obtained with the laser energy as low as E=1.3$E_{th}$. By the superposition of two waveforms, η in water can be dramatically increased up to 4.1% (=74 events/1800 pulses) with E=56 mJ/pulse and 1.5% (=27 events/1800 pulses) with E=18 mJ/pulse. For both cases, the same pressure from the piezoelectric transmitter is used (−7.5 MPa at 32.2 μs). Finally, without LGFU, the 3.5-MHz focused ultrasound hardly produced cavitation with η=0.06% (=2 events/3600 pulses). The cavitation could be produced using just E=1.3$E_{th}$ under the superposition. In this condition, the superposition increases the tensile pressure of LGFU (15 MPa) by 7.5 MPa, resulting in 22.5 MPa in the overlapped peak. This is lower than that of LGFU alone with E=4$E_{th}$ (~25 MPa) that leads to almost no cavitation (η=0.06%). Accordingly, the dual-focusing ultrasound approach provided in accordance with the present technology moderated the threshold requirement.

While not limiting the present disclosure to any particular theory, the free-field cavitation is believed to be explained by two mechanisms: shockwave interaction with tiny cavities and enhanced acoustic intensity. Here, the measurement sensitivity of cavitation is limited only to the acoustic signal that is originated from violent collapse of relatively large bubbles with lifetime of greater than several μs. However, the generation of micro-cavities with shorter lifetime is highly possible during the tensile phase of LGFU. The created tiny cavities are then immediately exposed to the steep shock front (~32.2 μs in FIG. 28(*b*)) that is a part of the low-frequency ultrasound waveform. Because acoustic reflection from the air cavity (reflectivity==1) turns the sharp positive amplitude into a largely negative one, the shock interaction can greatly increase the number of cavitation bubbles. This process facilitates formation of a bubble cloud that eventually collapses with observable signal.

In the other way, the cavitation process can be promoted by an enhanced acoustic intensity. Under the superposition, the low-frequency waveform provides a broad tensile atmosphere formed over a relatively long period that accumulates significant acoustic energy. While the single tensile period of LGFU is as short as approximately 40 ns, the initial tensile phase of the 3.5-MHz ultrasound waveform in FIG. 28(*a*) prolongs over approximately 175 ns. This enhances the intensity that leads to ultrasonic absorption and heating as a favorable condition for cavitation.

In summary, this example successfully demonstrates a superposed configuration of high-frequency, high-amplitude, light-generated focused ultrasound LGFU (with a center frequency of 15 MHz) and low-frequency focused ultrasound (3.5 MHz) produced by the piezoelectric transducer. Such an embodiment enables single-pulsed free-field cavitation in water. Due to the sharp focusing by LGFU, the cavitation zone can be confined to the spatial dimension of 100 μm (lateral) by 155 μm (longitudinal). Under the superposition, the free-field cavitation is produced with the reduced threshold in terms of tensile peak pressure. Moreover, the laser energy to excite the optoacoustic lens (E=18 mJ/pulse) could be significantly reduced to lower than ⅓ of what is required for LGFU alone (E=56 mJ/pulse). It is believed that shockwave interaction and enhanced acoustic intensity may be the mechanisms responsible for cavitation. The dual-focusing approach can be used for high-precision pulsed cavitational therapy guided by ultrasonic imaging in which the same piezoelectric transducer is employed as a receiver.

Thus, focused optoacoustic transmitters prepared in accordance with various aspects of the present teachings can generate sufficient pressure amplitudes to induce shock waves and cavitation at tight focal spots, particularly suitable for surgical techniques. However, the experimental values discussed here are merely exemplary and not limiting for the inventive LGFU techniques, as the values depend on arcuate lens design, pulsed lasers for optical excitation, and nano-composite layer properties. It should be noted that in certain alternative variations, an optoacoustic lens may be in the form of a fiber structure that comprises a concave composite layer or in the form of an optical zone plate with a substantially planar and flat composite layer. The composite layer may comprise a plurality of light absorbing particles and a dielectric material having a high coefficient of volume thermal expansion greater than or equal to about $1\times10^{-5}\times K^{-1}$, and optionally in certain variations, greater than or equal to about $5\times10^{-4}$ $K^{-1}$. When light energy from a light source is directed to the optoacoustic lens, it is capable of generating high-frequency and high-amplitude focused ultrasound having a frequency of greater than or equal to about 10 MHz and an output pressure of greater than or equal to about 10 MPa. Such a photoacoustic lens can be used for surgical applications, such as endoscopic and intravascular surgical techniques. Surgery can be targeted at tissue by the photoacoustic lens with micro-scale accuracy to cut or ablate the tissue, while avoiding nearby sensitive or dangerous regions, such as nerves, where LGFU can be directed without significant attenuation. Examples will include, but are not limited to, the subdermal tissues by an extracorporeal manner and the vasculatures that can be reached using an endoscopic platform.

One of the key advantages in the inventive high-frequency and high-amplitude focused ultrasound energy of the LGFU is the compact dimension of the transmitters. As the pressure amplitudes achieved are greater than 50 MPa from a lens with 6-mm diameter, it is contemplated that a few tens of MPa is available from smaller lenses (a diameter of less than or equal to about 3 mm, for example), which is suitable for intra-vascular and intra-operative applications. The output pressure can be further enhanced by enhancing composite properties and using the lenses with lower f-numbers. Therefore, the LGFU transmitters are suitable for non-contact mechanical surgery in endoscopic platforms, for example. As discussed previously above in the context of the laser energy source, LGFU performance, in terms of pressure amplitude, intensity, frequency spectrum, and focal spot sizes, can be controlled externally by the excitation lasers.

For high-pressure amplitudes, narrow pulse widths are typically more preferable because the far-field optoacoustic pressure is proportional to the time-derivative of the original laser pulse. The narrower temporal pulse also increases the operation frequency resulting in a tighter focus. An SPPA intensity of the LGFU is less than 0.2 $W/cm^2$ due to the low repetition rate. For high-intensity applications, lasers with high repetition rates (greater than about 100 kHz), similar pulse energy (tens of mJ), and temporal width (5 to about 8 ns) can be used. For example, a pulse repetition of greater than 1 kHz can result in greater than 100 $W/cm^2$ of pressure intensity. This accumulates significant heat at focal volumes. The heating can be an important mechanism for certain thermal ablation-based therapy. Such regimes resulting in heating, rather than mechanical disruption, should generally be avoided for applications like drug delivery and thrombolysis, to avoid irreversible thermal effects. In the cell therapy applications, slight temperature changes of a few ° C. can cause transformation of the cellular metabolism, thus heating in such applications should be avoided, as appreciated by those of skill in the art.

Single-cell removal from substrates and the surrounding cell networks is demonstrated as part of the inventive technology, as an example of high-precision treatment which cannot be achieved by conventional low-frequency, high-amplitude ultrasound. As the inventive LGFU devices and methods are capable of accuracy to the single-cell level, this technique can be extended into delicate tissue structures and fine vasculatures as a means of a non-contact and non-thermal surgery. In terms of cell detachment mechanism, the LGFU-induced shock can directly break cell adhesion with the surrounding contacts. Moreover, as the micro-bubbles quickly grow and collapse at the targeted spot, these produce localized liquid jet-stream and secondary shock waves. These become strong disruption sources to the cell in contact or just from a distance of tens of μm. The polymer film is used as a cell supporting layer. Therefore, it is also possible to destroy the polymer film underneath the cells, which form physical contacts. As the polymer falls off, the cells lose their sites to the substrates. Without the polymer supporting layer, the threshold pressure for the cell detachment will depend on specific adhesion strength of the cells to substrates as well as the substrate conditions to induce the cavitation in terms of acoustic impedance and surface topography.

In certain variations, the present disclosure provides a method for surgery, lithotripsy, or ablation employing ultrasound energy. The method may comprise generating a high-frequency and high-amplitude focused ultrasound energy by directing laser energy at an optoacoustic lens comprising a concave composite layer comprising a polymeric material and a plurality of light absorbing particles. In certain aspects, the optoacoustic lens has an f-number (f#) of less than or equal to about 1. While any of the variations described above are contemplated, in certain variations, the concave composite layer has a thickness or depth of optical absorption of less than or equal to about 30 μm and the high-frequency and high-amplitude focused ultrasound energy has a frequency of greater than or equal to about 10 MHz and an output pressure of greater than or equal to about 10 MPa. The method further comprises directing the high-frequency and high-amplitude focused ultrasound energy at a target, where the focal spot of the generated high-frequency and high-amplitude focused ultrasound energy has a lateral dimension of less than or equal to about 200 μm and an axial dimension of less than or equal to about 1,000 μm.

In certain variations, the target may be in vitro or in vivo. For example, the target may be within an organism. In certain variations, the target is selected from the group consisting of: a cell, an organ, tissue, a tumor, vasculature, and an abnormal growth. The method in certain aspects may further comprise generating an ultrasonic energy by another piezoelectric transducer to produce low-frequency focused ultrasound, for example having a frequency of less than or equal to about 10 MHz. Typical HIFU transducers operating with a few MHz frequency (or any high-amplitude transducers generating higher MPa amplitudes) can be easily adopted to make superposition with LGFU and strengthen the pressure amplitude. The complementary transducer has a wider focal spot than that of LGFU, so an ultrasonic disruption zone is primarily determined by LGFU that operates with a higher frequency. The directing thus comprises directing both the low-frequency ultrasound and the high-frequency and high-amplitude focused ultrasound energy at the target, resulting in the dual-focusing ultrasound approach provided in accordance with certain aspects of the present teachings discussed previously above to facilitate free-field cavitation.

Thus, the present teachings provide a new approach to optoacoustically generating high-frequency and high-amplitude focused ultrasound. The unprecedented optoacoustic pressure is achieved due to the efficient optoacoustic energy conversion in the nano-composites of gold-coated CNTs and PDMS, the high-frequency nature of laser pulses, and the high focal gain from the low f-number lenses. The type I lens with 6-mm diameter can generate the pressure amplitudes of greater than 50 MPa in the peak positive and higher than the cavitation threshold in the peak negative on the tight focal width of 75 μm in lateral and 400 μm in axial directions. The cavitation bubbles are tens of μm in dimensions and typical lifetime is shorter than 20 μs. Various applications of non-contact mechanical disruption in high precision are contemplated, as discussed above, including micro-scale fragmentation of solid materials and targeted cell surgery. The dimension of mechanical disruption can be controlled from 6 μm up to 400 μm depending on the laser intensity and the incident LGFU amplitude. In the cell surgery, selective removal of a single cell from a substrate and from the neighboring cells with accuracy of 25 μm or less is possible. The LGFU provided by the present teachings has great flexibility in terms of transmitter designs and excitation laser choices to control ultrasonic frequencies, amplitudes, and intensities. Such LGFU techniques are a versatile modality for use as a high-accuracy tool for ultrasonic therapy of cells, blood vessels, and tissue layers.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A high-frequency light-generated focused ultrasound (LGFU) device, comprising:

a source of light energy; and an arcuate optoacoustic lens comprising a composite layer that comprises a plurality of light absorbing particles and a dielectric material having a coefficient of volume thermal expansion greater than or equal to about $1\times10^{-5}\times K^{-1}$; wherein when the light energy is directed to the arcuate optoacoustic lens it is capable of generating focused ultrasound having a frequency of greater than or equal to about 10 MHz and an output pressure of greater than or equal to about 1 MPa.

2. The high-frequency light-generated focused ultrasound (LGFU) device of claim 1, wherein the arcuate optoacoustic lens is a concave lens.

3. The high-frequency light-generated focused ultrasound (LGFU) device of claim 1, wherein the arcuate optoacoustic lens has a geometrical design with an f-number (f#) of less than or equal to about 1.

4. The high-frequency light-generated focused ultrasound (LGFU) device of claim 1, wherein the composite layer has a depth of optical absorption less than or equal to about 30 μm.

5. The high-frequency light-generated focused ultrasound (LGFU) device of claim 1, wherein the light absorbing particles absorb greater than or equal to about 50% to less than or equal to about 100% of the light energy directed at the optoacoustic lens.

6. The high-frequency light-generated focused ultrasound (LGFU) device of claim 1, wherein the light absorbing particles comprise carbon nanotubes, graphene oxide, or combinations thereof.

7. The high-frequency light-generated focused ultrasound (LGFU) device of claim 6, wherein the light absorbing particles are coated with an electromagnetic absorption material comprising gold.

8. The high-frequency light-generated focused ultrasound (LGFU) device of claim 1, wherein the dielectric material is a polymer comprising polydimethylsiloxane.

9. The high-frequency light-generated focused ultrasound (LGFU) device of claim 1, wherein the optoacoustic lens has a focal spot of about 75 μm in a lateral dimension and about 400 μm in an axial dimension, when the source of light energy is a laser having a pulse width less than or equal to about 10 ns, a repetition rate of greater than or equal to about 10 Hz, and greater than or equal to about 10 mJ of laser energy per pulse.

10. The high-frequency light-generated focused ultrasound (LGFU) device of claim 1, wherein the coefficient of volume thermal expansion greater than or equal to about $5\times10^{-4}\ K^{-1}$.

11. The high-frequency light-generated focused ultrasound (LGFU) device of claim 1, wherein the light absorbing particles are axially shaped particles.

12. The high-frequency light-generated focused ultrasound (LGFU) device of claim 1, wherein composite layer is substantially free of carbon black particles.

13. The high-frequency light-generated focused ultrasound (LGFU) device of claim 1, wherein the output pressure of the focused ultrasound is greater than or equal to about 40 MPa.

14. A method of generating a high-frequency and high-amplitude focused ultrasound, the method comprising:

directing light energy at an arcuate optoacoustic lens that comprises a composite layer comprising a polymeric material and a plurality of light absorbing particles, wherein the composite layer has a depth of optical absorption less than or equal to about 30 μm, to generate a focused ultrasound having a frequency of greater than or equal to about 10 MHz and an output pressure of greater than or equal to about 1 MPa.

15. The method according to claim 14, wherein the arcuate optoacoustic lens is a concave lens having a geometrical design with an f-number (f#) of less than or equal to about 1.

* * * * *